US012232530B2

(12) United States Patent
Alston et al.

(10) Patent No.: US 12,232,530 B2
(45) **Date of Patent: *Feb. 25, 2025**

(54) VAPORIZER DEVICE WITH MORE THAN ONE HEATING ELEMENT

(71) Applicant: JUUL Labs, Inc., San Francisco, CA (US)

(72) Inventors: William W. Alston, Lincoln, CA (US); Adam Bowen, San Mateo, CA (US); Jacob R. Davis, San Francisco, CA (US); Ian Garcia-Doty, Oakland, CA (US); Bradley J. Ingebrethsen, Saugerties, NY (US); Joshua A. Kurzman, San Francisco, CA (US); James Monsees, San Francisco, CA (US); Andrew J. Pappas, San Francisco, CA (US); Paul R. Vieira, Oakland, CA (US); Timothy J. Watson, San Francisco, CA (US); Joseph S. Wilinski, Jr., San Francisco, CA (US)

(73) Assignee: JUUL Labs, Inc., Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/736,707

(22) Filed: May 4, 2022

(65) Prior Publication Data

US 2022/0279846 A1 Sep. 8, 2022

Related U.S. Application Data

(62) Division of application No. 16/679,057, filed on Nov. 8, 2019, now Pat. No. 11,350,664.

(Continued)

(51) Int. Cl.
*A24F 40/46* (2020.01)
*A24F 40/10* (2020.01)

(Continued)

(52) U.S. Cl.
CPC ..... *A24F 40/46* (2020.01); *A24F 40/10* (2020.01); *A24F 40/42* (2020.01); *A24F 40/30* (2020.01)

(58) Field of Classification Search
None
See application file for complete search history.

(56) References Cited

U.S. PATENT DOCUMENTS 720,007 A 10/1903 Dexter
1,165,000 A 12/1915 Dula (Continued)

FOREIGN PATENT DOCUMENTS

CA 2641869 A1 5/2010
CA 2940842 A1 9/2015

(Continued)

OTHER PUBLICATIONS

Becker, et al., "PTC Heating Elements—Background Analysis and Design Attributes", 8095 IEEE Transactions on Industry Applications IA-21 Jul./Aug. 1985 No. 4, New York.

(Continued)

*Primary Examiner* — James Harvey
(74) *Attorney, Agent, or Firm* — Mintz, Levin, Cohn, Ferris, Glovsky and Popeo, P.C.

(57) ABSTRACT

Various embodiments of a vaporization device are described that include one or more features, such as for generating a combined inhalable aerosol. In some embodiments, the vaporization device can include one or more heaters that are configured to heat one or more vaporizable materials. Vari- (Continued)

ous embodiments of heating elements and heating systems for use in vaporization devices are also described.

20 Claims, 48 Drawing Sheets

Related U.S. Application Data

(60) Provisional application No. 62/930,542, filed on Nov. 4, 2019, provisional application No. 62/898,522, filed on Sep. 10, 2019, provisional application No. 62/821,305, filed on Mar. 20, 2019, provisional application No. 62/816,452, filed on Mar. 11, 2019, provisional application No. 62/791,709, filed on Jan. 11, 2019, provisional application No. 62/757,689, filed on Nov. 8, 2018.

(51) Int. Cl.
*A24F 40/42* (2020.01)
*A24F 40/30* (2020.01)

(56) References Cited

U.S. PATENT DOCUMENTS

| | | | |
|---|---|---|---|
| 2,158,928 | A | 5/1939 | Sol |
| 3,292,634 | A | 12/1966 | Beucler et al. |
| 4,303,083 | A | 1/1981 | Burruss, Jr. |
| 4,708,151 | A | 11/1987 | Shelar |
| 4,771,796 | A | 9/1988 | Myer |
| 5,101,838 | A | 4/1992 | Schwartz et al. |
| 5,144,962 | A | 9/1992 | Counts et al. |
| 5,152,456 | A | 10/1992 | Ross et al. |
| 5,159,942 | A | 11/1992 | Brinkley et al. |
| 5,261,424 | A | 11/1993 | Sprinkel, Jr. |
| 5,497,791 | A | 3/1996 | Bowen et al. |
| 5,529,078 | A | 6/1996 | Rehder et al. |
| 5,564,442 | A | 10/1996 | MacDonald et al. |
| 5,708,258 | A | 1/1998 | Counts et al. |
| 6,095,153 | A | 8/2000 | Kessler et al. |
| 6,513,524 | B1 | 2/2003 | Storz |
| 6,603,924 | B2 | 8/2003 | Brown et al. |
| 6,772,756 | B2 | 8/2004 | Shayan |
| 7,040,314 | B2 | 5/2006 | Nguyen et al. |
| 7,434,584 | B2 | 10/2008 | Steinberg |
| 7,832,410 | B2 | 11/2010 | Hon |
| 8,371,310 | B2 | 2/2013 | Brenneise |
| 8,714,150 | B2 | 5/2014 | Alelov |
| 8,752,545 | B2 | 6/2014 | Buchberger |
| 8,794,231 | B2 | 8/2014 | Thorens et al. |
| 8,833,364 | B2 | 9/2014 | Buchberger |
| 8,881,737 | B2 | 11/2014 | Collett et al. |
| 8,910,639 | B2 | 12/2014 | Chang et al. |
| 8,948,578 | B2 | 2/2015 | Buchberger |
| 9,078,473 | B2 | 7/2015 | Worm et al. |
| 9,282,772 | B2 | 3/2016 | Tucker et al. |
| 9,364,800 | B2 | 6/2016 | Dubief |
| 9,462,832 | B2 | 10/2016 | Lord et al. |
| 9,497,999 | B2 | 11/2016 | Lord |
| 9,609,893 | B2 | 4/2017 | Novak, III et al. |
| 9,675,109 | B2 | 6/2017 | Monsees et al. |
| 9,717,276 | B2 | 8/2017 | Brammer et al. |
| 9,839,238 | B2 | 12/2017 | Worm et al. |
| 9,913,493 | B2 | 3/2018 | Worm et al. |
| 9,943,108 | B2 | 4/2018 | Lord |
| 9,974,335 | B2 | 5/2018 | Lord |
| 10,111,466 | B2 | 10/2018 | Lord |
| 10,194,689 | B2 | 2/2019 | Schennum et al. |
| 10,206,429 | B2 | 2/2019 | Davis et al. |
| 10,278,421 | B2 | 5/2019 | Lord |
| 10,278,424 | B2 | 5/2019 | Garthaffner et al. |
| 10,368,580 | B2 | 8/2019 | Rostami et al. |
| 10,375,990 | B2 | 8/2019 | Lord |
| 10,609,958 | B2 | 4/2020 | Robinson et al. |
| 10,653,180 | B2 | 5/2020 | Monsees et al. |
| 11,589,617 | B2 | 2/2023 | Trzecieski |
| 2002/0146242 | A1 | 10/2002 | Vieira |
| 2005/0016550 | A1 | 1/2005 | Katase |
| 2005/0067503 | A1 | 3/2005 | Katase |
| 2005/0150488 | A1 | 7/2005 | Dave |
| 2007/0006889 | A1 | 1/2007 | Kobal et al. |
| 2008/0023003 | A1 | 1/2008 | Rosenthal |
| 2008/0092912 | A1 | 4/2008 | Robinson et al. |
| 2008/0257367 | A1 | 10/2008 | Paterno et al. |
| 2009/0095287 | A1 | 4/2009 | Emarlou |
| 2009/0133691 | A1 | 5/2009 | Yamada et al. |
| 2009/0151717 | A1 | 6/2009 | Bowen et al. |
| 2009/0230117 | A1 | 9/2009 | Fernando et al. |
| 2009/0255534 | A1 | 10/2009 | Paterno |
| 2009/0283103 | A1 | 11/2009 | Nielsen et al. |
| 2009/0293892 | A1 | 12/2009 | Williams et al. |
| 2009/0302019 | A1 | 12/2009 | Selenski et al. |
| 2009/0314299 | A1 | 12/2009 | Kilpatrick |
| 2010/0006092 | A1 | 1/2010 | Hale et al. |
| 2010/0200006 | A1 | 12/2010 | Robinson et al. |
| 2010/0313901 | A1 | 12/2010 | Fernando et al. |
| 2011/0209717 | A1 | 1/2011 | Han |
| 2011/0030706 | A1 | 2/2011 | Gibson et al. |
| 2011/0036346 | A1 | 2/2011 | Cohen et al. |
| 2011/0126831 | A1 | 6/2011 | Fernandez |
| 2011/0265806 | A1 | 11/2011 | Alarcon et al. |
| 2012/0006343 | A1 | 1/2012 | Renaud et al. |
| 2012/0048266 | A1 | 3/2012 | Alelov |
| 2012/0199146 | A1 | 8/2012 | Marangos |
| 2012/0199572 | A1 | 8/2012 | Shen et al. |
| 2012/0255546 | A1 | 10/2012 | Goetz et al. |
| 2012/0260927 | A1 | 10/2012 | Liu |
| 2012/0325227 | A1 | 12/2012 | Robinson et al. |
| 2013/0014772 | A1 | 1/2013 | Liu |
| 2013/0160780 | A1 | 6/2013 | Matsumoto et al. |
| 2013/0220315 | A1 | 8/2013 | Conley et al. |
| 2013/0255702 | A1 | 10/2013 | Griffith et al. |
| 2013/0298905 | A1 | 11/2013 | Levin et al. |
| 2014/0000638 | A1 | 1/2014 | Sebastian et al. |
| 2014/0096782 | A1 | 4/2014 | Ampolini et al. |
| 2014/0123989 | A1 | 5/2014 | LaMothe |
| 2014/0209105 | A1 | 7/2014 | Sears et al. |
| 2014/0238424 | A1 | 8/2014 | Macko et al. |
| 2014/0261486 | A1 | 9/2014 | Potter et al. |
| 2014/0261487 | A1 | 9/2014 | Chapman et al. |
| 2014/0261491 | A1 | 9/2014 | Hawes |
| 2014/0190503 | A1 | 10/2014 | Li et al. |
| 2014/0345631 | A1 | 11/2014 | Bowen et al. |
| 2014/0345635 | A1 | 11/2014 | Rabinowitz et al. |
| 2014/0366902 | A1 | 12/2014 | Chiolini et al. |
| 2015/0047662 | A1 | 2/2015 | Hopps |
| 2015/0101606 | A1 | 4/2015 | White |
| 2015/0128966 | A1 | 5/2015 | Lord |
| 2015/0136153 | A1 | 5/2015 | Lord |
| 2015/0157055 | A1 | 6/2015 | Lord |
| 2015/0196059 | A1 | 7/2015 | Liu |
| 2015/0216236 | A1 | 8/2015 | Bless et al. |
| 2015/0237917 | A1 | 8/2015 | Lord |
| 2015/0245659 | A1 | 9/2015 | Depiano et al. |
| 2015/0245669 | A1 | 9/2015 | Cadieux et al. |
| 2015/0258289 | A1 | 9/2015 | Henry, Jr. et al. |
| 2015/0305409 | A1 | 10/2015 | Verleur et al. |
| 2015/0313284 | A1 | 11/2015 | Liu |
| 2015/0335070 | A1 | 11/2015 | Sears et al. |
| 2015/0374035 | A1 | 12/2015 | Sanchez et al. |
| 2016/0007653 | A1 | 1/2016 | Tu |
| 2016/0007654 | A1 | 1/2016 | Zhu |
| 2016/0021934 | A1 | 1/2016 | Cadieux et al. |
| 2016/0044967 | A1 | 2/2016 | Bowen et al. |
| 2016/0073693 | A1 | 3/2016 | Reevell |
| 2016/0081395 | A1 | 3/2016 | Thorens et al. |
| 2016/0106155 | A1 | 4/2016 | Reevell |
| 2016/0120218 | A1 | 5/2016 | Schennum et al. |
| 2016/0206000 | A1 | 7/2016 | Lord et al. |
| 2016/0219934 | A1 | 8/2016 | Li et al. |
| 2016/0242466 | A1 | 8/2016 | Lord et al. |
| 2016/0249682 | A1 | 9/2016 | Leadley et al. |
| 2016/0262453 | A1 | 9/2016 | Ampolini et al. |

(56) References Cited

U.S. PATENT DOCUMENTS

| | | | |
|---|---|---|---|
| 2016/0262454 | A1 | 9/2016 | Sears et al. |
| 2016/0262459 | A1 | 9/2016 | Monsees et al. |
| 2016/0309786 | A1 | 10/2016 | Holtz et al. |
| 2016/0331026 | A1 | 11/2016 | Cameron |
| 2016/0331030 | A1 | 11/2016 | Ampolini et al. |
| 2016/0331034 | A1 | 11/2016 | Cameron |
| 2017/0027226 | A1 | 2/2017 | Mironov et al. |
| 2017/0035113 | A1 | 2/2017 | Thorens |
| 2017/0127722 | A1 | 5/2017 | Davis et al. |
| 2017/0127725 | A1 | 5/2017 | Buchberger et al. |
| 2017/0135399 | A1 | 5/2017 | Gavrielov et al. |
| 2017/0135401 | A1 | 5/2017 | Dickens |
| 2017/0143038 | A1 | 5/2017 | Dickens |
| 2017/0143041 | A1 | 5/2017 | Batista et al. |
| 2017/0156403 | A1 | 6/2017 | Gill et al. |
| 2017/0164657 | A1 | 6/2017 | Batista |
| 2017/0181471 | A1 | 6/2017 | Phillips et al. |
| 2017/0188626 | A1 | 7/2017 | Davis et al. |
| 2017/0188629 | A1 | 7/2017 | Dickens et al. |
| 2017/0196268 | A1 | 7/2017 | Reevell |
| 2017/0208857 | A1 | 7/2017 | Branton et al. |
| 2017/0224014 | A1 | 8/2017 | Fraser |
| 2017/0231284 | A1 | 8/2017 | Newns et al. |
| 2017/0245543 | A1 | 8/2017 | Karles et al. |
| 2017/0251721 | A1 | 9/2017 | Rostami et al. |
| 2017/0258134 | A1 | 9/2017 | Kane |
| 2017/0258137 | A1 | 9/2017 | Smith et al. |
| 2017/0258138 | A1 | 9/2017 | Rostami et al. |
| 2017/0265524 | A1 | 9/2017 | Cadieux et al. |
| 2017/0280767 | A1 | 10/2017 | Li et al. |
| 2017/0280768 | A1 | 10/2017 | Lipowicz |
| 2017/0283154 | A1 | 10/2017 | Karles et al. |
| 2017/0290370 | A1 | 10/2017 | Garthaffner et al. |
| 2017/0303586 | A1 | 10/2017 | Sur |
| 2017/0325502 | A1 | 11/2017 | Nelson et al. |
| 2017/0325506 | A1 | 11/2017 | Batista et al. |
| 2017/0333650 | A1 | 11/2017 | Buchberger et al. |
| 2017/0347706 | A1 | 12/2017 | Aoun et al. |
| 2018/0000158 | A1 | 1/2018 | Ewing et al. |
| 2018/0016040 | A1 | 1/2018 | Ewing et al. |
| 2018/0027875 | A1 | 2/2018 | Rostami et al. |
| 2018/0027879 | A1 | 2/2018 | Gavrielov et al. |
| 2018/0035717 | A1 | 2/2018 | Batista |
| 2018/0070633 | A1 | 3/2018 | Phillips et al. |
| 2018/0070641 | A1 | 3/2018 | Batista et al. |
| 2018/0085539 | A1 | 3/2018 | Trzecieski et al. |
| 2018/0132525 | A1 | 5/2018 | Patil et al. |
| 2018/0160733 | A1 | 6/2018 | Leadley et al. |
| 2018/0168227 | A1 | 6/2018 | Fraser et al. |
| 2018/0169357 | A1 | 6/2018 | Reevell |
| 2018/0184712 | A1 | 7/2018 | Fraser et al. |
| 2018/0192700 | A1 | 7/2018 | Fraser et al. |
| 2018/0271151 | A1 | 9/2018 | Litten |
| 2018/0271154 | A1 | 9/2018 | Leadley et al. |
| 2018/0271155 | A1 | 9/2018 | Baker et al. |
| 2018/0279679 | A1 | 10/2018 | Mcadam et al. |
| 2018/0343920 | A1 | 12/2018 | Sutton et al. |
| 2018/0360123 | A1 | 12/2018 | Silvestrini |
| 2018/0368472 | A1 | 12/2018 | Mishra et al. |
| 2019/0014825 | A1 | 1/2019 | Saygili |
| 2019/0021399 | A1 | 1/2019 | Silvestrini |
| 2019/0029320 | A1 | 1/2019 | Saygili |
| 2019/0045837 | A1 | 2/2019 | Spencer |
| 2019/0046745 | A1 | 2/2019 | Nettenstrom et al. |
| 2019/0083720 | A1 | 3/2019 | Leadley et al. |
| 2019/0098930 | A1 | 4/2019 | Fallon et al. |
| 2019/0098931 | A1 | 4/2019 | Leadley et al. |
| 2019/0099561 | A1 | 4/2019 | Nettenstrom |
| 2019/0099562 | A1 | 4/2019 | Nettenstrom et al. |
| 2019/0099567 | A1 | 4/2019 | Nettenstrom et al. |
| 2019/0150520 | A1 | 5/2019 | Fraser et al. |
| 2019/0208821 | A1 | 7/2019 | Fraser et al. |
| 2019/0208822 | A1 | 7/2019 | Mullin |
| 2019/0208824 | A1 | 7/2019 | Wright |
| 2019/0223508 | A1 | 7/2019 | Otiaba et al. |
| 2019/0246693 | A1 | 8/2019 | Nettenstrom et al. |
| 2019/0320718 | A1 | 10/2019 | Yilmaz et al. |
| 2020/0000151 | A1 | 1/2020 | Fraser et al. |
| 2020/0029618 | A1 | 1/2020 | Fraser et al. |
| 2020/0037669 | A1 | 2/2020 | Bowen et al. |
| 2020/0038601 | A1 | 2/2020 | Hepworth et al. |
| 2020/0046025 | A1 | 2/2020 | Otiaba et al. |
| 2020/0107572 | A1 | 4/2020 | Marques et al. |
| 2020/0113234 | A1 | 4/2020 | Patoret |
| 2020/0146352 | A1 | 5/2020 | Alston et al. |
| 2020/0154771 | A1 | 5/2020 | Otiaba et al. |
| 2020/0163376 | A1 | 5/2020 | Saygili et al. |
| 2020/0221777 | A1 | 7/2020 | Saygili et al. |
| 2020/0260783 | A1 | 8/2020 | Waller et al. |
| 2020/0275696 | A1 | 9/2020 | Atkins et al. |
| 2021/0084986 | A1 | 3/2021 | Hepworth et al. |
| 2021/0145051 | A1 | 5/2021 | Florack et al. |
| 2021/0145072 | A1 | 5/2021 | Mullin et al. |
| 2021/0204609 | A1* | 7/2021 | Bilat ..... A24F 40/51 |
| 2022/0279846 | A1* | 9/2022 | Alston ..... A24F 40/42 |
| 2023/0042402 | A1* | 2/2023 | Alston ..... A24F 40/40 |
| 2023/0054752 | A1* | 2/2023 | Alston ..... A24F 40/485 |

FOREIGN PATENT DOCUMENTS

| | | | |
|---|---|---|---|
| CN | 1541577 | A | 11/2004 |
| CN | 201630238 | U | 11/2010 |
| CN | 102612361 | A | 7/2012 |
| CN | 202738816 | U | 2/2013 |
| CN | 202873796 | U | 4/2013 |
| CN | 103156273 | A | 6/2013 |
| CN | 103929985 | A | 7/2014 |
| CN | 203748667 | U | 8/2014 |
| CN | 104544567 | A | 4/2015 |
| CN | 104684422 | A | 6/2015 |
| CN | 204409589 | U | 6/2015 |
| CN | 104770878 | A | 7/2015 |
| CN | 102762118 | B | 8/2015 |
| CN | 104968225 | A | 10/2015 |
| CN | 204837995 | U | 12/2015 |
| CN | 207476951 | U | 6/2018 |
| CN | 105473012 | B | 6/2020 |
| CN | 111213915 | A | 6/2020 |
| EP | 3085257 | A1 | 10/2016 |
| EP | 2753200 | B1 | 12/2017 |
| EP | 2961288 | B1 | 10/2018 |
| EP | 2961285 | B1 | 1/2019 |
| EP | 3344080 | B1 | 6/2020 |
| EP | 3285843 | B1 | 9/2020 |
| EP | 3481473 | B1 | 9/2020 |
| EP | 3484315 | B1 | 12/2020 |
| EP | 3525608 | B1 | 12/2020 |
| EP | 3562337 | B1 | 2/2021 |
| EP | 3522740 | B1 | 3/2021 |
| EP | 3232838 | B1 | 4/2021 |
| EP | 3562535 | B1 | 4/2021 |
| EP | 3534733 | B1 | 6/2021 |
| EP | 3554295 | B1 | 7/2021 |
| EP | 3104723 | B1 | 8/2021 |
| EP | 3573486 | B1 | 9/2021 |
| EP | 3644770 | B1 | 9/2021 |
| GB | 1025630 | A | 4/1966 |
| GB | 1213318 | A | 11/1970 |
| GB | 2524779 | A | 10/2015 |
| JP | 2005058421 | A | 3/2005 |
| KR | 10-2013-0052119 | A | 5/2013 |
| KR | 10-2016-0112770 | A | 9/2016 |
| KR | 101691984 | B1 | 1/2017 |
| WO | WO-03082031 | A1 | 10/2003 |
| WO | WO-2004064548 | A1 | 8/2004 |
| WO | WO-2004089126 | A1 | 10/2004 |
| WO | WO-2010140841 | A2 | 12/2010 |
| WO | WO-2012065310 | A1 | 5/2012 |
| WO | WO-2015150699 | A1 | 10/2015 |
| WO | WO-2016062777 | A1 | 4/2016 |
| WO | WO-2016079589 | A1 | 5/2016 |
| WO | WO-2016135342 | A2 | 9/2016 |
| WO | WO-2016179376 | A1 | 11/2016 |
| WO | WO-2017042081 | A1 | 3/2017 |

(56) References Cited

FOREIGN PATENT DOCUMENTS

| | | | |
|---|---|---|---|
| WO | WO-2017153591 | A1 | 9/2017 |
| WO | WO-2017185051 | A1 | 10/2017 |
| WO | WO-2017207443 | A1 | 12/2017 |
| WO | WO-2018029186 | A1 | 2/2018 |
| WO | WO-2019122880 | A1 | 6/2019 |
| WO | WO-2020081849 | A2 | 4/2020 |
| WO | WO-2020097567 | A1 | 5/2020 |
| WO | WO-2020201026 | A1 | 10/2020 |

OTHER PUBLICATIONS

Yan, Dawei, (May 31, 1994) "New 600 Questions and Answers on Computer and Electronic Technology, the First Edition", Weapon Industry Press, 299-300.

Jiang, et al. (Jul. 31, 2008) "Development of High-Performance PTCR Heating Elements for New Heaters", Device Manufacturing and Application, 33(7):600-602, 625.

* cited by examiner $$P = \int_{vol} \frac{(\nabla V)^2}{\rho} \, dvol$$

Every control volume ∂x, ∂y, ∂z within an isotropic PTCR material subject to a voltage gradient will heat to a temperature within the PTCR transition zone and hold that temperture over a wide range of ∇V.

| Temperature (°C) | Resistivity (ohm-cm) | Temperature (°C) | Resistivity (ohm-cm) | Temperature (°C) | Resistivity (ohm-cm) |
|---|---|---|---|---|---|
| 22.3 | 109.694 | 184.2 | 38.685 | 232.3 | 162.394 |
| 23.6 | 108.330 | 184.7 | 38.673 | 233.2 | 256.665 |
| 33.5 | 98.611 | 187.0 | 38.625 | 233.8 | 331.375 |
| 38.5 | 94.008 | 188.0 | 38.607 | 234.8 | 441.487 |
| 46.9 | 86.630 | 190.0 | 38.578 | 235.6 | 558.977 |
| 47.1 | 86.506 | 190.2 | 38.576 | 236.3 | 678.110 |
| 52.2 | 82.600 | 192.0 | 38.556 | 236.5 | 711.822 |
| 59.5 | 77.991 | 193.0 | 38.547 | 238.3 | 1261.390 |
| 59.8 | 77.795 | 194.0 | 38.541 | 240.8 | 2687.390 |
| 64.8 | 74.769 | 195.6 | 38.532 | 240.9 | 2778.690 |
| 75.2 | 68.082 | 195.8 | 38.532 | 243.9 | 4442.150 |
| 77.7 | 66.681 | 197.3 | 38.527 | 244.2 | 4788.260 |
| 86.5 | 62.716 | 198.6 | 38.527 | 245.2 | 6747.000 |
| 86.6 | 62.653 | 199.1 | 38.528 | 247.1 | 9698.350 |
| 91.1 | 60.966 | 200.6 | 38.535 | 247.9 | 11432.800 |
| 99.4 | 57.955 | 201.2 | 38.538 | 250.7 | 22831.500 |
| 99.9 | 57.775 | 202.2 | 38.547 | 251.7 | 28992.800 |
| 104.7 | 56.019 | 203.1 | 38.556 | 252.5 | 34334.100 |
| 111.4 | 53.450 | 203.9 | 38.570 | 254.5 | 45742.100 |
| 116.9 | 51.472 | 204.5 | 38.583 | 254.8 | 47918.300 |
| 119.0 | 50.738 | 205.9 | 38.620 | 257.3 | 68258.900 |
| 122.5 | 49.605 | 207.7 | 38.711 | 260.8 | 111647.000 |
| 127.5 | 48.097 | 207.9 | 38.722 | 262.1 | 133176.000 |
| 133.9 | 46.362 | 209.0 | 38.831 | 262.8 | 143871.000 |
| 134.9 | 46.125 | 210.7 | 39.097 | 263.3 | 150490.000 |
| 139.4 | 45.173 | 211.7 | 39.351 | 265.1 | 170423.000 |
| 144.3 | 44.277 | 212.7 | 39.692 | 268.9 | 221852.000 |
| 147.3 | 43.769 | 213.6 | 40.122 | 271.4 | 256649.000 |
| 149.1 | 43.456 | 214.3 | 40.449 | 272.2 | 265081.000 |
| 151.8 | 42.994 | 215.6 | 41.185 | 272.5 | 268026.000 |
| 158.1 | 41.887 | 217.6 | 42.459 | 276.8 | 295802.000 |
| 159.1 | 41.714 | 219.3 | 43.660 | 278.5 | 303521.000 |
| 163.5 | 40.937 | 219.4 | 43.788 | 282.3 | 316247.000 |
| 165.2 | 40.655 | 220.8 | 44.857 | 285.1 | 322183.000 |
| 168.3 | 40.128 | 221.4 | 45.434 | 291.0 | 326120.000 |
| 168.8 | 40.046 | 222.4 | 46.404 | 292.2 | 324601.000 |
| 171.6 | 39.604 | 222.9 | 47.021 | 293.4 | 322183.000 |
| 174.1 | 39.274 | 224.4 | 50.439 | 297.5 | 307629.000 |
| 175.3 | 39.148 | 225.6 | 54.008 | 302.3 | 285898.000 |
| 178.1 | 38.925 | 227.2 | 60.796 | 303.8 | 279388.000 |
| 179.2 | 38.862 | 228.0 | 66.314 | 307.4 | 260106.000 |
| 180.1 | 38.821 | 228.4 | 70.170 | 310.1 | 239863.000 |
| 181.9 | 38.752 | 229.4 | 97.759 | 313.2 | 215295.000 |
| 182.1 | 38.747 | 231.0 | 129.069 | 315.2 | 200942.000 |

FIG. 15

$\rho$ = 5700 kg/m$^3$
Cp = 520 J/kg K
K = 2.1 W/m K

| Deg K | Ohm-m |
|---|---|
| 298.15 | 0.168329938 |
| 303.15 | 0.161810538 |
| 313.15 | 0.150027222 |
| 323.15 | 0.13959319 |
| 333.15 | 0.130614905 |
| 343.15 | 0.122664629 |
| 353.15 | 0.115975772 |
| 363.15 | 0.110218721 |
| 373.15 | 0.105160691 |
| 383.15 | 0.100737561 |
| 393.15 | 0.0968975 |
| 403.15 | 0.093703374 |
| 413.15 | 0.091130667 |
| 423.15 | 0.089298908 |
| 433.15 | 0.088613617 |
| 443.15 | 0.090317615 |
| 453.15 | 0.096577771 |
| 458.15 | 0.102238954 |
| 463.15 | 0.111000861 |
| 468.15 | 0.123519669 |
| 473.15 | 0.149909764 |
| 478.15 | 0.194749565 |
| 483.15 | 0.26517015 |
| 488.15 | 0.374116437 |
| 493.15 | 0.543771602 |
| 498.15 | 0.79410177 |
| 503.15 | 1.167231769 |
| 508.15 | 1.720888026 |
| 513.15 | 2.533063907 |
| 518.15 | 3.668688815 |

VAPORIZER DEVICE WITH MORE THAN ONE HEATING ELEMENT

CROSS REFERENCE

This application is a divisional of U.S. patent application Ser. No. 16/679,057 entitled "Vaporizer Device With More Than One Heating Element" filed Nov. 8, 2019, which claims priority to U.S. Provisional Patent Application No. 62/757,689 entitled "Vaporizer Device With More Than One Heating Element" filed Nov. 8, 2018, U.S. Provisional Patent Application No. 62/821,305 entitled "Vaporizer Device With More Than One Heating Element" filed Mar. 20, 2019, U.S. Provisional Patent Application No. 62/930,542 entitled "Vaporizer Device With More Than One Heating Element" filed Nov. 4, 2019, U.S. Provisional Patent Application No. 62/791,709 entitled "Vaporizer Including Positive Temperature Coefficient of Resistivity Heater" filed Jan. 11, 2019, U.S. Provisional Patent Application No. 62/816,452 entitled "Vaporizer Including Positive Temperature Coefficient of Resistivity Heater" filed Mar. 11, 2019, and U.S. Provisional Patent Application No. 62/898,522 entitled "Vaporizer Including Positive Temperature Coefficient of Resistivity Heater" filed Sep. 10, 2019, which are hereby incorporated by reference in their entirety.

TECHNICAL FIELD

The subject matter described herein relates to vaporizer devices configured to heat vaporizable material.

BACKGROUND

Vaporizer devices, which can also be referred to as vaporizers, electronic vaporizer devices, or e-vaporizer devices, can be used for delivery of an aerosol (for example, a vapor-phase and/or condensed-phase material suspended in a stationary or moving mass of air or some other gas carrier) containing one or more active ingredients by inhalation of the aerosol by a user of the vaporizing device. For example, electronic nicotine delivery systems (ENDS) include a class of vaporizer devices that are battery powered and that can be used to simulate the experience of smoking, but without burning of tobacco or other substances. Vaporizers are gaining increasing popularity both for prescriptive medical use, in delivering medicaments, and for consumption of tobacco, nicotine, and other plant-based materials. Vaporizer devices can be portable, self-contained, and/or convenient for use.

In use of a vaporizer device, the user inhales an aerosol, colloquially referred to as "vapor," which can be generated by a heating element that vaporizes (e.g., causes a liquid or solid to at least partially transition to the gas phase) a vaporizable material, which can be liquid, a solution, a solid, a paste, a wax, and/or any other form compatible for use with a specific vaporizer device. The vaporizable material used with a vaporizer can be provided within a cartridge for example, a separable part of the vaporizer device that contains vaporizable material) that includes an outlet (for example, a mouthpiece) for inhalation of the aerosol by a user.

To receive the inhalable aerosol generated by a vaporizer device, a user may, in certain examples, activate the vaporizer device by taking a puff, by pressing a button, and/or by some other approach. A puff as used herein can refer to inhalation by the user in a manner that causes a volume of air to be drawn into the vaporizer device such that the inhalable aerosol is generated by a combination of the vaporized vaporizable material with the volume of air.

An approach by which a vaporizer device generates an inhalable aerosol from a vaporizable material involves heating the vaporizable material in a vaporization chamber (e.g., a heater chamber) to cause the vaporizable material to be converted to the gas (or vapor) phase. A vaporization chamber can refer to an area or volume in the vaporizer device within which a heat source (for example, a conductive, convective, and/or radiative heat source) causes heating of a vaporizable material to produce a mixture of air and vaporized material to form a vapor for inhalation of the vaporizable material by a user of the vaporization device.

In some implementations, a liquid vaporizable material can be drawn out of a reservoir and into the vaporization chamber via a wicking element (e.g., a wick). Drawing of the liquid vaporizable material into the vaporization chamber can be at least partially due to capillary action provided by the wicking element as the wicking element pulls the liquid vaporizable material along the wick in the direction of the vaporization chamber.

Vaporizer devices can be controlled by one or more controllers, electronic circuits (for example, sensors, heating elements), and/or the like on the vaporizer. Vaporizer devices can also wirelessly communicate with an external controller for example, a computing device such as a smartphone).

SUMMARY

In certain aspects of the current subject matter, challenges associated with efficiently and effectively heating one or more types of vaporizable material can be addressed by inclusion of one or more of the features described herein or comparable/equivalent approaches as would be understood by one of ordinary skill in the art. Aspects of the current subject matter relate to embodiments of vaporizer devices including various heating elements and heating systems for heating one or more types of vaporizable material. In one aspect consistent with the current disclosure, a vaporizer device for generating a combined inhalable aerosol may include a body including an airflow pathway extending therethrough. The vaporizer device may include a first cartridge receptacle configured to receive a first cartridge. The first cartridge may be configured to contain a first vaporizable material. The vaporizer device may include a second cartridge receptacle configured to receive a second cartridge. The second cartridge may be configured to contain a second vaporizable material. The vaporizer device may include a first heater in communication with the first cartridge receptacle for heating the first vaporizable material and forming a first inhalable aerosol. The vaporizer device may include a second heater in communication with the second cartridge receptacle for heating the second vaporizable material and forming a second inhalable aerosol. The airflow pathway may extend adjacent the first heater and the second heater and may be configured to allow the first inhalable aerosol and the second inhalable aerosol to combine to form the combined inhalable aerosol for inhalation by a user from an end of the airflow pathway.

The vaporizer device may include a third heater positioned adjacent the airflow pathway at a position upstream from at least one of the first heater and the second heater. The first vaporizable material may be a liquid. The second vaporizable material may be a non-liquid. The first vaporizable material and the second vaporizable material may be a liquid. The first vaporizable material and the second vaporizable material may be a non-liquid. The first vaporizable material may be a first liquid and the second vaporizable material may be a second liquid that is different from the first liquid. The first vaporizable material may be a first non-liquid and the second vaporizable material may be a second non-liquid, which is different from the first non-liquid. The first heater and/or the second heater may include a nonlinear positive temperature coefficient of resistance material.

In an interrelated aspect, a method of a vaporizer device for generating a combined inhalable aerosol may include heating a first vaporizable material and forming a first inhalable aerosol. The heating may be performed by a first heater of the vaporizer device. The vaporizer device may include a body including an airflow pathway extending therethrough. The vaporizer device may include a first cartridge receptacle configured to receive a first cartridge. The first cartridge may be configured to contain the first vaporizable material. The first heater may be in communication with the first cartridge receptacle for heating the first vaporizable material. The vaporizer device may include a second cartridge receptacle configured to receive a second cartridge. The second cartridge may be configured to contain a second vaporizable material. The vaporizer device may include a second heater in communication with the second cartridge receptacle for heating the second vaporizable material and forming a second inhalable aerosol. The airflow pathway may extend adjacent the first heater and the second heater and may be configured to allow the first inhalable aerosol and the second inhalable aerosol to combine to form the combined inhalable aerosol for inhalation by a user from an end of the airflow pathway. The method may include heating the second vaporizable material and forming the second inhalable aerosol. The method may include combining the first inhalable aerosol with the second inhalable aerosol to form the combined inhalable aerosol for inhalation by the user.

In an interrelated aspect, a vaporizer device may include a housing including an air inlet. The vaporizer device may include a heating element within the housing and arranged to receive airflow from the air inlet. The heating element may include a nonlinear positive temperature coefficient of resistance material. The vaporizer device may include a heat exchanger thermally coupled to the heating element and may be configured to transfer heat between the heating element and the airflow to heat air in the airflow. The vaporizer device may be capable of providing the heated air to a vaporizable material for vaporization of the vaporizable material.

The heat exchanger may include a first heat exchanger thermally coupled to a first side of the heating element. The heat exchanger may include a second heat exchanger thermally coupled to a second side of the heating element. The heat exchanger may include a plurality of fin features. The vaporizer device may include a flow diverter located in a path of the airflow and may be configured to divert a portion of the airflow through the heat exchanger. The housing may include a cover containing the heat exchanger. The vaporizer device may include a power source configured to provide electrical energy to heat the heating element. The vaporizer device may include a cartridge located downstream of the heating element and oriented to receive the heated air, wherein downstream may be with respect to the airflow. The vaporizer device may include a cartridge configured to contain the vaporizable material. The housing may include a connector configured to couple the housing to the cartridge. The cartridge may include a solid vaporizable material. The cartridge may include a reservoir, liquid vaporizable material within the reservoir, and a wick in fluidic communication with the liquid vaporizable material. The cartridge may be configured to receive the heated air and direct the heated air over the wick. The cartridge may include a mouthpiece, and the wick may be located in a path of the airflow between the heating element and the mouthpiece. The cartridge may include a second air inlet configured to draw a second airflow into the cartridge for mixing with the heated air and within a reservoir located in a path of the airflow downstream from the heat exchanger and the vaporizable material. The cartridge may include a reservoir. The cartridge may include a liquid vaporizable material within the reservoir. The cartridge may include a wick in fluidic communication with the liquid vaporizable material. The wick may be arranged to receive the heated air from the heat exchanger to produce vaporized vaporizable material in the form of an inhalable aerosol. The cartridge may include a solid vaporizable material arranged to receive the vaporized vaporizable material from the wick. The cartridge may include a mouthpiece configured to receive the vaporized vaporizable material after the vaporized vaporizable material passes through the solid vaporizable material.

The vaporizer device may include a first cartridge including a reservoir, liquid vaporizable material within the reservoir, and a wick in fluidic communication with the liquid vaporizable material. The wick may be arranged to receive the heated air from the heat exchanger to produce vaporized vaporizable material in the form of an inhalable aerosol. The vaporizer device may include a second cartridge including a solid vaporizable material and a mouthpiece. The solid vaporizable material arranged to receive the vaporized vaporizable material from the wick. The mouthpiece may be configured to receive the vaporized vaporizable material after the vaporized vaporizable material passes through the solid vaporizable material. The first cartridge may be removably coupled to the housing. The second cartridge may be removably coupled to the housing and/or the first cartridge.

The first cartridge and the second cartridge may be disposable cartridges. The second cartridge includes a second air inlet for mixing ambient temperature air with the vaporized vaporizable material after the vaporized vaporizable material passes through the solid vaporizable material. The vaporizer device may include a fibrous body arranged to receive and cool the vaporized vaporizable material after the vaporized vaporizable material passes through the solid vaporizable material. The nonlinear positive temperature coefficient of resistance material may include an electrical resistivity transition zone characterized by an increase in electrical resistivity over a temperature range such that, when the heating element is heated to a first temperature within the electrical resistivity transition zone, current flow from a power source is reduced to a level that limits further temperature increases of the heating element from current flow. The electrical resistivity transition zone may begin at a starting temperature of between 150° C. and 350° C. The electrical resistivity transition zone may begin at a starting temperature of between 220° C. and 300° C. The electrical resistivity transition zone may begin at a starting temperature between 240° C. and 280° C.

The increase in electrical resistivity over a temperature range of an electrical resistivity transition zone may include an increase factor of at least 10. The increase factor may characterize a relative change in electrical resistivity between electrical resistivity at a first temperature associated with a start of the electrical resistivity transition zone and electrical resistivity at a second temperature associated with an end of the electrical resistivity transition zone. An electrical resistivity transition zone may begin at a first temperature and electrical resistivity of the heating element at temperatures below the first temperature is between 0.2 ohm-cm and 200 ohm-cm. The vaporizer device may include a power source configured to provide a voltage between 3 Volts and 50 Volts to the heating element. The vaporizer device may include a pressure sensor. The vaporizer device may include a controller coupled to the pressure sensor and may be configured to detect inhalation and in response electrically connect the power source to the heating element. The housing may be cylindrical. The heating element may be cylindrical. The heat exchanger may be cylindrical.

In an interrelated aspect, a method may include receiving, by a vaporizer device, user input. The method may include heating, using the vaporizer device, a vaporizable material. The method may include forming inhalable aerosol.

In an interrelated aspect, a vaporizable material insert for use with a vaporizer device having a heating element may include an elongated body including an inner chamber defined by sidewalls and a first end. The elongated body may include an opening at a second end opposing the first end. The sidewalls may include a plurality of perforations. The inner chamber may be defined by the sidewalls and the first end. The inner chamber may be in fluid communication with the plurality of perforations. At least a part of the sidewalls may include a vaporizable material. The vaporizer device may include a receptacle for receiving the vaporizable material insert, as well as a sealed airflow pathway that extends along the side walls of the vaporizable material insert when the vaporizable material insert is inserted in the receptacle. The vaporizer device may be configured to flow heated air through the sealed airflow pathway to thereby allow the heated air to pass through the plurality of perforations and heat the vaporizable material to form an inhalable aerosol in the inner chamber.

The details of one or more variations of the subject matter described herein are set forth in the accompanying drawings and the description below. Other features and advantages of the subject matter described herein will be apparent from the description and drawings, and from the claims. The claims that follow this disclosure are intended to define the scope of the protected subject matter.

BRIEF DESCRIPTION OF THE DRAWINGS

The accompanying drawings, which are incorporated into and constitute a part of this specification, show certain aspects of the subject matter disclosed herein and, together with the description, help explain some of the principles associated with the disclosed implementations. In the drawings:

FIG. 15 presents an example table of resistivity vs. temperature curve data for the nonlinear PTCR semiconducting material illustrated in FIG. 14;

When practical, similar reference numbers denote similar structures, features, or elements.

DETAILED DESCRIPTION

Figure 1:
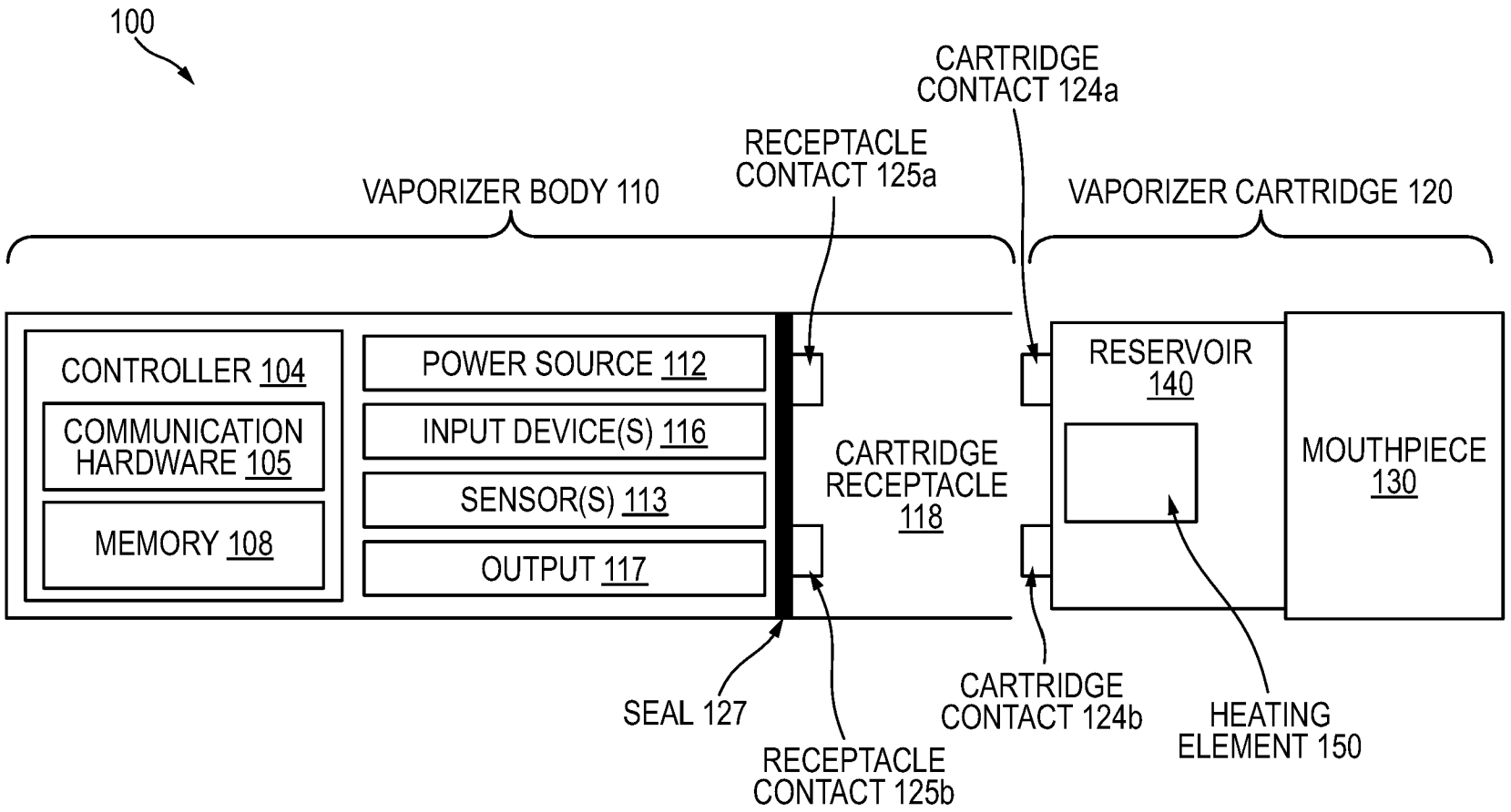
FIG. 1 illustrates a block diagram of a vaporizer consistent with implementations of the current subject matter.

Implementations of the current subject matter include methods, apparatuses, articles of manufacture, and systems relating to vaporization of one or more materials for inhalation by a user. Example implementations include vaporizer devices and systems including vaporizer devices. The term "vaporizer device" as used in the following description and claims refers to any of a self-contained apparatus, an apparatus that includes two or more separable parts (for example, a vaporizer body that includes a battery and other hardware, and a cartridge that includes a vaporizable material), and/or the like. A "vaporizer system," as used herein, can include one or more components, such as a vaporizer device. Examples of vaporizer devices consistent with implementations of the current subject matter include electronic vaporizers, electronic nicotine delivery systems (ENDS), and/or the like. In general, such vaporizer devices are hand-held devices that heat (such as by convection, conduction, radiation, and/or some combination thereof) a vaporizable material to provide an inhalable dose of the material.

Vaporizers described herein may be a cartridge-using vaporizer, a cartridge-less vaporizer, or a multi-use vaporizer capable of use with or without a cartridge. For example, some vaporizer embodiments may include a reusable vaporizer body that is configured to releasably couple a disposable or refillable cartridge containing at least one vaporizable material. As such, features described herein related to a vaporizer may be contained within the vaporizer body and/or the cartridge of the vaporizer. Furthermore, although some features described herein are described as being contained in the cartridge, such features may be contained within the vaporizer body without departing from the scope of this disclosure.

In some embodiments disclosed herein, vaporizers may produce aerosol on-demand (e.g., when a user puffs on the vaporizer) for inhalation. Additionally, the aerosol produced may include a combination of vaporized liquid material, vaporized non-liquid material, and/or inhalable elements from heating non-liquid vaporizable material. Such a combined aerosol may provide an enhanced user experience that is the same as or similar to inhaling smoke from a traditional cigarette.

Some vaporizer embodiments disclosed herein include a heating and airflow system having a first heating element that heats a first chamber and a second heating element that heats a second chamber. The first chamber may be configured to contain a liquid vaporizable material and the first heating element may be configured to heat and/or vaporize the liquid vaporizable material. Additionally, the second chamber may be configured to contain a non-liquid vaporizable material and the second heating element may be configured to heat and/or vaporize the non-liquid vaporizable material. The contents emitted from the first and second chambers as a result of being heated by the first and second heating elements, respectively, may be combined to form a combined aerosol for inhalation by a user, as will be described in greater detail below. This combined aerosol can be provided on-demand and include inhalable elements from both liquid and non-liquid vaporizable material, which can provide an experience that is similar to smoking a traditional cigarette. Various heating and airflow systems and associated features for achieving the above on-demand combined aerosol are described in greater detail below.

Various heater element embodiments are also described herein that can improve the efficiency and quality of heating of the vaporizable material, such as by heating the vaporizable material to a temperature that is hot enough to vaporize the vaporizable material into an aerosol for inhalation, but below a temperature that produces harmful byproducts and/or that results in combustion of the vaporizable material. In some embodiments, the heating element may be configured to heat the vaporizable material (e.g., non-liquid vaporizable material) to a temperature that is hot enough to produce a byproduct of the vaporizable material but does not vaporize or cause burning of the vaporizable material. In some embodiments, the heating elements described herein can achieve an optimal heating range at a rate that allows a user to have an enjoyable user experience (e.g., not being required to wait a long time for the heating element to reach a temperature in the optimal heating range, etc.). In some embodiments, the heating element may be at least partially constructed of a material having a nonlinear positive temperature coefficient of resistance. In some embodiments, vaporizer cartridges including such heating elements can be cost effectively manufactured, thereby making them economically feasible as single-use disposable cartridges. Various vaporizers, including cartridges, and heating elements including one or more of the above features are described in greater detail below.

As mentioned above, a vaporizer device can be a cartridge-using vaporizer device, a cartridge-less vaporizer device, or a multi-use vaporizer device capable of use with or without a cartridge. For example, a vaporizer device can include at least one heating chamber (for example, an oven or other region in which material is heated by a heating element) configured to receive a vaporizable material directly into each heating chamber, and/or a reservoir or the like for containing the vaporizable material.

In some implementations, a vaporizer device can be configured for use with a liquid vaporizable material (for example, a carrier solution in which an active and/or inactive ingredient(s) are suspended or held in solution, or a liquid form of the vaporizable material itself), a paste, a wax, and/or a non-liquid or solid vaporizable material. A solid vaporizable material can include a plant material that emits some part of the plant material as the vaporizable material (for example, some part of the plant material remains as waste after the material is vaporized for inhalation by a user) or optionally can be a solid form of the vaporizable material itself, such that all of the solid material can eventually be vaporized for inhalation. A liquid vaporizable material can likewise be capable of being completely vaporized, or can include some portion of the liquid material that remains after all of the material suitable for inhalation has been vaporized. As noted above, vaporizable material used with a vaporizer may optionally be provided within a cartridge (e.g., a part of the vaporizer that contains the vaporizable material or a source substance that includes the vaporizable material in a reservoir or other container and that can be refillable when empty or disposable in favor of a new cartridge containing additional vaporizable material of a same or different type).

Referring to the block diagram of FIG. 1, a vaporizer device 100 can include a power source 112 (for example, a battery, which can be a rechargeable battery), and a controller 104 (for example, a processor, circuitry, etc. capable of executing logic) for controlling delivery of heat to cause at least one vaporizable material 102 to be converted from a condensed form to the gas phase. The controller 104 can be part of one or more printed circuit boards (PCBs) consistent with certain implementations of the current subject matter. After conversion of the vaporizable material 102 to the gas phase, at least some of the vaporizable material 102 in the gas phase can condense to form particulate matter in at least a partial local equilibrium with the gas phase as part of an aerosol, which can form some or all of an inhalable dose provided by the vaporizer device 100 during a user's puff or draw on the vaporizer device 100. It should be appreciated that the interplay between gas and condensed phases in an aerosol generated by a vaporizer device 100 can be complex and dynamic, due to factors such as ambient temperature, relative humidity, chemistry, flow conditions in airflow paths (both inside the vaporizer and in the airways of a human or other animal), and/or mixing of the vaporizable material 102 in the gas phase or in the aerosol phase with other air streams, which can affect one or more physical parameters of an aerosol. In some vaporizer devices, and particularly for vaporizer devices configured for delivery of volatile vaporizable materials, the inhalable dose can exist predominantly in the gas phase (for example, formation of condensed phase particles can be very limited).

The atomizer (e.g., heating element 150) in the vaporizer device 100 can be configured to vaporize a vaporizable material 102. The vaporizable material 102 can be a liquid. Examples of the vaporizable material 102 include neat liquids, suspensions, solutions, mixtures, and/or the like. The atomizer can include a wicking element (i.e., a wick) configured to convey an amount of the vaporizable material 102 to a part of the atomizer that includes a heating element 150.

For example, the wicking element can be configured to draw the vaporizable material 102 from a reservoir 140 configured to contain the vaporizable material 102, such that the vaporizable material 102 can be vaporized by heat delivered from a heating element. The wicking element can also optionally allow air to enter the reservoir 140 and replace the volume of vaporizable material 102 removed. In some implementations of the current subject matter, capillary action can pull the vaporizable material 102 into the wick for vaporization by the heating element, and air can return to the reservoir 140 through the wick to at least partially equalize pressure in the reservoir 140. Other methods of allowing air back into the reservoir 140 to equalize pressure are also possible. As used herein, the terms "wick" or "wicking element" include any material capable of causing fluid motion via capillary pressure.

Various embodiments of the heating element 150, as well as various configurations of one or more heating elements 150 of a heating system, are described herein. For example, in some embodiments the heating element 150 can include the heating element including a nonlinear positive temperature coefficient of resistance material. In some embodiments, the vaporizer can include a heating system including one or more heating elements, such as two or three heating elements that are configured to heat one or more types of vaporizable materials, as will be described in greater detail below.

As noted above, vaporizers consistent with implementations of the current subject matter may also or alternatively be configured to create an inhalable dose of gas-phase and/or aerosol-phase vaporizable material via heating of a non-liquid source substance containing or including a vaporizable material, such as for example a solid-phase vaporizable material or plant material (e.g., tobacco leaves and/or parts of tobacco leaves) containing the vaporizable material. In such vaporizers, a heating element may be part of or otherwise incorporated into or in thermal contact with the walls of an oven or other heating chamber into which the non-liquid source substance that contains or includes a vaporizable material is placed. Alternatively, a heating element or elements may be used to heat air passing through or past the non-liquid source substance to cause convective heating of the non-liquid vaporizable material. In still other examples, a heating element or elements may be disposed in intimate contact with plant material such that direct thermal conduction heating of the source substance occurs from within a mass of the source substance (e.g., as opposed to only by conduction inward from walls of an oven). Such non-liquid vaporizable materials may be used with cartridge using or cartridge less vaporizers.

The heating element can include one or more of a conductive heater, a radiative heater, and/or a convective heater. One type of heating element is a resistive heating element, which can include a material (such as a metal or alloy, for example a nickel-chromium alloy, or a non-metallic resistor) configured to dissipate electrical power in the form of heat when electrical current is passed through one or more resistive segments of the heating element. In some implementations of the current subject matter, a heating element which includes a resistive coil or other heating element wrapped around, positioned within, integrated into a bulk shape of, pressed into thermal contact with, or otherwise arranged to deliver heat to a mass of a source substance (e.g., plant based-substance such as tobacco) that contains the vaporizable material. Throughout the current disclosure, "source substance" generally refers to the part of a plant-based material (or other condensed form of a plant material or other material that may release vaporizable material without being burned) that contains vaporizable materials that are converted to vapor and/or aerosol for inhalation. Other heating elements, and/or atomizer assembly configurations are also possible.

For example, a resistive heating element can be activated in association with a user puffing (i.e., drawing, inhaling, etc.) on a mouthpiece 130 of the vaporizer device 100 to cause air to flow from an air inlet, along an airflow path that passes the heating element and an associated mass of the source substance. Optionally, air can flow from an air inlet through one or more condensation areas or chambers, to an air outlet in the mouthpiece 130. Incoming air moving along the airflow path moves over or through the heating element 150 and the source substance, where vaporizable material 102 in the gas phase is entrained into the air. The heating element can be activated via the controller 104, which can optionally be a part of a vaporizer body 110 as discussed herein, causing current to pass from the power source 112 through a circuit including the resistive heating element, which is optionally part of a vaporizer cartridge 120 as discussed herein. As noted herein, the entrained vaporizable material in the gas phase can condense as it passes through the remainder of the airflow path such that an inhalable dose of the vaporizable material 102 in an aerosol form can be delivered from the air outlet (for example, the mouthpiece 130) for inhalation by a user. Other airflow pathways and collection of aerosols and/or source substances of one or more vaporizable materials is described in greater detail below.

Activation of one or more heating elements can be caused by automatic detection of a puff based on one or more signals generated by one or more of a sensor 113. The sensor 113 and the signals generated by the sensor 113 can include one or more of: a pressure sensor or sensors disposed to detect pressure along the airflow path relative to ambient pressure (or optionally to measure changes in absolute pressure), a motion sensor or sensors (for example, an accelerometer) of the vaporizer device 100, a flow sensor or sensors of the vaporizer device 100, a capacitive lip sensor of the vaporizer device 100, detection of interaction of a user with the vaporizer device 100 via one or more input devices 116 (for example, buttons or other tactile control devices of the vaporizer device 100), receipt of signals from a computing device in communication with the vaporizer device 100, and/or via other approaches for determining that a puff is occurring or imminent.

As discussed herein, the vaporizer device 100 consistent with implementations of the current subject matter can be configured to connect (such as, for example, wirelessly or via a wired connection) to a computing device (or optionally two or more devices) in communication with the vaporizer device 100. To this end, the controller 104 can include communication hardware 105. The controller 104 can also include a memory 108. The communication hardware 105 can include firmware and/or can be controlled by software for executing one or more cryptographic protocols for the communication.

A computing device can be a component of a vaporizer system that also includes the vaporizer device 100, and can include its own hardware for communication, which can establish a wireless communication channel with the communication hardware 105 of the vaporizer device 100. For example, a computing device used as part of a vaporizer system can include a general-purpose computing device (such as a smartphone, a tablet, a personal computer, some other portable device such as a smartwatch, or the like) that executes software to produce a user interface for enabling a user to interact with the vaporizer device 100. In other implementations of the current subject matter, such a device used as part of a vaporizer system can be a dedicated piece of hardware such as a remote control or other wireless or wired device having one or more physical or soft (i.e., configurable on a screen or other display device and selectable via user interaction with a touch-sensitive screen or some other input device like a mouse, pointer, trackball, cursor buttons, or the like) interface controls. The vaporizer device 100 can also include one or more outputs 117 or devices for providing information to the user. For example, the outputs 117 can include one or more light emitting diodes (LEDs) configured to provide feedback to a user based on a status and/or mode of operation of the vaporizer device 100.

In the example in which a computing device provides signals related to activation of the resistive heating element, or in other examples of coupling of a computing device with the vaporizer device 100 for implementation of various control or other functions, the computing device executes one or more computer instruction sets to provide a user interface and underlying data handling. In one example, detection by the computing device of user interaction with one or more user interface elements can cause the computing device to signal the vaporizer device 100 to activate the heating element to reach an operating temperature for creation of an inhalable dose of vapor/aerosol. Other functions of the vaporizer device 100 can be controlled by interaction of a user with a user interface on a computing device in communication with the vaporizer device 100.

The temperature of a resistive heating element of the vaporizer device 100 can depend on a number of factors, including an amount of electrical power delivered to the resistive heating element and/or a duty cycle at which the electrical power is delivered, conductive heat transfer to other parts of the electronic vaporizer device and/or to the environment, latent heat losses due to vaporization of the vaporizable material 102 from the wicking element and/or the atomizer as a whole, and convective heat losses due to airflow (i.e., air moving across the heating element or the atomizer as a whole when a user inhales on the vaporizer device 100). As noted herein, to reliably activate the heating element or heat the heating element to a desired temperature, the vaporizer device 100 may, in some implementations of the current subject matter, make use of signals from the sensor 113 (for example, a pressure sensor) to determine when a user is inhaling. The sensor 113 can be positioned in the airflow path and/or can be connected (for example, by a passageway or other path) to an airflow path containing an inlet for air to enter the vaporizer device 100 and an outlet via which the user inhales the resulting vapor and/or aerosol such that the sensor 113 experiences changes (for example, pressure changes) concurrently with air passing through the vaporizer device 100 from the air inlet to the air outlet. In some implementations of the current subject matter, the heating element can be activated in association with a user's puff, for example by automatic detection of the puff, or by the sensor 113 detecting a change (such as a pressure change) in the airflow path.

The sensor 113 can be positioned on or coupled to (i.e., electrically or electronically connected, either physically or via a wireless connection) the controller 104 (for example, a printed circuit board assembly or other type of circuit board). To take measurements accurately and maintain durability of the vaporizer device 100, it can be beneficial to provide a seal 127 resilient enough to separate an airflow path from other parts of the vaporizer device 100. The seal 127, which can be a gasket, can be configured to at least partially surround the sensor 113 such that connections of the sensor 113 to the internal circuitry of the vaporizer device 100 are separated from a part of the sensor 113 exposed to the airflow path.

In some implementations, the vaporizer body 110 includes the controller 104, the power source 112 (for example, a battery), one more of the sensor 113, charging contacts (such as those for charging the power source 112), the seal 127, and a cartridge receptacle 118 configured to receive the vaporizer cartridge 120 for coupling with the vaporizer body 110 through one or more of a variety of attachment structures. In some examples, the vaporizer cartridge 120 includes the reservoir 140 for containing the vaporizable material 102, and the mouthpiece 130 has an aerosol outlet for delivering an inhalable dose to a user. In these examples, the vaporizer cartridge 120 can include the atomizer having a wicking element and a heating element. Alternatively, one or both of the wicking element and the heating element can be part of the vaporizer body 110. In implementations in which any part of the atomizer (i.e., heating element and/or wicking element) is part of the vaporizer body 110, the vaporizer device 100 can be configured to supply the vaporizable material 102 from the reservoir 140 in the vaporizer cartridge 120 to the part(s) of the atomizer included in the vaporizer body 110.

Various embodiments of a vaporizer cartridge are described herein that are configured for containing and vaporizing one or more non-liquid source substances, such as loose-leaf tobacco. Furthermore, such embodiments of vaporizer cartridges may be single-use such that they are not refillable after the vaporizable material has been used up. Such single-use vaporizer cartridges may thus require inexpensive material and manufacturing in order to be economically feasible. Furthermore, although it may be desirable to make and manufacture single-use vaporizer cartridges for vaporizing non-liquid source substances, it is also desirable to efficiently and effectively vaporize the vaporizable material. For example, a user inhaling on a vaporizer device typically prefers inhaling aerosol created by the vaporizer device shortly after engaging with the vaporizer device (e.g., placing lips on mouthpiece, pushing an activation button, etc.). As such, the embodiments of the vaporizer cartridges disclosed herein may beneficially achieve efficient vaporization of vaporizable material from a source substance to achieve a desired user experience. Furthermore, embodiments of the vaporizer cartridge disclosed herein may advantageously provide sufficient heat energy to the source substance to cause release of the vaporizable material such to create an aerosol form of the vaporizable material for inhalation, while also limiting heating sufficiently to at least reduce creation of at least one harmful by-product that is not desired for a user to inhale. To achieve the above, various embodiments of heating elements are disclosed and described in greater detail below.

For example, various embodiments of heating elements are described herein that are configured to heat within a desired temperature range, such as at or below approximately 250 degrees Celsius. Such a temperature range may advantageously vaporize a source substance such as processed tobacco and allow nicotine and volatile flavor compounds to be aerosolized and delivered to a user puffing on the associated vaporization device. Such a temperature within the temperature range may also prevent the creation of at least one harmful or potentially harmful by-product. As such, at least one benefit of the heating assemblies described herein include the improved quality of aerosol for inhalation by a user.

In addition, various embodiments of the heating elements described herein may efficiently heat up to a temperature within the desired temperature range. This can allow the associated vaporizer device to achieve a desired user experience for the user inhaling on the vaporizer device. Such efficient heat-up time can result in efficient power usage, such as battery power from the vaporizer device. Furthermore, the various embodiments of the heating elements described herein can achieve such benefits while not requiring an increase in vaporizer device size. In some embodiments, the heating element can allow for a more compact vaporizer device than what is currently available. In addition, embodiments of the heating element can be made and manufactured at a cost that may allow the vaporizer cartridge to be single-use and economically feasible.

Embodiments of the heating elements described below can include at least one thermally conductive material, such as carbon, carbon foam, metal, metal foil, aluminum foam, or a biodegradable polymer. The thermally conductive material can allow energy provided by a vaporizer device to be transmitted to the thermally conductive feature (e.g., via the cartridge and vaporizer device contacts) to thereby cause an increase in temperature along at least a part of the thermally conductive feature, such as for vaporizing the vaporizable material from the source substance. The vaporizer body can include a controller that can control the amount of energy provided to the thermally conductive material, thereby assisting the heating element with reaching a temperature that is within the desired temperature range. For example, in some embodiments the heating element 150 can include the heating element including a nonlinear positive temperature coefficient of resistance material.

Further to and in addition to the above disclosure, various embodiments of a vaporizer are described herein that may heat more than one vaporizable material using more than one heating element.

Figure 2A:
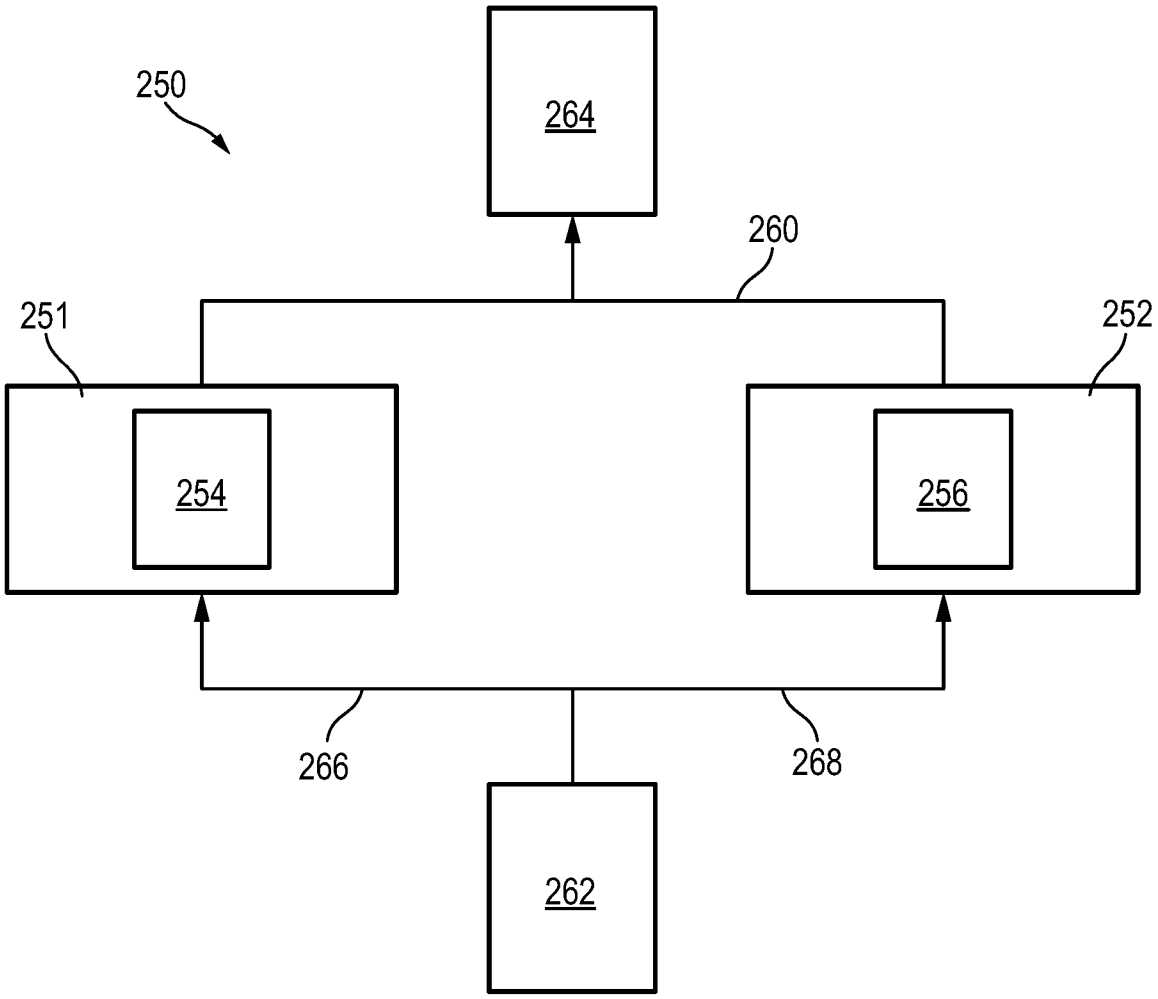
FIG. 2A illustrates a block diagram of an embodiment of a heating and airflow system consistent with implementations of the current subject matter.
Figure 2B:
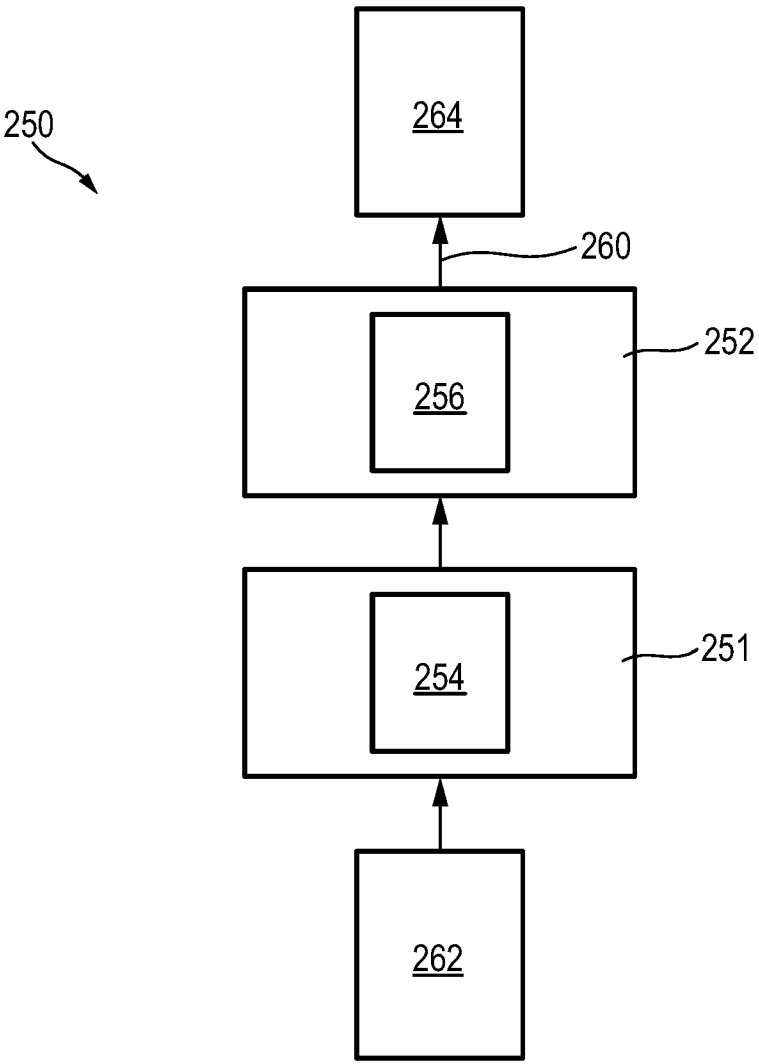
FIG. 2B illustrates a block diagram of another embodiment of a heating and airflow system consistent with implementations of the current subject matter.

FIGS. 2A and 2B illustrate first and second embodiments of a heating and airflow system 250 of a vaporizer device consistent with implementations of the current subject matter. For example, all or part of the heating and airflow systems 250 shown in FIGS. 2A and 2B may be contained in a vaporizer body and/or in a vaporizer cartridge configured to releasably couple to the vaporizer body. As shown in FIGS. 2A and 2B, the heating and airflow systems 250 include a first heating element 251 that is configured to heat a first chamber 254 configured to hold a first vaporizable material. Additionally, the heating and airflow systems 250 include a second heating element 252 that is configured to heat a second chamber 256 configured to hold a second vaporizable material. As such, the heating and airflow systems 250 of FIGS. 2A and 2B may produce a combined aerosol that includes inhalable extracts from both the first and second vaporizable material. The first heating element 251 and the second heating element 252 may include the same or different configurations and type of heating element, and may be independently controlled. For example, the first heating element 251 and the second heating element 252 may be controlled to reach different temperatures and/or heat for different amounts of time.

For example, the first chamber 254 may be configured for containing a liquid vaporizable material and the first heating element 251 may be configured to heat or vaporize the liquid vaporizable material. Additionally, the second chamber 256 may be configured to contain a non-liquid vaporizable material and the second heating element 252 may be configured to heat and/or vaporize the non-liquid vaporizable material. As will be described in greater detail below, inhalable extracts from both the liquid and non-liquid vaporizable material may be combined for inhalation by a user.

For example, FIG. 2A shows an airflow pathway 260 that includes an inlet 262, an outlet 264, and a first pathway 266 and a second pathway 268 that extend between the inlet 262 and outlet 264. The first pathway 266 may pass through or adjacent the first heating element 251 and/or first chamber 254 to allow inhalable extracts (e.g., within an aerosol) created from heating and/or vaporizing the liquid vaporizable material to mix with the airflow passing through the vaporizer device. Additionally, the second pathway 268 may pass through or adjacent the second heating element 252 and/or second chamber 256 to allow inhalable extracts created from heating and/or vaporizing the non-liquid vaporizable material to mix with the airflow passing through the vaporizer device.

As shown in FIG. 2A, when a user inhales on the vaporizer device (such as on the mouthpiece), airflow may be drawn into the inlet 262 and along the airflow pathway 260. For example, a first part of the airflow may travel along the first pathway 266 thereby collecting the inhalable extracts of the liquid vaporizable material. Additionally, a second part of the airflow may travel along the second pathway 268 thereby collecting inhalable extracts of the non-liquid vaporizable material. The first part and second part of the airflow may converge prior to passing through the outlet 264 (e.g., a port along the mouthpiece). For example, the first pathway 266 and the second pathway 268 may converge at a mixing chamber that allows the inhalable extracts from the liquid and non-liquid vaporizable material to be combined prior to traveling out the outlet 264 for inhalation by a user.

Various airflow pathways may be implemented in the heating and airflow system 250 and are within the scope of this disclosure. For example, as shown in FIG. 2B, the airflow pathway 260 may include a single pathway that travels through and/or adjacent to the first heating element 251 and the second heating element 252 and the first chamber 254 and the second chamber 256 sequentially. As such, the airflow passing through and/or adjacent to the second heating element 252 and second chamber 256 may include inhalable extracts from the heated and/or vaporized first vaporizable material. Inhalable extracts from the heated and/or vaporized second vaporizable material may be added to the airflow such that the airflow exiting the outlet 264 includes the combined aerosol.

Figure 3:
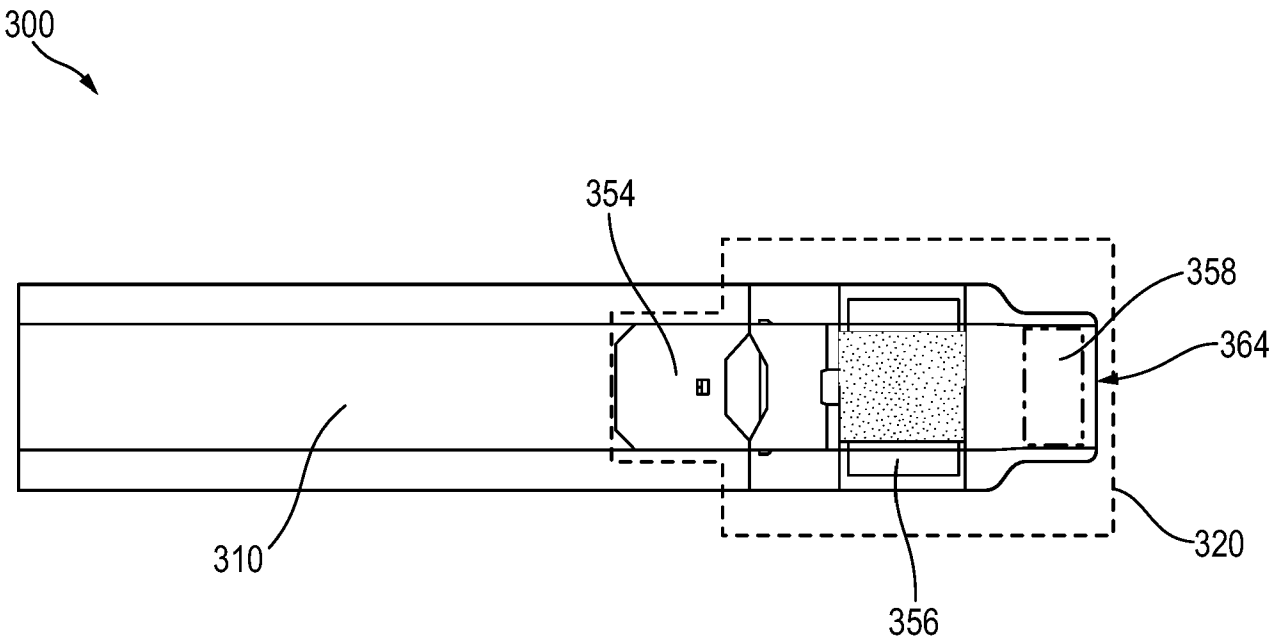
FIG. 3 illustrates a top view of an embodiment of a vaporizer including the heating and airflow system of FIG. 2B.

FIG. 3 illustrates an example embodiment of a vaporizer device 300 including a removable vaporizer cartridge 320 coupled to a vaporizer body 310 and a heating and airflow system consistent with this disclosure, such as the heating and airflow system 250 shown in FIG. 2B. As shown in FIG. 3, the vaporizer cartridge 320 includes an atomizer chamber 354 including humectants that may be vaporized by a first heating element 351. Additionally, the vaporizer cartridge 320 includes a tobacco chamber 356 including tobacco blends that may be heated and/or vaporized by a second heating element 352. The airflow pathway 360 of the vaporizer device 300 shown in FIG. 3 may travel linearly through and/or adjacent the first heating element 351 and the second heating element 352 to collect and combine inhalable extracts from the humectants and tobacco for inhalation by a user.

In some embodiments, other inhalable extracts and/or other aerosol flavorants may be optionally provided in a flavor filter 358. The flavor filter 358 may be positioned between the tobacco chamber 356 and an outlet 364.

Figure 4A:
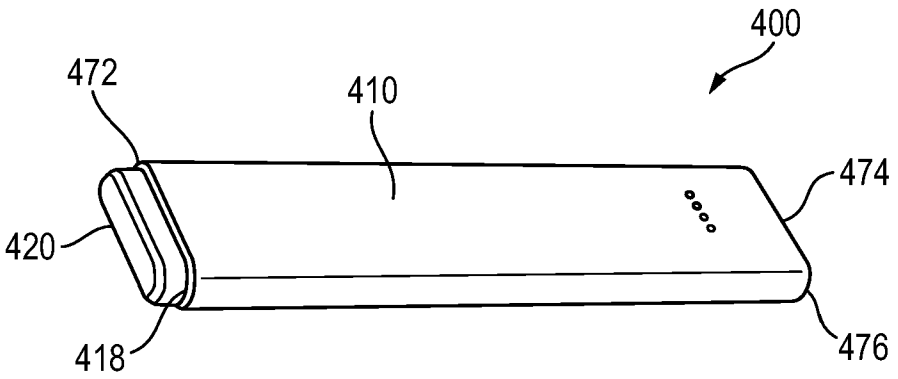
FIG. 4A illustrates a top perspective view of another embodiment of a vaporizer including a liquid vaporizable material cartridge inserted at a first end of the vaporizer and a non-liquid tobacco cartridge inserted at a second end of the vaporizer.
Figure 4B:
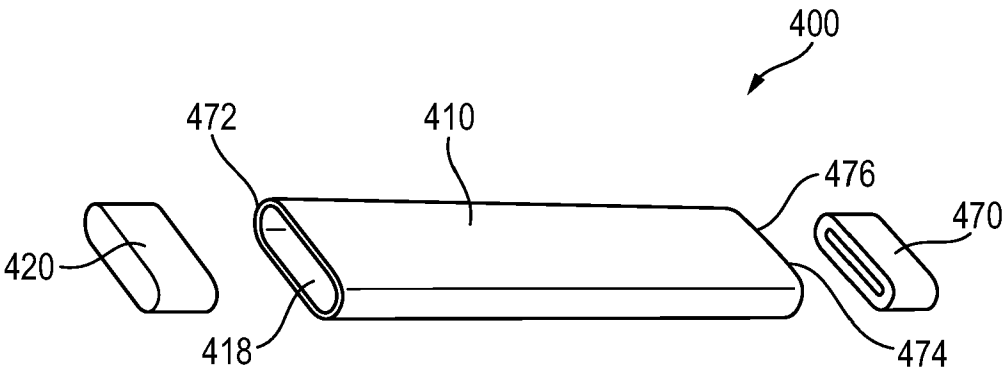
FIG. 4B illustrates a top perspective exploded view of the vaporizer of FIG. 4A showing the liquid vaporizable material cartridge and the non-liquid tobacco cartridge removed from the first and second ends, respectively, of the vaporizer.

FIGS. 4A-4D illustrate another embodiment of a vaporizer device 400 configured to releasably couple two separate cartridges, such as a first cartridge 420 configured to contain a liquid vaporizable material and a second cartridge 470 configured to contain a non-liquid tobacco material. As shown in FIGS. 4A and 4B, the vaporizer device 400 can include a first cartridge receptacle 418 at a first end 472 of a vaporizer body 410 that is configured to releasably couple the first cartridge 420, as well as a second cartridge receptacle 474 at a second end 476 of the vaporizer body 410 that is configured to releasably couple the second cartridge 470. For example, the first cartridge 420 and first cartridge receptacle 418 can include features that allow for vaporization of the liquid vaporizable material contained within the first cartridge 420, such as any of such features described herein. Additionally, the second cartridge 470 and the second cartridge receptacle 474 can include features that allow for vaporization of the non-liquid tobacco material contained within the second cartridge 470, such as any of such features described herein.

Either the first end 472 or the second end 476 of the vaporizer body 410, as well as either the first cartridge 420 or the second cartridge 470, can be configured to allow airflow to pass along and/or through. For example, airflow can travel along and/or through either the first cartridge 420 or the second cartridge 470 to allow inhalable extracts from the vaporized liquid vaporizable material and vaporized non-liquid tobacco material to be inhaled by a user puffing on the vaporizer device 400. The vaporizer device 400 can be configured such that the user can puff on either the first end 472 or the second end 476 of the vaporizer device 400 to thereby inhale aerosol containing inhalable extracts from the first cartridge 420 and the second cartridge 470.

Figure 4C:
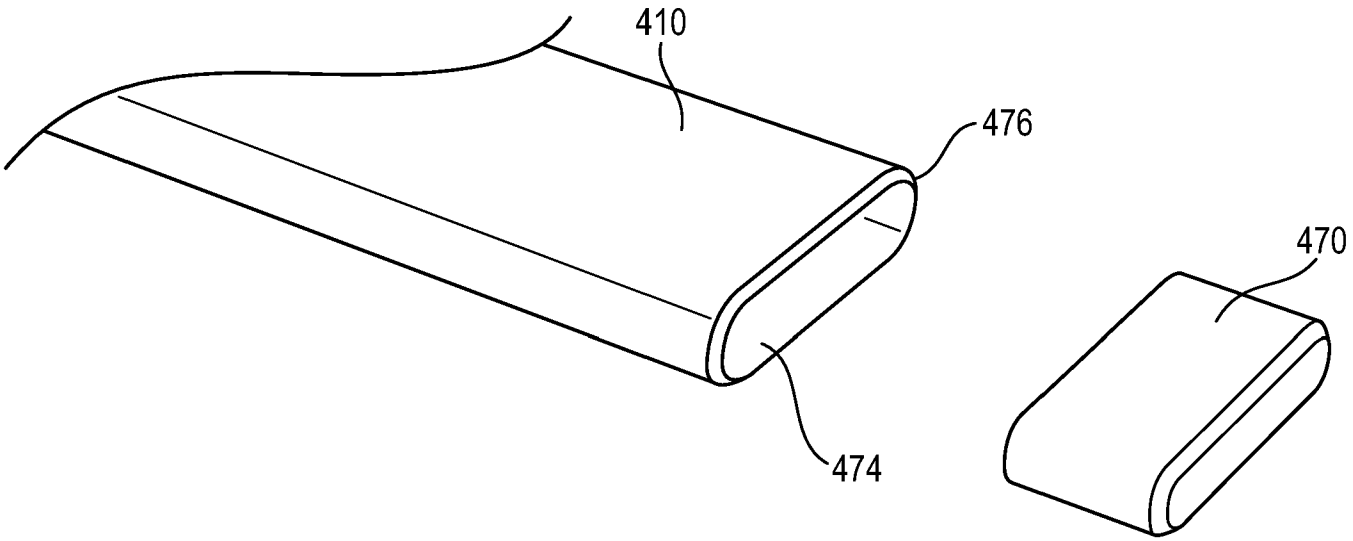
FIG. 4C illustrates a top perspective view of a distal end of the vaporizer of FIG. 4A showing a cartridge receptacle for inserting the tobacco cartridge therein.

FIG. 4C illustrates an example second cartridge 470 containing a non-liquid tobacco material that can be inserted and releasably coupled to the second cartridge receptacle 474. Both the first cartridge 420 and the second cartridge 470 can be refillable and/or replaceable thereby allowing the vaporizer device 400 to be used with various cartridges containing various materials.

In some embodiments, the first cartridge 420 and the second cartridge 470 can contain the same or similar materials, such as two different liquid vaporizable materials.

In some embodiments, the first cartridge receptacle 418 can be configured to only allow cartridges containing a liquid material or a non-liquid material. Similarly, the second cartridge receptacle 474 can be configured to only allow cartridges containing a liquid material or a non-liquid material.

In some embodiments, the vaporizer device 400 can be configured to form an aerosol for inhalation by a user only when both the first cartridge 420 and the second cartridge 470 are coupled to the vaporizer device 400. In some embodiments, only one of the first cartridge 420 and the second cartridge 470 need to be coupled to the vaporizer device 400 to allow the vaporizer device 400 to function to form an aerosol for inhalation by a user.

Figure 4D:
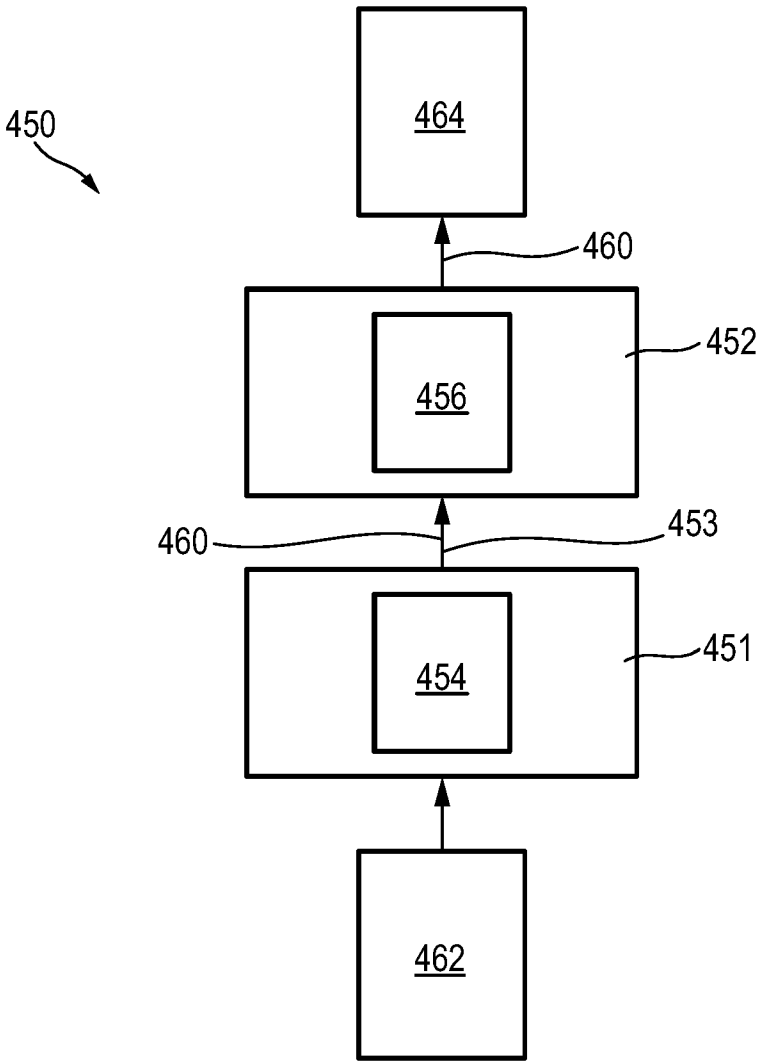
FIG. 4D illustrates a block diagram of another embodiment of a heating and airflow system consistent with implementations of the current subject matter.

FIG. 4D illustrates a third embodiment of a heating and airflow system 450 consistent with implementations of the current subject matter. For example, the heating and airflow system 450 illustrated in FIG. 4D can be included in the vaporizer device 400 and/or first cartridge 420 and the second cartridge 470 of FIGS. 4A-4C.

As shown in FIG. 4D the heating and airflow system 450 can include a first heating element 451 that is configured to heat a first chamber 454 configured to hold a first vaporizable material, such as the liquid vaporizable material contained within the first cartridge 420. Additionally, the heating and airflow system 450 can include a second heating element 452 that is configured to heat a second chamber 456 configured to hold a second vaporizable material, such as the non-liquid tobacco material contained within the second cartridge 470. As such, the heating and airflow system 450 of FIG. 4D may produce a combined aerosol that includes inhalable extracts from both the liquid and non-liquid vaporizable materials. The first heating element 451 and second heating element 452 may include the same or different configurations and type of heating element, and may be independently controlled. For example, the first heating element 451 and second heating element 452 may be controlled to reach different temperatures and/or heat for different amounts of time. For example, in some embodiments the heating element 150 can include the heating element including a nonlinear positive temperature coefficient of resistance material.

For example, the first chamber 454 may be configured for containing a liquid vaporizable material and the first heating element 451 may be configured to heat or vaporize the liquid vaporizable material. Additionally, the second chamber 456 may be configured to contain a non-liquid vaporizable material and the second heating element 452 may be configured to heat and/or vaporize the non-liquid vaporizable material. The first heating element 451 can be integrated with the vaporizer device 400 or first cartridge 420 and the second heating element 452 can be integrated with the vaporizer device 400 or the second cartridge 470.

Furthermore, as shown in FIG. 4D, the heating and airflow system 450 can include a third heating element 453 positioned along the airflow pathway 460 and configured to assist with heating airflow traveling along the airflow pathway 460, such as upstream or downstream from another heater (e.g., a heater for vaporizing vaporizable material). For example, the third heating element 453 can be integrated with the vaporizer device 400 and positioned along the airflow pathway 460 upstream from the second chamber 456 and second heating element 452. As such, the third heating element 453 can increase the temperature of the airflow along the airflow pathway 460 leading up to the second chamber 456 and second heating element 452. For example, such heating of the airflow can allow the second chamber 456 to achieve a smaller temperature gradient along the second chamber 456, which can allow for efficient and effective vaporization of the vaporizable material (e.g., non-liquid tobacco material) contained therein. Furthermore, with the warmer airflow entering the second chamber 456 (compared to heating and airflow systems that do not heat airflow prior to entering a chamber containing vaporizing material), the non-liquid vaporizable material contained in the second chamber 456 can be heated by the second heating element 452 at a lower, more optimal temperatures. Such temperatures can at least reduce the formation of undesirable byproducts when vaporizing the non-liquid vaporizable material, as well as allow for effective start-and-stop vaporizing of the non-liquid vaporizable material. Such start-and-stop vaporizing can accommodate a user that wants to enjoy more than one session of puffing on the vaporizer device 400 using a single cartridge containing the non-liquid vaporizable material.

Figure 5A:
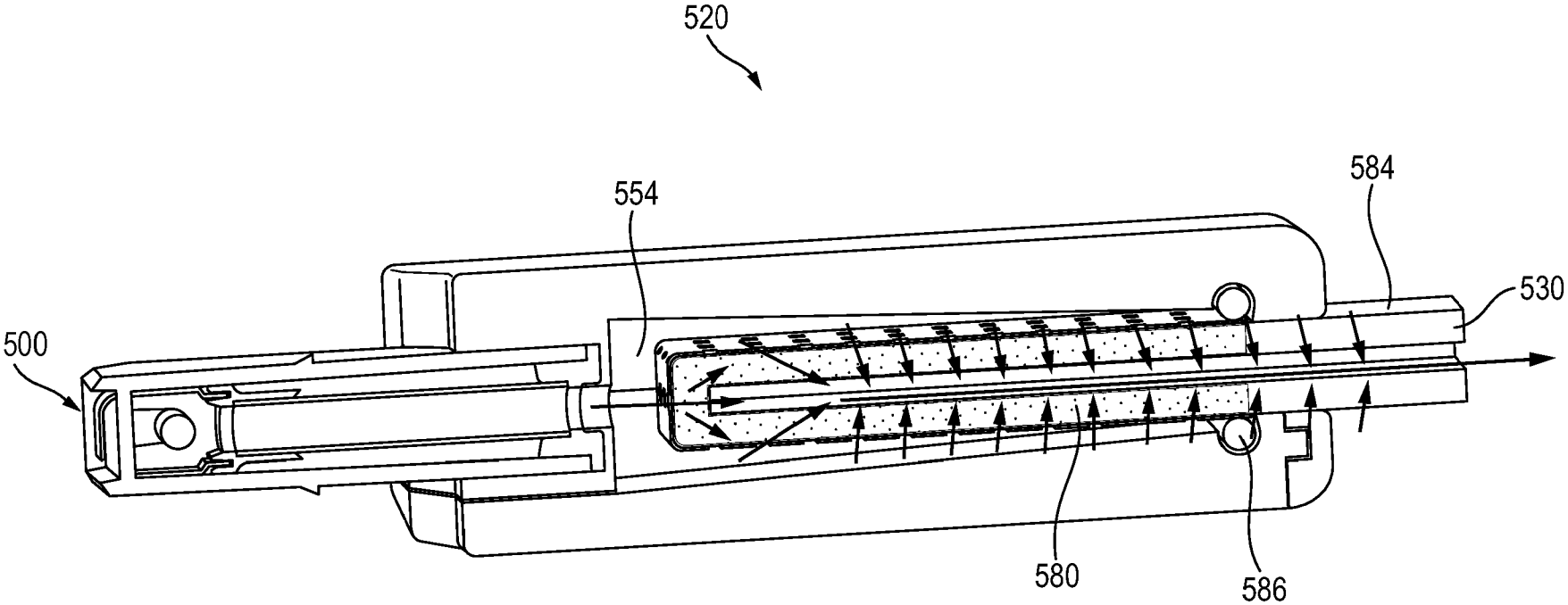
FIG. 5A illustrates a perspective cross-section view of an embodiment of a vaporizer cartridge with a tobacco consumable that is configured for use with any of the vaporizers described herein.
Figure 5B:
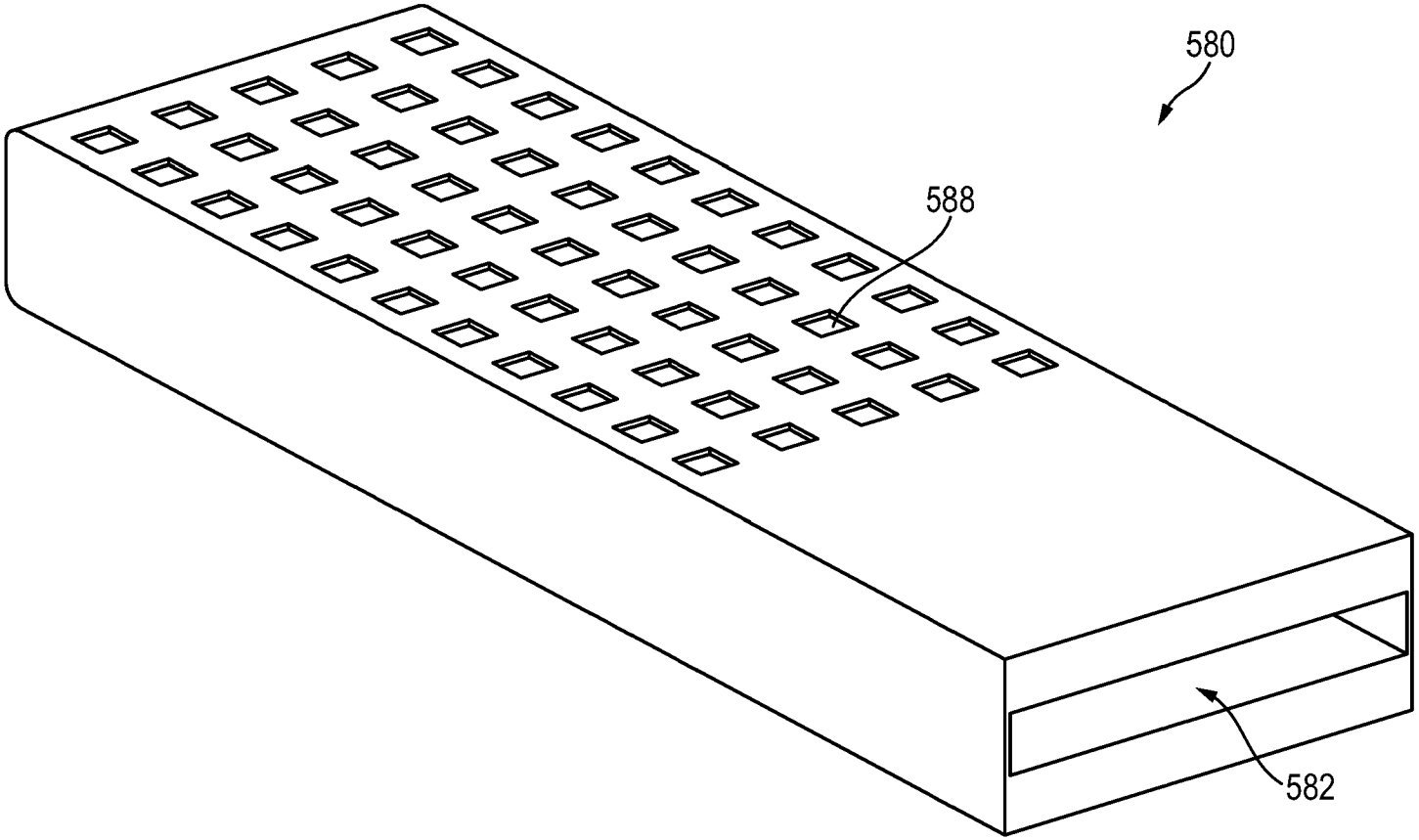
FIG. 5B illustrates a perspective side view of the tobacco consumable of FIG. 5A.
Figure 5C:
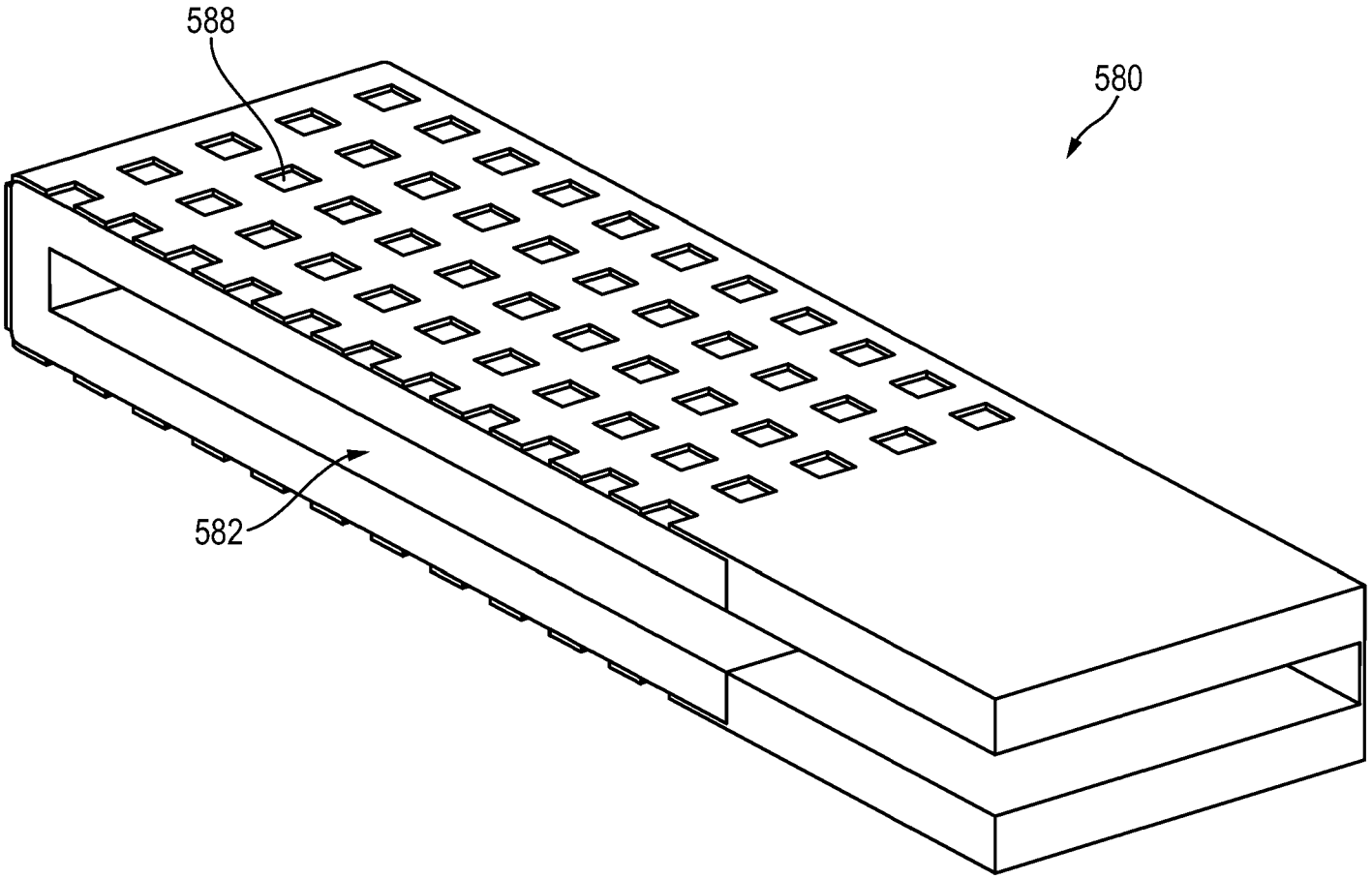
FIG. 5C illustrates a perspective cross-section view of the tobacco consumable of FIG. 5B, displaying a tobacco interior section.

FIGS. 5A-5C illustrate embodiments of a vaporizer cartridge 520 and a vaporizable material insert 580 that can be compatible for use with at least the vaporizer devices described herein. For example, FIG. 5A illustrate the vaporizer cartridge 520 with the vaporizable material insert 580 inserted in a chamber 554 of the vaporizer cartridge 520, which can include a heating element 550. As shown in FIGS. 5B and 5C, the vaporizable material insert 580 can include a hollow core 582 that is enclosed within the vaporizable material insert 580 except for an open end 584 of the vaporizable material insert 580 that can be positioned outside of the chamber 554 of the vaporizer cartridge 520, as shown in FIG. 5A.

As shown in FIG. 5A, the vaporizer cartridge 520 can include a seal 586 that forces heated air generated in the vaporizer cartridge 520 to pass through the walls of the vaporizable material insert 580 (which can contain the vaporizable material, such as tobacco) such that vapor or aerosol passes through the vaporizable material and into the hollow core 582 of the vaporizable material insert 580. Such vapor or aerosol can then pass from the hollow core 582 of the vaporizable material insert 580 and out the open end 584 of the vaporizable material insert 580, such as for allowing the aerosol to be inhaled by a user.

In some embodiments, the vaporizable material insert 580 can include an exterior shell made of one or more of a paper material and a plastic (low COG) material. In some embodiments, the vaporizable material insert 580 can include various hole pattern configurations, such as along one or more of an end and a side of the vaporizable material insert 580. For example, the holes or perforations 588 can allow air to pass therethrough for assisting in forming the inhalable aerosol that forms and/or collects in the hollow core 582 of the vaporizable material insert 580 for inhalation by a user. In some embodiments, the vaporizable material insert 580 can include a mouthpiece 530 that can assist a user with inhaling the inhalable aerosol.

At least one benefit of the vaporizable material insert 580 and vaporizer cartridge 520 of FIGS. 5A-5C includes that aerosol can be produced in the vaporizable material insert 580, including collecting in the hollow core 582. The airflow containing the aerosol can have a clean and direct exit path out of the vaporizer cartridge 520 and mouthpiece 530, such as without contacting or contaminating a part of the durable portion of the vaporizer device.

In some embodiments, the vaporizable material insert 580 can be configured for use with a vaporizer device having a heating element, and the vaporizable material insert 580 may include an elongated body including the hollow core 582 (or inner chamber) that is defined by sidewalls and a first end. The elongated body may include the open end 584 at a second end opposing the first end. The sidewalls may include a plurality of perforations 588, as shown in FIG. 5B. The hollow core 582 may be defined by the sidewalls and the first end, and the hollow core 582 may be in fluid communication with the plurality of perforations 588. Additionally, at least a part of the sidewalls of the vaporizable material insert may include a vaporizable material. Some embodiments of a vaporizer device may include a receptacle for receiving the vaporizable material insert 580, as well as a sealed airflow pathway that extends along the side walls of the vaporizable material insert 580 when the vaporizable material insert is inserted in the receptacle, as shown in FIG. 5A. The vaporizer device may be configured to flow heated air through the sealed airflow pathway to thereby allow the heated air to pass through the plurality of perforations and heat a vaporizable material to form and/or collect an inhalable aerosol in the hollow core 582. The inhalable aerosol in the hollow core 582 can then be inhaled by a user.

Various airflow pathways may be implemented in the heating and airflow system and are within the scope of this disclosure, including the heating and airflow systems described with regards to FIGS. 2A and 2B. For example, as shown in FIG. 4D, the airflow pathway 460 may include a single pathway that travels through the first chamber 454 and the second chamber 456 sequentially. For example, the airflow pathway 460 can sequentially travel adjacent to the first heating element 451, the third heating element 453, and the second heating element 452. As such, the airflow passing through and/or adjacent to the second heating element 452 and the second chamber 456 may include inhalable extracts from the heated and/or vaporized first heating element 451 and the first chamber 454. Furthermore, such airflow including inhalable extracts from the heated and/or vaporized first cartridge 420 can be heated along the airflow pathway 460 by the third heating element 453 before passing through the second heating element 452 and the second chamber 456. Inhalable extracts from the heated and/or vaporized second vaporizable material may be added to the airflow such that the airflow exiting the outlet 464 includes the combined aerosol. Various other airflow pathway configurations and heating and airflow systems are within the scope of this disclosure. For example, in some embodiments the heating element 150 can include the heating element including a nonlinear positive temperature coefficient of resistance material.

Vaporizers that include the heating and airflow systems described herein (e.g., heating and airflow systems shown in FIGS. 2A-3) may provide one or more of a vareity of benefits over currently available vaporizer devices. For example, the heating and airflow systems described herein may provide a combined aerosol (e.g., inhalable elements from liquid and non-liquid vaporizable material). Other benefits may include the ability to provide the combined aerosol on-demand thereby not requiring a user to have to wait for a heating element to reach a required temperture. Such heat-up time may typically be required for drawing inhalable extracts from non-liquid vaporizable material. In the heating and airflow systems described herein, the inhalable extracts are drawn from both non-liquid and liquid vaporizable materials where the liquid vaporizable materials may be vaporized more efficiently and effectively on-demand. Furthermore, the heating element configured to heat and/or vaporize the non-liquid vaporizable material may heat to a temperature (e.g., less than 150 degrees Celcius) that eliminates the potential for charring (e.g., reduce or elimitate amount of harmful and potentially harmful constituents produced) combined with the ability to start and stop a session at will, including multimple times with the same cartridge and/or heating and airflow systems. As such, a user may be able to enjoy multiple sessions with a single cartridge and not have to consume or use the entire non-liquid vaporizable material contained in the cartridge and/or heating and airflow systems in a single session. For example, since the non-liquid vaporizable material (e.g., tobacco) may be refreshed by vapor produced in the atomizer chamber, the user experience may be consistent throughout the session and subsequent sessions. Other benefits of the vaporizers and heating and airflow systems described herein are within the scope of this diclosure.

In an embodiment of the vaporizer device 100 in which the power source 112 is part of the vaporizer body 110, and a heating element is disposed in the vaporizer cartridge 120 and configured to couple with the vaporizer body 110, the vaporizer device 100 can include electrical connection features (for example, means for completing a circuit) for completing a circuit that includes the controller 104 (for example, a printed circuit board, a microcontroller, or the like), the power source 112, and the heating element (for example, a heating element within the atomizer). These features can include one or more contacts (referred to herein as cartridge contacts 124*a* and 124*b*) on one or more outer surfaces of the vaporizer cartridge 120 and at least two contacts (referred to herein as receptacle contacts 125*a* and 125*b*) disposed on the vaporizer body, optionally in a cartridge receptacle 118 of the vaporizer device 100 such that the cartridge contacts 124*a* and 124*b* and the receptacle contacts 125*a* and 125*b* make electrical connections when the vaporizer cartridge 120 is inserted into and coupled with the cartridge receptacle 118. The circuit completed by these electrical connections can allow delivery of electrical current to a heating element and can further be used for additional functions, such as measuring a resistance of the heating element for use in determining and/or controlling a temperature of the heating element based on a thermal coefficient of resistivity of the heating element.

Other configurations in which a vaporizer cartridge 120 is coupled to a vaporizer body 110 without being inserted into a cartridge receptacle 118 are also within the scope of the current subject matter. It will be understood that the references herein to "receptacle contacts" can more generally refer to contacts on a vaporizer body 110 that are not contained within the cartridge receptacle 118 but are nonetheless configured to make electrical connections with the cartridge contacts 124*a* and 124*b* of a vaporizer cartridge 120 when the vaporizer cartridge 120 and the vaporizer body 110 are coupled. The circuit completed by these electrical connections can allow delivery of electrical current to the resistive heating element and may further be used for additional functions, such as for example for measuring a resistance of the resistive heating element for use in determining and/or controlling a temperature of the resistive heating element based on a thermal coefficient of resistivity of the resistive heating element, for identifying a cartridge based on one or more electrical characteristics of a resistive heating element or the other circuitry of the vaporizer cartridge, etc. The vaporizer device 100 (and other features described herein in accordance with one or more implementations) may include circuitry having a heating element comprising a nonlinear positive temperature coefficient of resistance material, or features thereof, for example heating elements consistent with the as example implementations described in further detail below.

In some implementations of the current subject matter, the cartridge contacts 124*a* and 124*b* and the receptacle contacts 125*a* and 125*b* can be configured to electrically connect in either of at least two orientations. In other words, one or more circuits necessary for operation of the vaporizer device 100 can be completed by insertion of the vaporizer cartridge 120 into the cartridge receptacle 118 in a first rotational orientation (around an axis along which the vaporizer cartridge 120 is inserted into the cartridge receptacle 118 of the vaporizer body 110) such that the cartridge contact 124*a* is electrically connected to the receptacle contact 125*a* and the cartridge contact 124*b* is electrically connected to the receptacle contact 125*b*. Furthermore, the one or more circuits necessary for operation of the vaporizer device 100 can be completed by insertion of the vaporizer cartridge 120 in the cartridge receptacle 118 in a second rotational orientation such cartridge contact 124*a* is electrically connected to the receptacle contact 125*b* and cartridge contact 124*b* is electrically connected to the receptacle contact 125*a*.

In one example of an attachment structure for coupling the vaporizer cartridge 120 to the vaporizer body 110, the vaporizer body 110 includes one or more detents (for example, dimples, protrusions, etc.) protruding inwardly from an inner surface of the cartridge receptacle 118, additional material (such as metal, plastic, etc.) formed to include a portion protruding into the cartridge receptacle 118, and/or the like. One or more exterior surfaces of the vaporizer cartridge 120 can include corresponding recesses (not shown in FIG. 1A) that can fit and/or otherwise snap over such detents or protruding portions when the vaporizer cartridge 120 is inserted into the cartridge receptacle 118 on the vaporizer body 110. When the vaporizer cartridge 120 and the vaporizer body 110 are coupled (e.g., by insertion of the vaporizer cartridge 120 into the cartridge receptacle 118 of the vaporizer body 110), the detents or protrusions of the vaporizer body 110 can fit within and/or otherwise be held within the recesses of the vaporizer cartridge 120, to hold the vaporizer cartridge 120 in place when assembled. Such an assembly can provide enough support to hold the vaporizer cartridge 120 in place to ensure good contact between the cartridge contacts 124*a* and 124*b* and the receptacle contacts 125*a* and 125*b*, while allowing release of the vaporizer cartridge 120 from the vaporizer body 110 when a user pulls with reasonable force on the vaporizer cartridge 120 to disengage the vaporizer cartridge 120 from the cartridge receptacle 118. It will be understood that other configurations for coupling of a vaporizer cartridge 120 and a vaporizer body 110 are within the scope of the current subject matter, for example as discussed in more detail herein.

In some implementations, the vaporizer cartridge 120, or at least an insertable end of the vaporizer cartridge 120 configured for insertion in the cartridge receptacle 118, can have a non-circular cross section transverse to the axis along which the vaporizer cartridge 120 is inserted into the cartridge receptacle 118. For example, the non-circular cross section can be approximately rectangular, approximately elliptical (i.e., have an approximately oval shape), non-rectangular but with two sets of parallel or approximately parallel opposing sides (i.e., having a parallelogram-like shape), or other shapes having rotational symmetry of at least order two. In this context, approximate shape indicates that a basic likeness to the described shape is apparent, but that sides of the shape in question need not be completely linear and vertices need not be completely sharp. Rounding of both or either of the edges or the vertices of the cross-sectional shape is contemplated in the description of any non-circular cross section referred to herein.

The cartridge contacts 124*a* and 124*b* and the receptacle contacts 125*a* and 125*b* can take various forms. For example, one or both sets of contacts can include conductive pins, tabs, posts, receiving holes for pins or posts, or the like. Some types of contacts can include springs or other features to facilitate better physical and electrical contact between the contacts on the vaporizer cartridge 120 and the vaporizer body 110. The electrical contacts can optionally be gold-plated, and/or include other materials.

Further to the discussion above regarding the electrical connections between the vaporizer cartridge 120 and the vaporizer body 110 being reversible such that at least two rotational orientations of the vaporizer cartridge 120 in the cartridge receptacle 118 are possible, in some embodiments of the vaporizer device 100, the shape of the vaporizer cartridge 120, or at least a shape of the insertable end of the vaporizer cartridge 120 that is configured for insertion into the cartridge receptacle 118, can have rotational symmetry of at least order two. In other words, the vaporizer cartridge 120 or at least the insertable end of the vaporizer cartridge 120 can be symmetrical upon a rotation of 180° around an axis along which the vaporizer cartridge 120 is inserted into the cartridge receptacle 118. In such a configuration, the circuitry of the vaporizer device 100 can support identical operation regardless of which symmetrical orientation of the vaporizer cartridge 120 occurs.

Some aspects of the current subject matter relate to a vaporizer heater that utilizes a nonlinear positive temperature coefficient of resistivity (PTCR) heating element, also referred to as a PTCR heater, for use as a convective heater, such as in any of the vaporizer embodiments described herein. In such a convective heater for a vaporizer, air is heated by the heating element and passed over or through a vaporizable material to form a vapor and/or aerosol for inhalation. In some implementations, the vaporizable material may include a solid vaporizable material (e.g., loose-leaf materials commonly utilized in heat-not-burn (HNB) vaporizers) and/or a liquid vaporizable material (e.g., pre-filled cartridges, pods, and the like). A PTCR heating element (or alternatively, other heating elements consistent with the current disclosure) used for convective heating can enable more uniform heating of the vaporizable material. Improved uniformity in heating can provide a number of advantages, including avoiding differential temperature within vaporizable materials that act as an insulator, prevention of contamination of the heating element, and the like. And because the heating element can be formed from PTCR material, the heating element can be temperature self-limiting and, given a known range of applied voltages, will not heat beyond a specific temperature, thereby avoiding formation of unwanted, and potentially dangerous, chemical byproducts. A PTCR heating element may also optionally be implemented without the need for a temperature control circuit provided that the transition temperature of the PTCR material is selected to be capable of delivering heated air at a desired target operating temperature for the vaporizable material.

Figure 6:
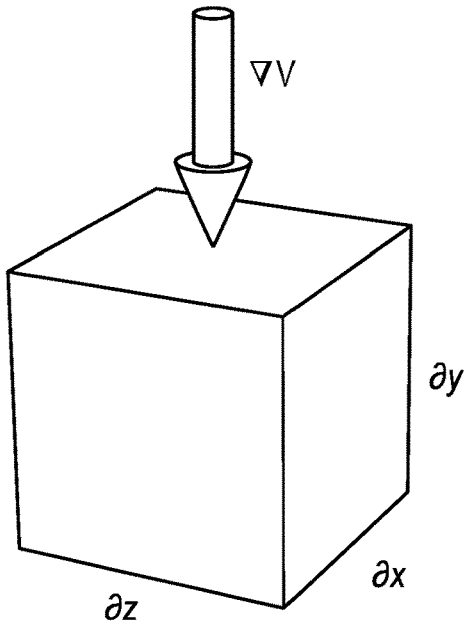
FIG. 6 illustrates example properties associated with thermal power generation within an isotropic PTCR material.
Figure 6:
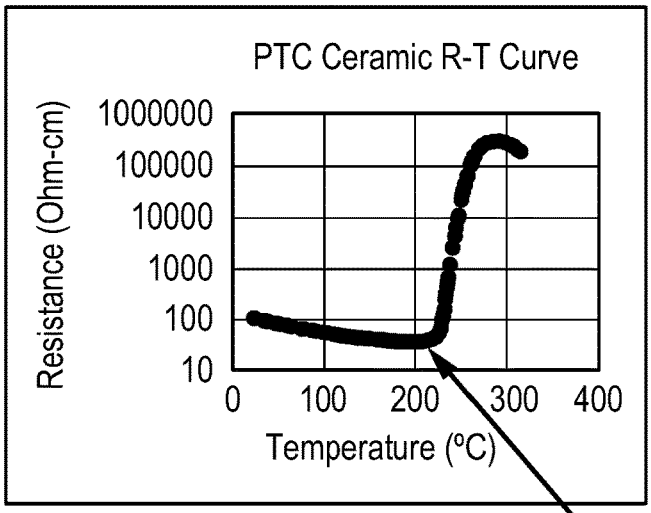

The thermal power generation within an isotropic PTCR material can be characterized such that, for every control volume ∂x, ∂y, ∂z within an isotropic PTCR material subject to a voltage gradient ΔV, the control volume ∂x, ∂y, z will heat to a temperature within the PTCR transition zone and hold that temperature within a wide range of ΔV as illustrated in FIG. 6. Thermal power generation can be expressed as:

$$P = \int_{vol} \frac{(\nabla V)^2}{\rho} dvol,$$

where P is thermal power generation, vol is the control volume (e.g., ∂x, ∂y, ∂z), and ρ is resistivity.

By utilizing a PTCR heating element some implementations can enable temperature to be controlled over a range of applied voltages and without the need for temperature sensors, electronic circuitry, microprocessors, and/or algorithms providing power control to the heating element.

As used herein, the term solid vaporizable material generally refers to vaporizable material that includes solid materials. For example, some vaporizer devices heat materials having origins as plant leaves or other plant components in order to extract plant specific flavor aromatics and other products as aerosol. These plant materials may be chopped and blended into a homogenized construct with a variety of plant products that may include tobacco, in which case nicotine and/or nicotine compounds may be produced and delivered in aerosol form to the user of such a vaporizer device. The homogenized construct may also include vaporizable liquids such as propylene glycol and glycerol in order to enhance the vapor density and aerosol produced when heated. In order to avoid production of unwanted harmful or potentially harmful constituents (HPHCs) vaporizer devices of this type benefit from heaters having temperature control means. Such vaporizer devices that heat plant leaves or homogenized construct as described above such that temperatures are kept below combustion levels are generally referred to as heat not burn (HNB) devices.

As used herein, the term liquid vaporizable material generally refers to vaporizable material without solid materials. The liquid vaporizable material can include, for example, a liquid, a solution, a wax, or any other form as may be compatible with use of a specific vaporizer device. In some implementations, a liquid vaporizable material can include any form suitable to utilize a wick or wicking element to draw the vaporizable material into a vaporization chamber.

Vaporizer devices operate by heating the vaporizable material to an appropriate temperature to create an aerosol but without burning or charring of the vaporizable material. One class vaporizer device is more sophisticated in that it utilizes relatively tight temperature control in order to prevent overheating and the related formation of HPHCs. Such sophistication, typically requiring electronic circuitry including a microprocessor, is typically difficult in HNB devices because of the inherent non-uniformity and related spatially inconsistent thermal properties of the vaporizable materials to be heated. This results in over temperature regions and potential HPHC production. And some existing solution fail to control local temperatures within vaporizer devices, resulting in a high probability of producing vaporizable material over temperature regions and HPHCs.

Another class of vaporizer device is simpler in that no means of temperature control is provided, such that the construction of the vaporizer device may be less expensive but includes a danger of overheating and thereby causing unwanted chemical byproducts.

In HNB vaporizer devices (e.g., where the vaporizable material is solid), some existing methods lack the ability to impose uniform temperatures for one or more of the following reasons. For example, to-be-heated solid vaporizable materials have low thermal diffusivity such that diffusion of high temperatures from a heating element into the solid vaporizable materials can be both slow and result in high thermal gradients. As a result, non-uniform heating can be an unavoidable consequence. As another example, if heating element temperature control is employed, the heating element temperature control typically addresses an average temperature such that heating of non-uniform solid vaporizable material via high temperatures within the heating element can result in high temperatures within the solid vaporizable materials. As yet another example, in order to allow for heating of the insulative materials, some existing HNB devices require preheating times that may equal or exceed 30 seconds with accompanying cost in both energy consumption, battery drain, and user inconvenience.

In vaporizer devices where fluids are vaporized by causing a heating element to come into contact with the fluids to be vaporized, contamination of the heating element can occur leading to potential for compromising performance. A solution to this problem can be to incorporate the heating element into a disposable part of the vaporizer such that the heating element is replaced with each new disposable part and thereby limiting, but not eliminating, heating element contamination.

To overcome the difficulty of uniform heating of vaporizable materials, some implementations of the current subject matter can provide for the preheating of air using one or a plurality of PTCR heating elements in conjunction with a heat exchanger. As a user draws air into a vaporizer device, the incoming air is heated to a controlled temperature as it passes over the heat exchanger and then passes through or over the to-be-heated vaporizable material. The vaporizable material can be a solid material (e.g., as in a HNB material) or a liquid (e.g., fluid with a porous wick). In some implementations, the air can pass over the heat exchanger and then pass over and/or through a porous wick saturated with liquid vaporizable material, then through a solid vaporizable material (e.g., a HNB material), and then to the user. In some implementations, geometry for influx of cooling air may be included between the wick and the user, for example, a balanced air inlet. In addition, the current subject matter can provide for a PTCR heater having intrinsic temperature control such, for a given range of supply voltage (which can be variable by a factor of ten or more in some implementations), a designed peak temperature will not be exceeded. Such an approach can result in improved uniform heating of vaporizable material as compared to some conventional approaches.

In addition, using this convective heating approach, the PTCR heating element (or some other, conventional heating element) can be placed upstream of the wick, fluid container, and/or vaporizable material, such that the PTCR heating element is completely removed from any disposable part of the mechanism. By including the PTCR heating element in a non-disposable portion of the vaporizer device, unnecessary waste can be avoided. It will be understood that while the description of the particular convective heating embodiment refers to use of a heating element formed from or including a PTCR material to thereby optionally be temperature self-limiting, other heating elements (configured for convective, conductive, and/or radiative heating) are also within the scope of the current disclosure. One of ordinary skill in the art will understand that a PTCR element as described herein could be replaced by a conventional resistive heating element used in conjunction with electrical and/or electronic circuitry capable of providing some control over a temperature to which the heating element and/or air moving across it and/or vaporizable material heated by it is elevated.

Figure 7:
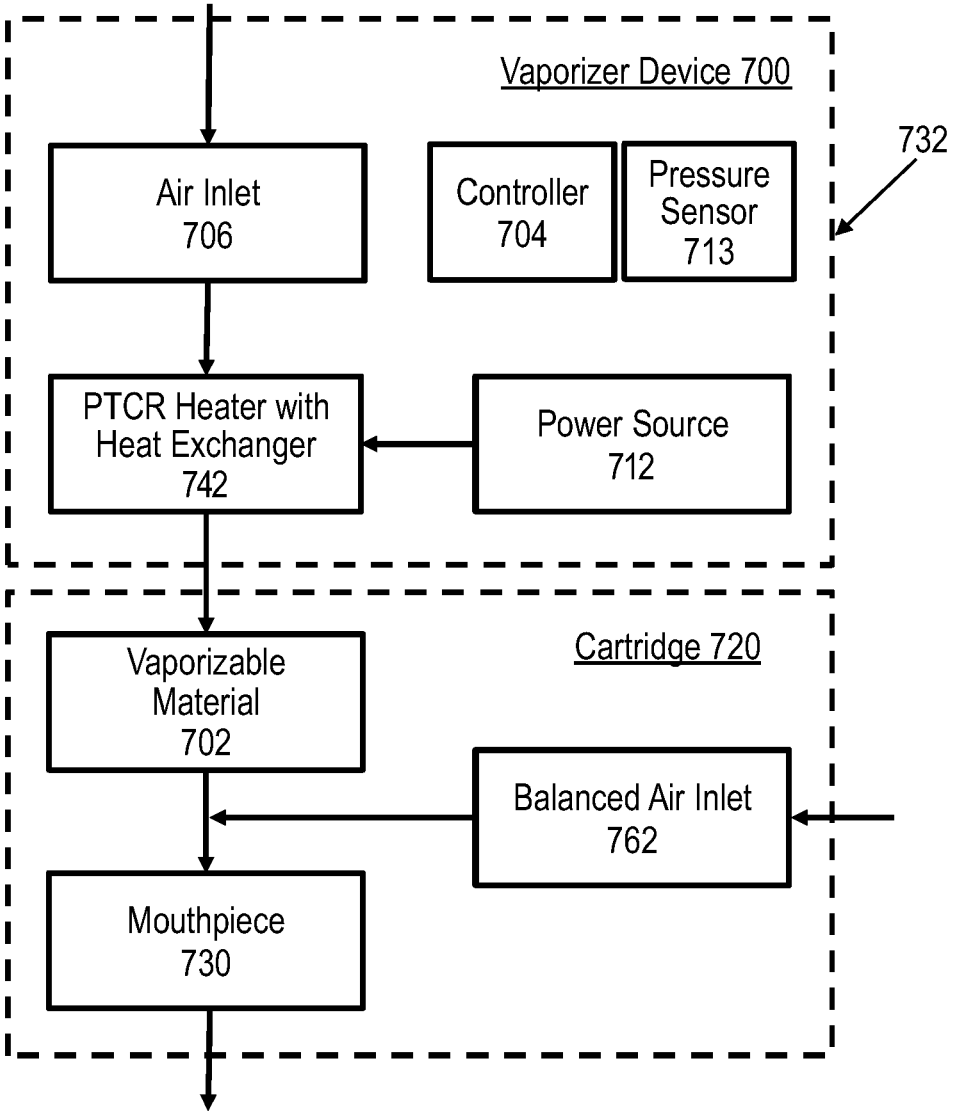
FIG. 7 is a block diagram illustrating an example vaporizer device according to some implementations of the current subject matter that can provide for uniform heating of vaporizable material utilizing convective heating.

FIG. 7 illustrates a block diagram of an embodiment of a vaporizer device 700, according to some implementations of the current subject matter, which can provide for uniform heating of a vaporizable material 702 utilizing convective heating. The example system as shown in FIG. 7 includes an air inlet 706, a PTCR heater with heat exchanger 742, and a power source 712, such as a battery, capacitor, and/or the like. The vaporizer device 700 can include a housing 732, which can couple to one or more of the PTCR heater with heat exchanger 742 and the power source 712. In some implementations, the vaporizer device 700 can optionally include a controller 704 and a pressure sensor 713. In some implementations, the housing 732 can define the air inlet 706.

The heater with heat exchanger may be a conventional heating element or may include a heating element formed of PTCR material, which is described in more detail below. A PTCR heater with heat exchanger 742 can be thermally coupled to the heating element and can be configured to transfer heat between the heating element and airflow that passes over and/or through the PTCR heater with heat exchanger 742. The PTCR heater with heat exchanger 742 can include multiple heat exchangers, for example, coupled to different sides of the heating element, and can include a flow diverter for diverting the airflow through and/or over fins of the heat exchanger to improve heat transfer. A more detailed discussion of example PTCR heaters with heat exchanger 742 is found below with reference to FIGS. 14-33G.

The vaporizer device 700 can include a connector 715 (shown in FIGS. 9, 10, and 13) for coupling the housing 732 to one or more cartridges 720 that include a vaporizable material 702. In some implementations, the cartridge 720 can include a mouthpiece 730. In some implementations, the coupling is removable such that the cartridge 720 can be coupled and decoupled from the vaporizer device 700 via the connector 715 easily and by a user.

When the vaporizer device 700 is coupled to the cartridge 720, the vaporizer device 700 and cartridge 720 can be arranged to define an airflow path from the air inlet 706, though and/or over the PTCR heater with heat exchanger 742, through the vaporizable material 702, and out the mouthpiece 730.

The controller 704 (e.g., a processor, circuitry, etc., capable of executing logic) may be configured for controlling delivery of heat to cause a vaporizable material 702 to be converted from a condensed form (e.g., a solid, a liquid, a solution, a suspension, a part of an at least partially unprocessed plant material, etc.) to the gas phase. The controller 704 may be part of one or more printed circuit boards (PCBs) consistent with certain implementations of the current subject matter.

The power source 712 can include any source suitable for applying electrical power to the PTCR heater with heat exchanger 742. For example, the power source 712 can include a battery, a capacitor (even with resistor-capacitor (RC) decay), and/or the like. In some implementations, the power source 712 can provide a voltage, which can be chosen from a wide range of voltages. For example, in some implementations, the power source 712 can provide a voltage between 3 volts and 50 volts or more. In some implementations, voltage supplied to the PTCR heater with heat exchanger 742 can vary by an order of magnitude with little effect on the PTCR heater with heat exchanger 742 performance. In some implementations, the power source 712 can include multiple power sources, which can be selected based on operating conditions and/or desired vaporizer device performance.

In operation, a user can draw air through the mouthpiece 730 (e.g., puff), which can be detected by the controller 704 using the pressure sensor 713. In response to detecting a puff, the controller 704 can cause application of current from the power source 712 to the PTCR heater with heat exchanger 742, thereby causing the PTCR heater with heat exchanger 742 to warm. Because the PTCR heater with heat exchanger 742 is formed of PTCR material, heating will be self-limiting and the heating element will not overheat.

The airflow passes through the air inlet 706 and over and/or through the PTCR heater with heat exchanger 742, causing air in the airflow to uniformly heat. The uniformly heated air passes to the vaporizable material 702 causing the vaporizable material 702 to also heat uniformly and to form a vapor (gas). The vaporizable material 702 can include a liquid, a solution, a solid, a wax, or any other form. In some implementations, incoming air passing along the airflow path passes over, through, and the like, a region or chamber (e.g., an atomizer), where gas phase vaporizable material is entrained into the air.

The entrained gas-phase vaporizable material may condense as it passes through the remainder of the airflow path such that an inhalable dose of the vaporizable material in an aerosol form can be delivered to the mouthpiece 730 for inhalation by the user in the form of a vapor and/or aerosol. In some implementations, the cartridge 720 includes a balanced air inlet 762 that can serve to provide ambient temperature air for mixing with the heated air after the heated air passes through the vaporizable material (e.g., downstream from the PTCR heater with heat exchanger 742 and the vaporizable material 702), thereby cooling the airflow prior to inhalation by the user. In some implementations, the balanced air inlet 762 is integrated with mouthpiece 730.

Activation of the PTCR heater with heat exchanger 742 may be caused by one or more events. Such events may include an automatic detection of the puff based on one or more of signals generated by one or more sensors, such as the pressure sensor 713 or sensors disposed to detect pressure along the airflow path relative to ambient pressure (or optionally to measure changes in absolute pressure), one or more motion sensors of the vaporizer device, one or more flow sensors of the vaporizer device, or a capacitive lip sensor of the vaporizer device. Other events may include a response to detection of interaction of a user with one or more input devices (e.g., buttons or other tactile control devices of the vaporizer such as a manual toggle switch, pushbutton switch, pressure switch, and the like), receipt of signals from a computing device in communication with the vaporizer and/or via other approaches for determining that a puff is occurring or imminent.

As alluded to in the previous paragraph, a vaporizer device consistent with implementations of the current subject matter may be configured to connect (e.g., wirelessly or via a wired connection) to a computing device (or optionally two or more devices) in communication with the vaporizer. To this end, the controller 704 may include communication hardware. The controller 704 may also include a memory. A computing device can be a component of a vaporizer system that also includes the vaporizer device, and can include its own communication hardware, which can establish a wireless communication channel with the communication hardware of the vaporizer device. For example, a computing device used as part of a vaporizer system may include a general-purpose computing device (e.g., a smartphone, a tablet, a personal computer, some other portable device such as a smartwatch, or the like) that executes software to produce a user interface for enabling a user of the device to interact with a vaporizer. In other implementations of the current subject matter, such a device used as part of a vaporizer system can be a dedicated piece of hardware such as a remote control or other wireless or wired device having one or more physical or soft (e.g., configurable on a screen or other display device and selectable via user interaction with a touch-sensitive screen or some other input device like a mouse, pointer, trackball, cursor buttons, or the like) interface controls. The vaporizer device can also include one or more output features or devices for providing information to the user.

A computing device that is part of a vaporizer system as defined above can be used for any of one or more functions, such as controlling dosing (e.g., dose monitoring, dose setting, dose limiting, user tracking, etc.), controlling sessioning (e.g., session monitoring, session setting, session limiting, user tracking, and the like), controlling nicotine delivery (e.g., switching between nicotine and non-nicotine vaporizable material, adjusting an amount of nicotine delivered, and the like), obtaining locational information (e.g., location of other users, retailer/commercial venue locations, vaping locations, relative or absolute location of the vaporizer itself, and the like), vaporizer personalization (e.g., naming the vaporizer, locking/password protecting the vaporizer, adjusting one or more parental controls, associating the vaporizer with a user group, registering the vaporizer with a manufacturer or warranty maintenance organization, and the like), engaging in social activities (e.g., games, social media communications, interacting with one or more groups, and the like) with other users, or the like. The terms "sessioning", "session", "vaporizer session," or "vapor session," are used generically to refer to a period devoted to the use of the vaporizer. The period can include a time period, a number of doses, an amount of vaporizable material, and/or the like.

In the example in which a computing device provides signals related to activation of the PTCR heater with heat exchanger 742, or in other examples of coupling of a computing device with a vaporizer for implementation of various control or other functions, the computing device executes one or more computer instructions sets to provide a user interface and underlying data handling. In one example, detection by the computing device of user interaction with one or more user interface elements can cause the computing device to signal the vaporizer to activate the PTCR heater with heat exchanger 742 to a full operating temperature for creation of an inhalable dose of vapor/aerosol. Other functions of the vaporizer may be controlled by interaction of a user with a user interface on a computing device in communication with the vaporizer.

The temperature of a PTCR heater with heat exchanger 742 of a vaporizer may depend on a number of factors, including conductive heat transfer to other parts of the electronic vaporizer and/or to the environment, latent heat losses due to vaporization of a vaporizable material from the wicking element and/or the atomizer as a whole, and convective heat losses due to airflow (e.g., air moving across the heating element or the atomizer as a whole when a user inhales on the electronic vaporizer). As noted above, to reliably activate the PTCR heater with heat exchanger 742 or heat the PTCR heater with heat exchanger 742 to a desired temperature, a vaporizer may, in some implementations of the current subject matter, make use of signals from the pressure sensor 713 to determine when a user is inhaling. The pressure sensor 713 can be positioned in the airflow path and/or can be connected (e.g., by a passageway or other path) to an airflow path connecting the air inlet 706 for air to enter the vaporizer device and an outlet (e.g., in the mouthpiece 730) via which the user inhales the resulting vapor and/or aerosol such that the pressure sensor 713 experiences pressure changes concurrently with air passing through the vaporizer device from the air inlet 706 to the air outlet. In some implementations of the current subject matter, the PTCR heater with heat exchanger 742 may be optionally activated in association with a user's puff, for example by automatic detection of the puff, for example by the pressure sensor 713 detecting a pressure change in the airflow path. In some implementations, a switch is an input device that may be used to electrically complete a circuit between the power source 712 and the PTCR heater with heat exchanger 742. In some implementations, an input device that includes a relay, a solenoid, and/or a solid-state device that may be used to electrically complete a circuit between the power source and the PTCR heater with heat exchanger 742 to activate the vaporizer device.

Typically, the pressure sensor 713 (as well as any other sensors) can be positioned on or coupled (e.g., electrically or electronically connected, either physically or via a wireless connection) to the controller 704 (e.g., a printed circuit board assembly or other type of circuit board). To take measurements accurately and maintain durability of the vaporizer, it can be beneficial to provide a resilient seal to separate an airflow path from other parts of the vaporizer. The seal, which can be a gasket, may be configured to at least partially surround the pressure sensor 713 such that connections of the pressure sensor 713 to internal circuitry of the vaporizer are separated from a part of the pressure sensor 713 exposed to the airflow path. In an example of a cartridge-based vaporizer device, the seal or gasket may also separate parts of one or more electrical connections between a vaporizer body and a vaporizer cartridge. Such arrangements of a gasket or seal in a vaporizer can be helpful in mitigating against potentially disruptive impacts on vaporizer components resulting from interactions with environmental factors such as water in the vapor or liquid phases, other fluids such as the vaporizable material, etc., and/or to reduce escape of air from the designed airflow path in the vaporizer. Unwanted air, liquid or other fluid passing and/or contacting circuitry of the vaporizer can cause various unwanted effects, such as alter pressure readings, and/or can result in the buildup of unwanted material, such as moisture, the vaporizable material, etc., in parts of the vaporizer where they may result in poor pressure signal, degradation of the optional pressure sensor or other components, and/or a shorter life of the vaporizer. Leaks in the seal or gasket can also result in a user inhaling air that has passed over parts of the vaporizer device containing or constructed of materials that may not be desirable to be inhaled.

In some implementations, the cartridge 720 can include a fibrous body for cooling the heated air after it passes through the vaporizable material 702. As noted above, the vaporizable material 702 can include solid vaporizable material (e.g., HNB materials) and/or liquid vaporizable material (e.g., a liquid, a solution, and the like).

Figure 8:
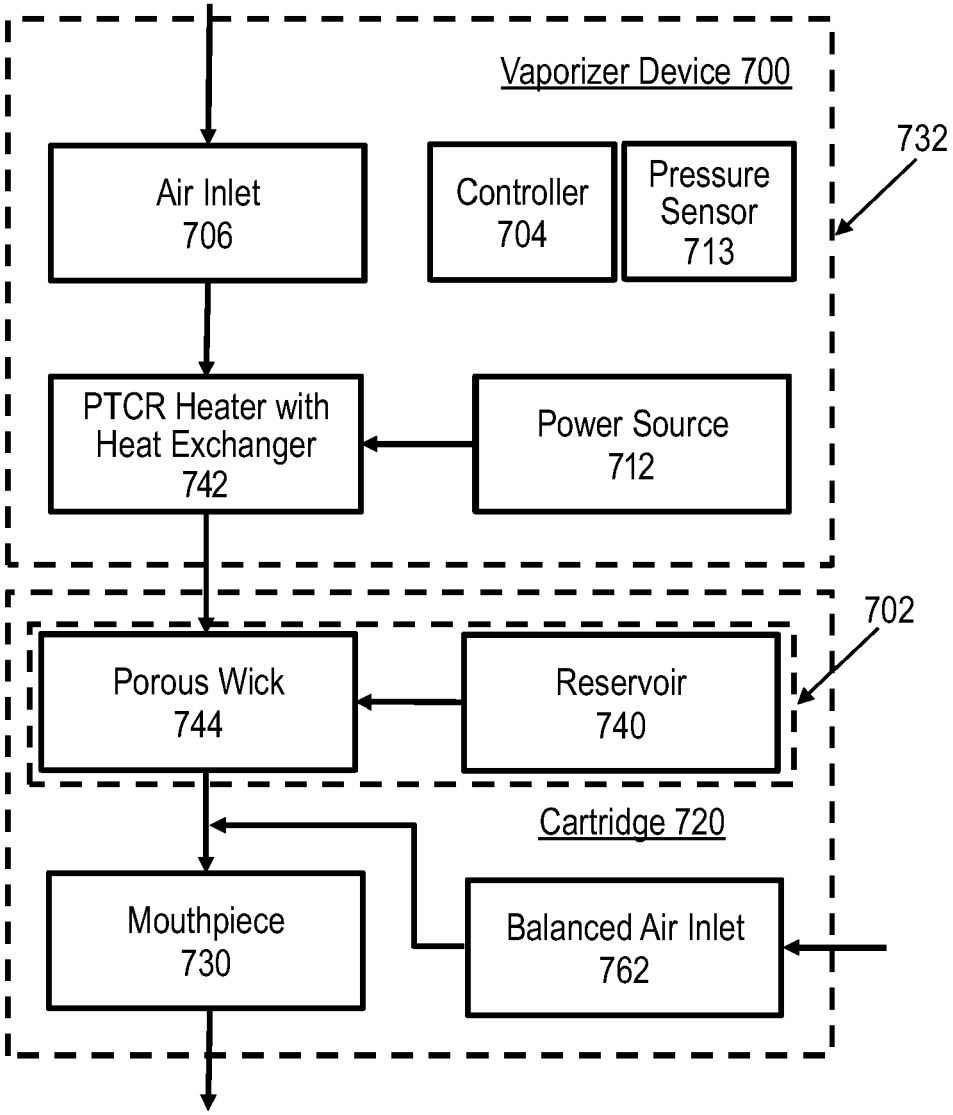
FIG. 8 is a block diagram of an example vaporizer device and cartridge with liquid vaporizable material that can provide for uniform heating of vaporizable material utilizing convective heating.

FIG. 8 illustrates a block diagram of an embodiment of a vaporizer device 700 and cartridge 720 with a liquid vaporizable material that can provide for uniform heating of the vaporizable material 702 utilizing convective heating. The vaporizable material 702 includes an atomizer including a porous wick 744 in fluidic communication with a fluid tank or fluid reservoir 740. The porous wick 744 is located within the path of the airflow between the PTCR heater with heat exchanger 742 and the mouthpiece 730. The porous wick 744 is located such that, in operation, heated air passes over and/or through the porous wick 744, which is saturated with the vaporizable material 702, causing vaporization of the liquid vaporizable material saturating the porous wick 744 thereby forming a vapor and/or aerosol. In some implementations, the porous wick 744 may allow air to enter the fluid reservoir 740 to replace the volume of liquid removed. In other words, capillary action pulls liquid vaporizable material into the porous wick 744 for vaporization by the heated air, and air may, in some implementations of the current subject matter, return to the fluid reservoir 740 through the wick to at least partially equalize pressure in the fluid reservoir 740. Other approaches to allowing air back into the fluid reservoir 740 to equalize pressure are also within the scope of the current subject matter.

Figure 9:
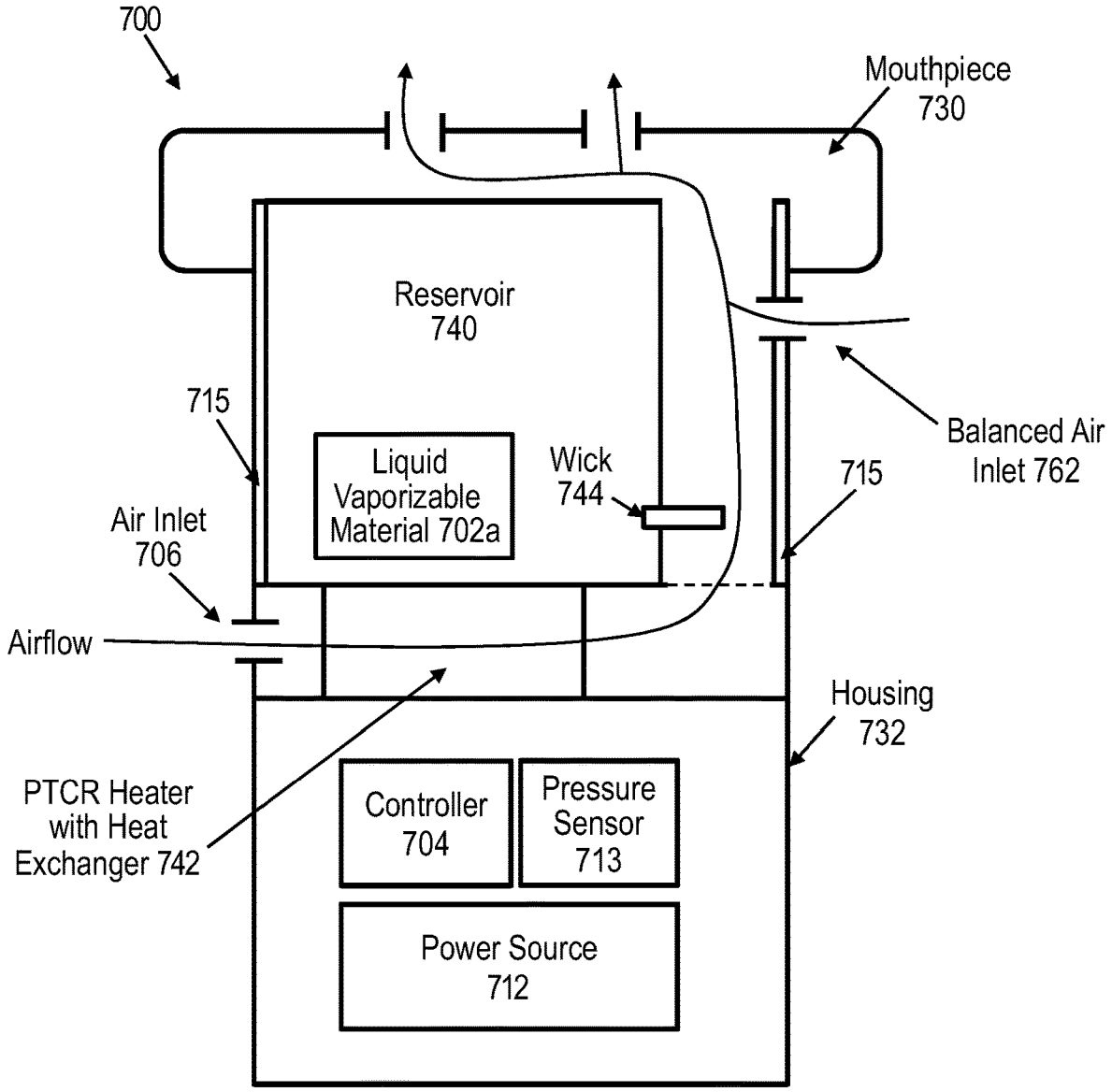
FIG. 9 is a cross-sectional view of an example vaporizer device with liquid vaporizable material.
Figure 10:
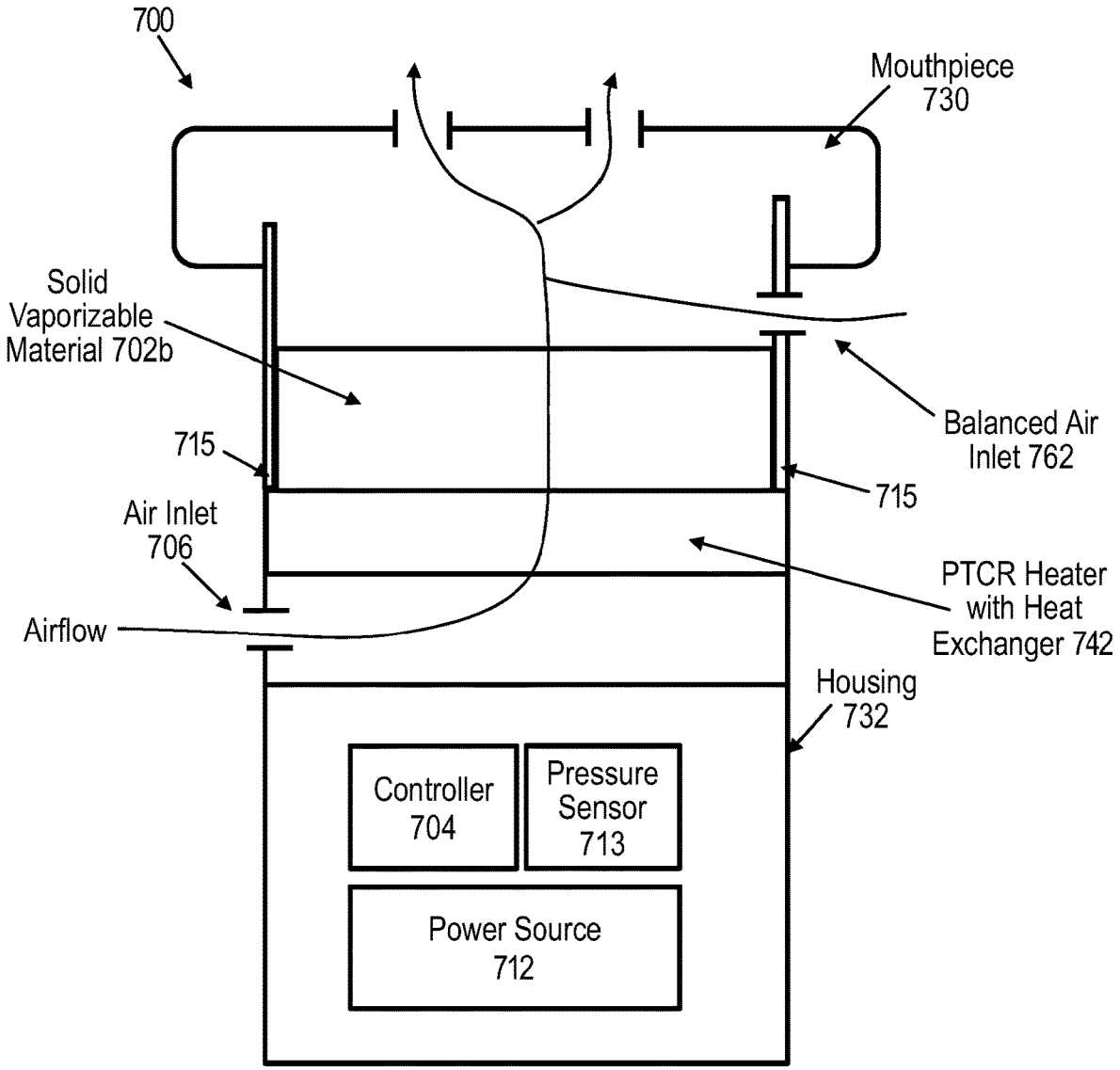
FIG. 10 is a cross-sectional view of an example vaporizer device with solid vaporizable material (e.g., heat-not-burn product)

FIG. 9 illustrates a cross-sectional view of an example vaporizer device with liquid vaporizable material and FIG.

10 illustrates a cross-sectional view of an example vaporizer device with solid vaporizable material (e.g., HNB product).

Figure 11:
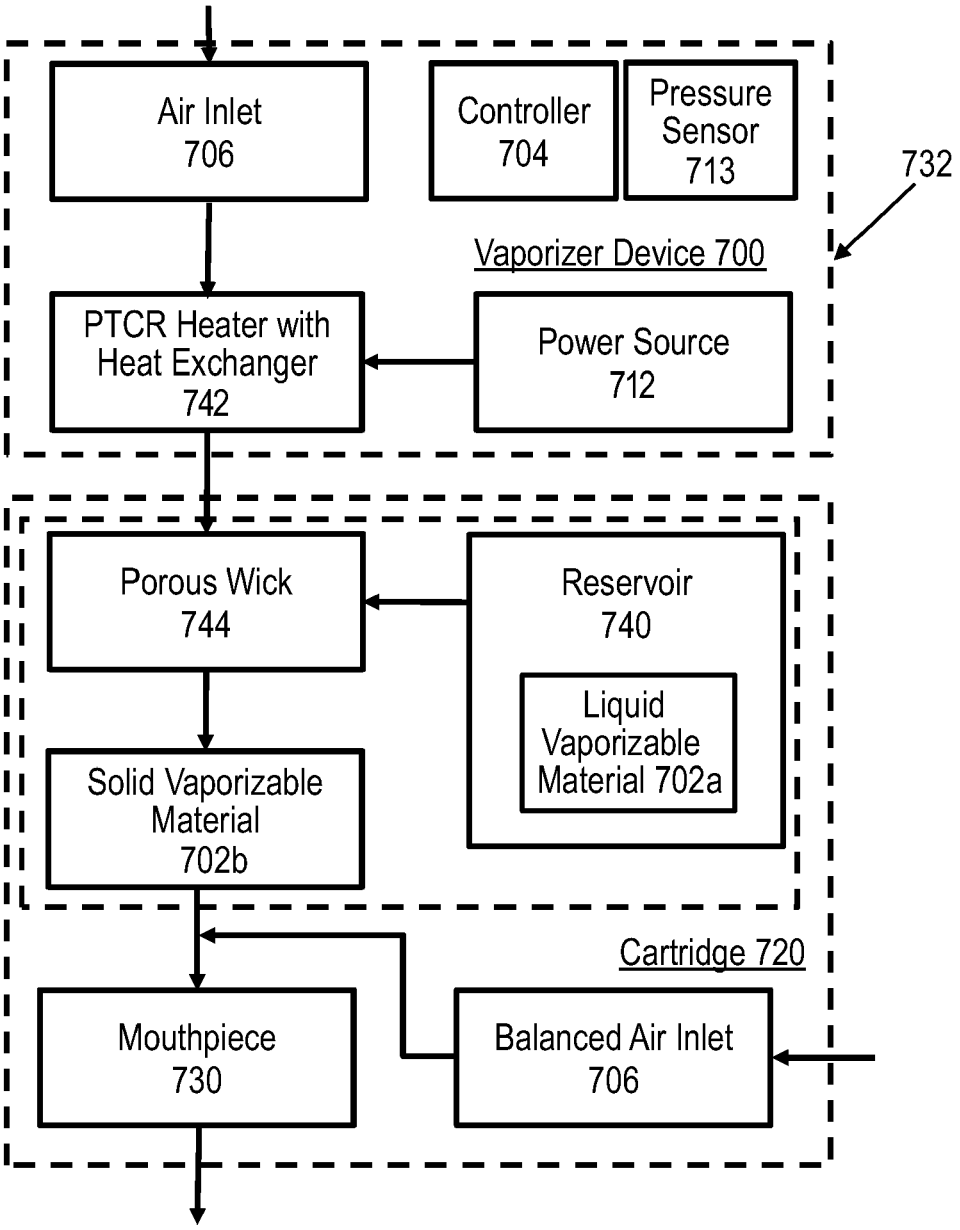
FIG. 11 is a block diagram of an example vaporizer device and cartridge with liquid vaporizable material and solid vaporizable material that can provide for uniform heating of vaporizable material utilizing convective heating.

In some implementations, the vaporizable material 702 can include both a liquid vaporizable material and a solid vaporizable material. For example, FIG. 11 illustrates a block diagram of an embodiment of a vaporizer device 700 and cartridge 720 with a liquid vaporizable material 702*a* and a solid vaporizable material 702*b* that can provide for uniform heating of the vaporizable material 702 utilizing convective heating. The cartridge 720 may include a fluid reservoir 740 containing the liquid vaporizable material 702*a* within the fluid reservoir 740, a porous wick 744 in fluidic communication with the liquid vaporizable material 702*a*, and a solid vaporizable material 702*b* located downstream (with respect to airflow) of the porous wick 744. The porous wick 744 is arranged to receive the heated air from the PTCR heater with heat exchanger 742 to produce vaporized vaporizable material in the form of a vapor and/or an aerosol. The solid vaporizable material 702*b* is arranged to receive the vaporized vaporizable material from the wick. The mouthpiece 730 is configured to receive the vaporized vaporizable material after the vaporized vaporizable material passes through the solid vaporizable material 702*b*. By combining both the liquid vaporizable material 702*a* and the solid vaporizable material 702*b*, improved flavoring can be achieved. In addition, by utilizing convective heating via the PTCR heater with heat exchanger 742 for vaporizing both the liquid vaporizable material 702*a* and the solid vaporizable material 702*b*, only a single heater is required to heat both materials.

Figure 12:
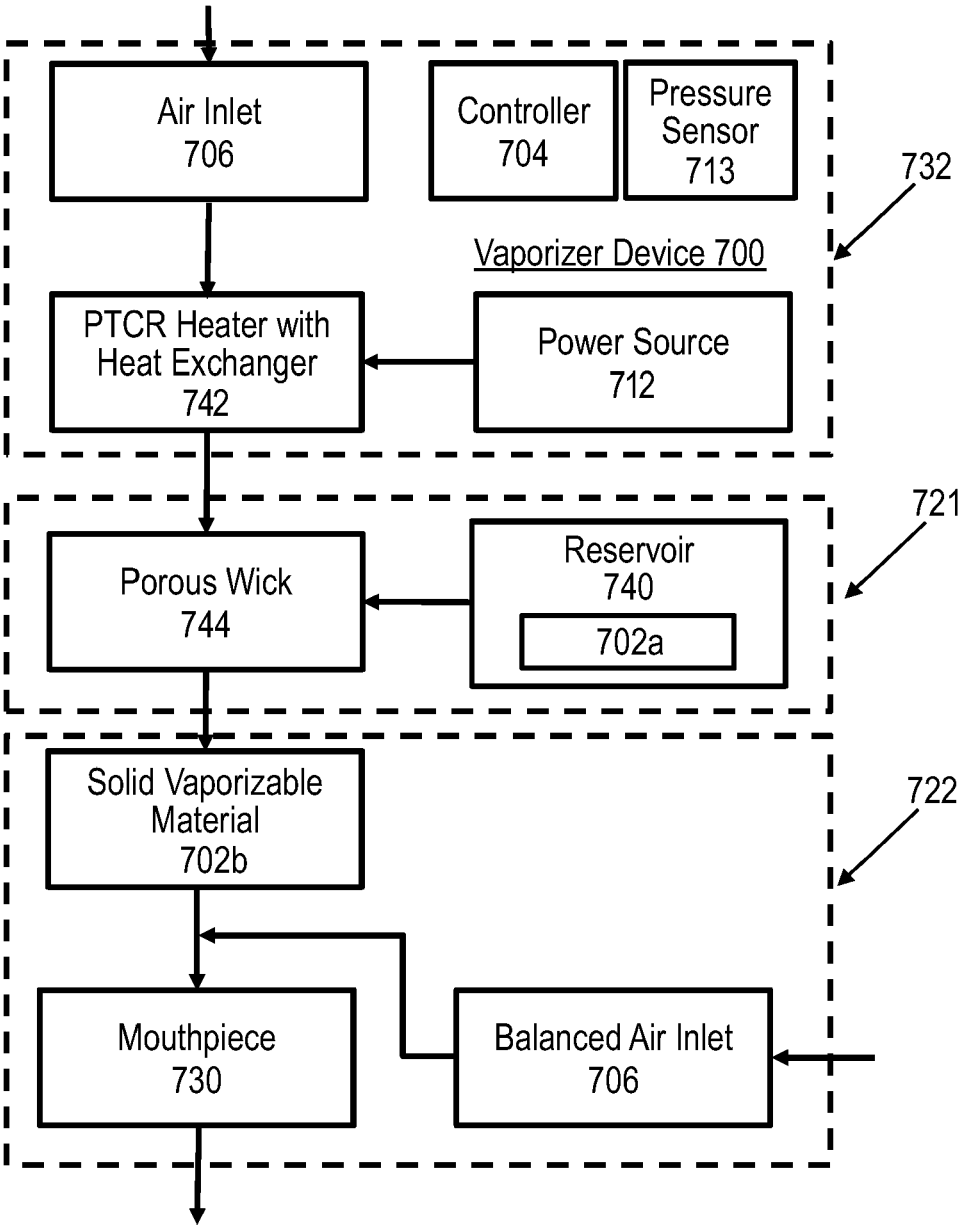
FIG. 12 is a block diagram of an example vaporizer device with multiple cartridges.
Figure 13:
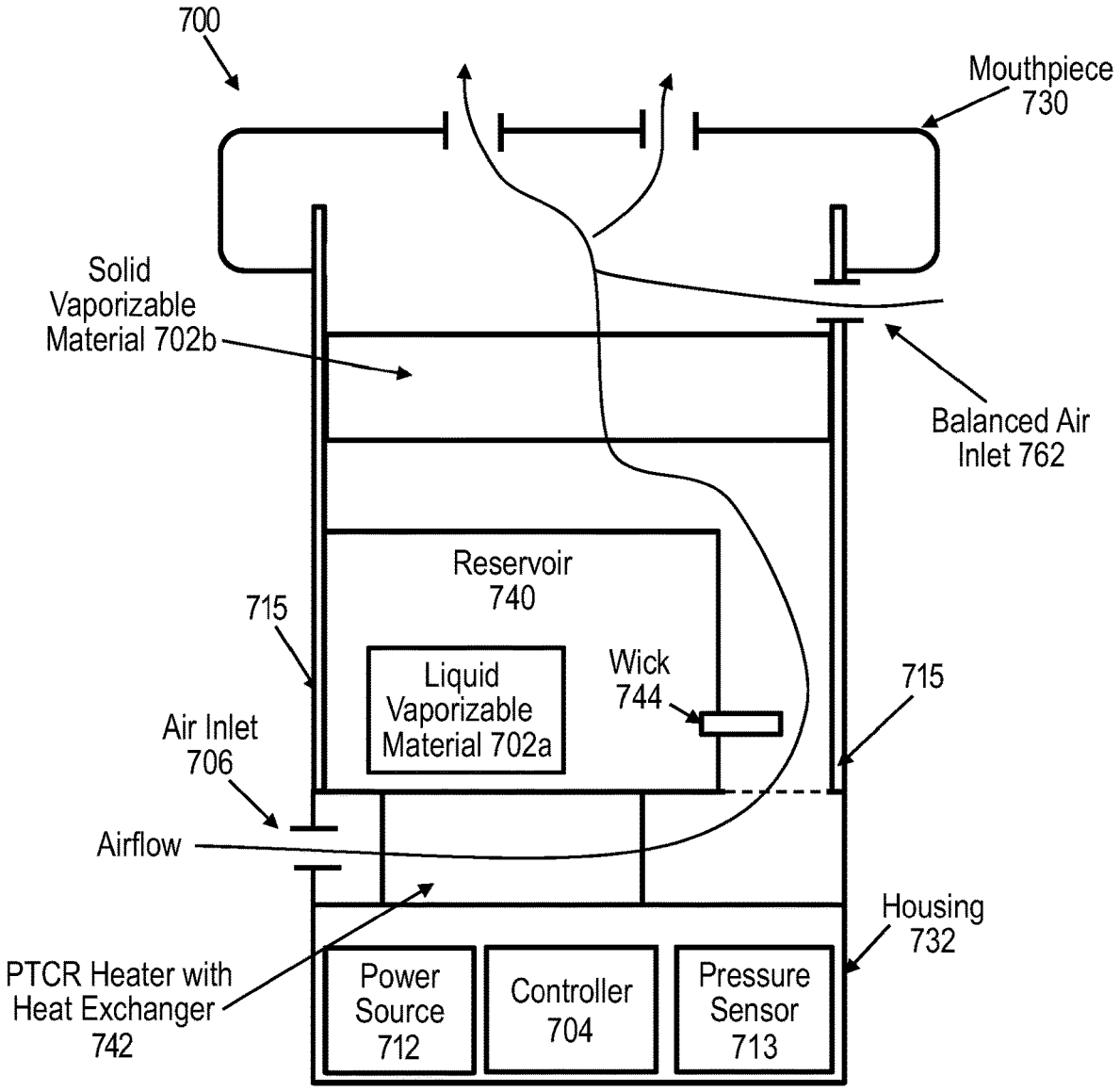
FIG. 13 is a cross-sectional view of an example vaporizer device with both liquid vaporizable material and solid vaporizable material.

In some implementations, the liquid vaporizable material 702*a* and the solid vaporizable material 702*b* can be included in different cartridges. For example, FIG. 12 illustrates a block diagram of an embodiment of a vaporizer device 700 with multiple cartridges. A first cartridge 721 includes the liquid vaporizable material 702*a* (including fluid reservoir 740 and porous wick 744) and a second cartridge 722 includes the solid vaporizable material 702*b* that can provide for uniform heating of the vaporizable material 702 utilizing convective heating. The first cartridge 721 can removably couple to the vaporizer device 700 and the second cartridge 722 can removably couple to the first cartridge 721. As illustrated, the first cartridge 721 includes the fluid reservoir 740 (e.g., tank), the liquid vaporizable material 702*a* within the fluid reservoir 740, and the porous wick 744 in fluidic communication with the liquid vaporizable material 702*a*. When the first cartridge 721 is coupled to the vaporizer device 700, the porous wick 744 is arranged to receive the heated air from the PTCR heater with heat exchanger 742 to produce vaporized vaporizable material in the form of a vapor and/or an aerosol. The second cartridge 722 includes the solid vaporizable material 702*b*, the balanced air inlet 762, and the mouthpiece 730. When the second cartridge 722 is coupled to the first cartridge 721, the solid vaporizable material 702*b* is arranged to receive the vaporized vaporizable material from the porous wick 744, and the mouthpiece 730 is configured to receive the vaporized vaporizable material after the vaporized vaporizable material passes through the solid vaporizable material 702*b*. In some implementations, the balanced air inlet 762 can provide ambient temperature air for cooling the heated air having passed through the solid vaporizable material 702*b*. FIG. 13 illustrates a cross-sectional view of another embodiment of a vaporizer device 700 with both of a liquid vaporizable material 702*a* and a solid vaporizable material 702*b*.

This convective heating approach can provide several advantages for vaporizing solid materials (e.g., HNB materials), as compared to conventional conductive heating approaches. For example, instead of poor conduction into insulative material (e.g., solid vaporizable material) in a direction normal to airflow, producing volatiles and differential porosity of the to-be-heated vaporizable material, some implementations of the current subject matter can provide incoming preheated air that enters the vaporizable material uniformly as a wave uniformly covering the cross-section of the vaporizable material. Volatiles are then released, coincident with increase in porosity, in a direction parallel to the flow of heated air. As another example, because of the cross-sectional uniform release of volatiles and coincident increase of porosity, the problem of differential flow path can be eliminated in some implementations. As yet another example, the problem of deteriorating conductive heat transfer through the product can be removed in some implementations of the current subject matter. As yet another example, some implementations of the current subject matter can eliminate a previously required preheating period, such that the current subject matter may provide aerosol on-demand from heated vaporizable material.

Similarly, this convective heating approach can provide several advantages for vaporizing liquid vaporizable materials. For example, instead of applying heat directly to the liquid vaporizable material using a heater element in direct contact with the liquid vaporizable material, some implementations of the current subject matter can provide incoming preheated air as a wave uniformly covering the cross-section of the porous wick saturated with the fluid to be vaporized, thereby avoiding differential temperatures and potential for heating element contamination.

As another example, by placing the wick in close proximity and upstream (with respect to the airflow) to the solid vaporizable material (e.g., loose-leaf tobacco), unwanted aerosol condensation within the device can be minimized.

In addition, intrinsic temperature control behavior of the PTCR heater with heat exchanger can simplify the electrical power delivery circuitry in that no specific thermal feedback is required. Electrical power delivery circuitry to PTCR heater with heat exchanger can be further simplified by eliminating the need, typical of electrical power delivery systems, for the power source to provide relatively constant voltage. In some implementations, applied voltage may vary by more than an order of magnitude without significantly affecting resulting heater element temperatures.

An example PTCR heater with heat exchanger will now be described in more detail. PTCR includes semiconducting materials that possess an electrical resistivity that changes nonlinearly with increasing temperature. Typical PTCR material resistivity is relatively low while temperature remains below a temperature transition zone. Above the temperature transition zone, the PTCR material resistivity is higher than the resistivity of the same PTCR material at temperatures below the temperature transition zone. The resistivity change can be orders of magnitude increase over a temperature transition zone of 50 degrees Celsius or less.

A heating element can utilize nonlinear PTCR material to enable intrinsic temperature control. For example, a heating element at an ambient temperature can be connected to a power source providing a voltage gradient and resulting current flow. Because the resistivity of the heating element is relatively low at ambient temperature (e.g., ambient temperature is below the transition zone), current will flow through the heating element. As current flows through the nonlinear PTCR material, heat is generated by resistance (e.g., dissipation of electrical power). The generated heat raises the temperature of the heating element, thereby causing the resistivity of the heating element to change. When the temperature of the heating element reaches the transition zone, the resistivity increases significantly over a small temperature range. The change in resistivity can be caused by the physical properties of the material. For example, a phase transition may occur in the material. Such an increase in resistivity (resulting in an overall increase in resistance) reduces current flow such that heat generation is reduced. The transition zone includes a temperature at which there is an inflection point such that heat generation will be insufficient to further raise the temperature of the heating element, thereby limiting the temperature of the heating element. So long as the power source remains connected and supplying current, the heating element will maintain a uniform temperature with minimal temperature variance. In this instance the applied power to the PTCR heating element can be represented by the equation $P_1$=Volts$^2$/Resistance. The heat loss of the PTCR heating element can be represented by $P_L$ and includes any combination of conductive, convective, radiative, and latent heat. During steady-state operation $P_1=P_L$. As $P_L$ increases, the temperature of the PTCR heating element drops thereby reducing the resistance thereby increasing the current flow through the PTCR heating element. As $P_L$ decreases, the temperature of the PTCR heating element increases thereby increasing the resistance thereby decreasing the current flow through the PTCR heating element. As $P_L$ approaches 0, the resistance of the PTCR heating element increase logarithmically. The operating temperature at which a PTCR heating element is limited can be affected by the element materials, element geometry, element resistivity as a function of temperature characteristics, power source, circuit characteristics (e.g., voltage gradient, current, time-variance properties), and the like.

Figure 14:
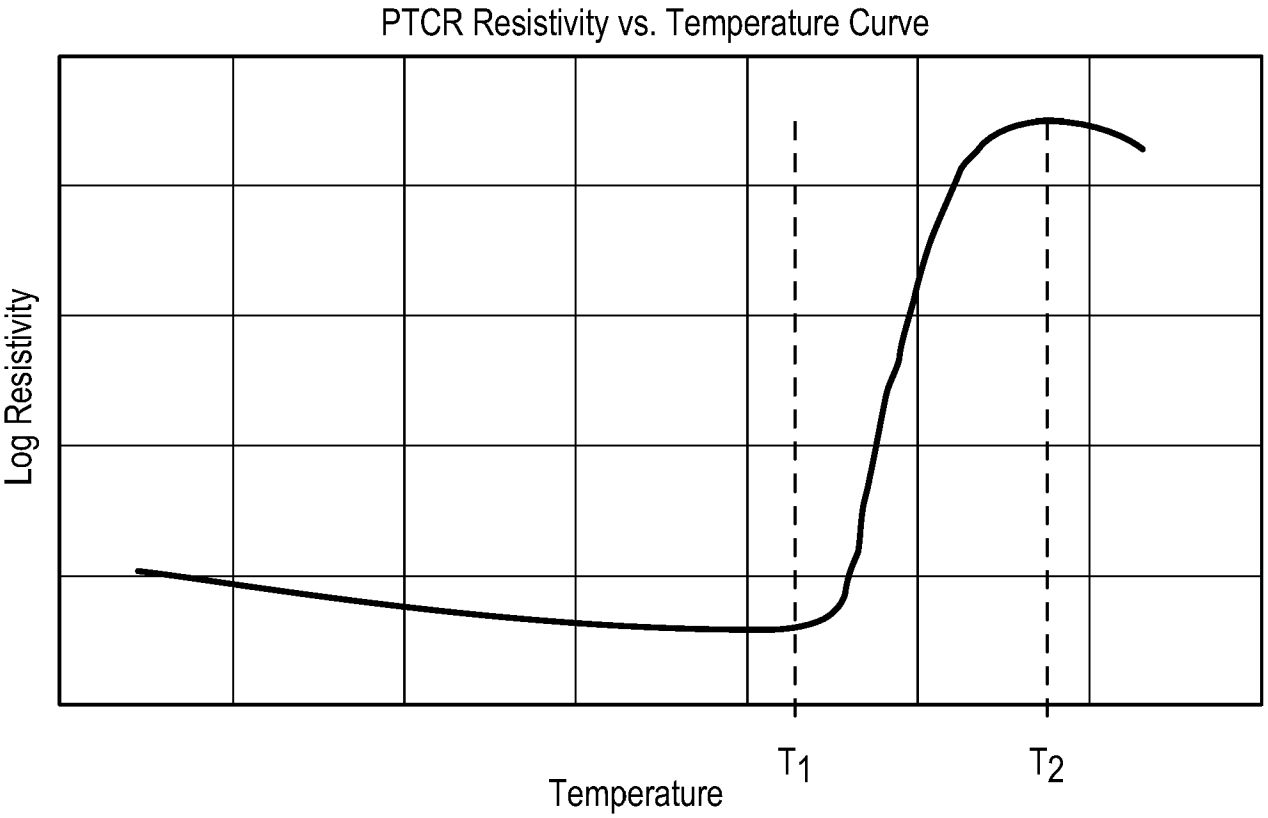
FIG. 14 graphically illustrates an example resistivity vs. temperature curve for a nonlinear positive temperature coefficient of resistivity (PTCR) material.

FIG. 14 is an example graphical illustration showing an example resistivity vs. temperature curve for a nonlinear PTCR material. The vertical axis is logarithmic. A heating element constructed (e.g., formed) of a nonlinear PTCR material (referred to as a PTCR heater) can include advantageous characteristics. For example, with application of sufficient voltage gradient (e.g., ΔV), a PTCR heater will generate heat and increase in temperature until the transition zone is reached. In the curve illustrated in FIG. 14, the transition zone spans between temperatures $T_1$ and $T_2$. In the curve illustrated in FIG. 14, the resistivity versus temperature curve appears nonlinear between $T_1$ and $T_2$, but in other embodiments, the resistivity versus temperature curve may be near linear or linear or other shapes. At some temperature above $T_1$ the resistivity of the nonlinear PTCR material will have increased to the point where further temperature increase will cease because the overall resistance will increase to a point such that current flow is limited. In other words, implementations of a PTCR heater can be considered to be temperature self-limiting and, given a known range of applied voltages, will not heat beyond a temperature just above the low point $T_1$ of the temperature transition zone.

Performance of a PTCR heater can depend on PTCR behavior as in FIG. 14 and on heater geometry. A PTCR heater having relatively long and narrow geometry and with electrical contacts for applying differential voltage at each end of the longer dimension of the PTCR heater can be ineffective in that resistivity of nonlinear PTCR materials is typically too high at temperatures below $T_1$. Nonlinear PTCR materials having steep transition zones where the temperature difference between $T_1$ and $T_2$ is less than 10° C. may cause all voltage drop to be within a small fraction of the length of said long and narrow geometry and given inevitable spatial nonuniformities within any material. Therefore, some implementations of a PTCR heater include an electrode construct for a PTCR heater such that a nonlinear PTCR material is provided within a parallel circuit. In some implementations that can provide improved uniformity in heating, the PTCR heater geometry can include a thin section of nonlinear PTCR material sandwiched between electrical conductors or electrically conductive coatings to which differential voltages may be applied.

FIG. 15 presents a table of resistivity vs. temperature curve data for the nonlinear PTCR semiconducting material illustrated in FIG. 14. In some implementations, the PTCR heating element has a resistivity of between 10 ohm-cm and 100 ohm-cm at 100° C. and a resistivity of between 50000 ohm-cm and 150000 ohm-cm at 260° C. In some implementations, the PTCR heating element has a resistivity of between 20 ohm-cm and 200 ohm-cm at 100° C. and a resistivity of between 100000 ohm-cm and 200000 ohm-cm at 265° C. In some implementations, the PTCR heating element has a resistivity of less than 100 ohm-cm at 100° C. and a resistivity greater than 100000 ohm-cm at 260° C. In some implementations, the PTCR heating element has a resistivity of less than 100 ohm-cm at 100° C. and a resistivity greater than 250000 ohm-cm at 275° C. In some implementations, the PTCR heating element has a resistivity of less than 100 ohm-cm at 100° C. and a resistivity greater than 300000 ohm-cm at 295° C. In some implementations, the PTCR heating element has a resistivity of between 10 ohm-cm and 110 ohm-cm at 25° C. and a resistivity of between 10 ohm-cm and 110 ohm-cm at 100° C. and a resistivity of between 100000 ohm-cm and 325000 ohm-cm at 280° C. In some implementations, the PTCR heating element has a resistivity of between 10 ohm-cm and 150 ohm-cm at 25° C. and a resistivity of between 10 ohm-cm and 150 ohm-cm at 100° C. and a resistivity of between 100000 ohm-cm and 350000 ohm-cm at 280° C. In some implementations, the PTCR heating element has a resistivity of between 10 ohm-cm and 200 ohm-cm at 25° C. and a resistivity of between 10 ohm-cm and 200 ohm-cm at 100° C. and a resistivity of between 100000 ohm-cm and 375000 ohm-cm at 280° C. In some implementations, the PTCR heating element has a resistivity of between 10 ohm-cm and 300 ohm-cm at 25° C. and a resistivity of between 10 ohm-cm and 300 ohm-cm at 100° C. and a resistivity of between 100000 ohm-cm and 400000 ohm-cm at 280° C. In some implementations, the PTCR heating element has a resistivity of between 10 ohm-cm and 400 ohm-cm at 25° C. and a resistivity of between 10 ohm-cm and 400 ohm-cm at 100° C. and a resistivity of between 100000 ohm-cm and 450000 ohm-cm at 280° C. In some implementations, the PTCR heating element has a resistivity of between 10 ohm-cm and 500 ohm-cm at 25° C. and a resistivity of between 10 ohm-cm and 500 ohm-cm at 100° C. and a resistivity of between 100000 ohm-cm and 500000 ohm-cm at 280° C. In some implementations, the PTCR heating element has a resistivity of between 50 ohm-cm and 110 ohm-cm at 25° C. and a resistivity of between 50 ohm-cm and 110 ohm-cm at 100° C. and a resistivity of between 150000 ohm-cm and 325000 ohm-cm at 280° C. In some implementations, the PTCR heating element has a resistivity of between 50 ohm-cm and 150 ohm-cm at 25° C. and a resistivity of between 50 ohm-cm and 150 ohm-cm at 100° C. and a resistivity of between 150000 ohm-cm and 350000 ohm-cm at 280° C. In some implementations, the PTCR heating element has a resistivity of between 50 ohm-cm and 200 ohm-cm at 25° C. and a resistivity of between 50 ohm-cm and 200 ohm-cm at 100° C. and a resistivity of between 150000 ohm-cm and 375000 ohm-cm at 280° C. In some implementations, the PTCR heating element has a resistivity of between 50 ohm-cm and 300 ohm-cm at 25° C. and a resistivity of between 50 ohm-cm and 300 ohm-cm at 100° C. and a resistivity of between 150000 ohm-cm and 400000 ohm-cm at 280° C. In some implementations, the PTCR heating element has a resistivity of between 50 ohm-cm and 400 ohm-cm at 25° C. and a resistivity of between 50 ohm-cm and 400 ohm-cm at 100° C. and a resistivity of between 150000 ohm-cm and 450000 ohm-cm at 280° C. In some implementations, the PTCR heating element has a resistivity of between 50 ohm-cm and 500 ohm-cm at 25° C. and a resistivity of between 50 ohm-cm and 500 ohm-cm at 100° C. and a resistivity of between 150000 ohm-cm and 500000 ohm-cm at 280° C. In some implementations, the PTCR heating element has a resistivity of between 90 ohm-cm and 110 ohm-cm at 25° C. and a resistivity of between 90 ohm-cm and 110 ohm-cm at 100° C. and a resistivity of between 200000 ohm-cm and 325000 ohm-cm at 280° C. In some implementations, the PTCR heating element has a resistivity of between 90 ohm-cm and 150 ohm-cm at 25° C. and a resistivity of between 90 ohm-cm and 150 ohm-cm at 100° C. and a resistivity of between 200000 ohm-cm and 350000 ohm-cm at 280° C. In some implementations, the PTCR heating element has a resistivity of between 90 ohm-cm and 200 ohm-cm at 25° C. and a resistivity of between 90 ohm-cm and 200 ohm-cm at 100° C. and a resistivity of between 200000 ohm-cm and 375000 ohm-cm at 280° C. In some implementations, the PTCR heating element has a resistivity of between 90 ohm-cm and 300 ohm-cm at 25° C. and a resistivity of between 90 ohm-cm and 300 ohm-cm at 100° C. and a resistivity of between 200000 ohm-cm and 400000 ohm-cm at 280° C. In some implementations, the PTCR heating element has a resistivity of between 90 ohm-cm and 400 ohm-cm at 25° C. and a resistivity of between 90 ohm-cm and 400 ohm-cm at 100° C. and a resistivity of between 200000 ohm-cm and 450000 ohm-cm at 280° C. In some implementations, the PTCR heating element has a resistivity of between 90 ohm-cm and 500 ohm-cm at 25° C. and a resistivity of between 90 ohm-cm and 500 ohm-cm at 100° C. and a resistivity of between 200000 ohm-cm and 500000 ohm-cm at 280° C. In some implementations, the PTCR heating element has a resistivity of between 10 ohm-cm and 110 ohm-cm at 50° C. and a resistivity of between 10 ohm-cm and 50 ohm-cm at 150° C. and a resistivity of between 50000 ohm-cm and 125000 ohm-cm at 260° C. In some implementations, the PTCR heating element has a resistivity of between 10 ohm-cm and 150 ohm-cm at 50° C. and a resistivity of between 10 ohm-cm and 100 ohm-cm at 150° C. and a resistivity of between 50000 ohm-cm and 150000 ohm-cm at 260° C. In some implementations, the PTCR heating element has a resistivity of between 10 ohm-cm and 200 ohm-cm at 50° C. and a resistivity of between 10 ohm-cm and 150 ohm-cm at 150° C. and a resistivity of between 50000 ohm-cm and 175000 ohm-cm at 260° C. In some implementations, the PTCR heating element has a resistivity of between 10 ohm-cm and 300 ohm-cm at 50° C. and a resistivity of between 10 ohm-cm and 200 ohm-cm at 150° C. and a resistivity of between 50000 ohm-cm and 200000 ohm-cm at 260° C. In some implementations, the PTCR heating element has a resistivity of between 10 ohm-cm and 400 ohm-cm at 50° C. and a resistivity of between 10 ohm-cm and 250 ohm-cm at 150° C. and a resistivity of between 50000 ohm-cm and 250000 ohm-cm at 260° C. In some implementations, the PTCR heating element has a resistivity of between 10 ohm-cm and 500 ohm-cm at 50° C. and a resistivity of between 10 ohm-cm and 300 ohm-cm at 150° C. and a resistivity of between 50000 ohm-cm and 300000 ohm-cm at 260° C. In some implementations, the PTCR heating element has a resistivity of between 50 ohm-cm and 110 ohm-cm at 50° C. and a resistivity of between 20 ohm-cm and 50 ohm-cm at 150° C. and a resistivity of between 75000 ohm-cm and 125000 ohm-cm at 260° C. In some implementations, the PTCR heating element has a resistivity of between 50 ohm-cm and 150 ohm-cm at 50° C. and a resistivity of between 20 ohm-cm and 100 ohm-cm at 150° C. and a resistivity of between 75000 ohm-cm and 150000 ohm-cm at 260° C. In some implementations, the PTCR heating element has a resistivity of between 50 ohm-cm and 200 ohm-cm at 50° C. and a resistivity of between 20 ohm-cm and 150 ohm-cm at 150° C. and a resistivity of between 75000 ohm-cm and 175000 ohm-cm at 260° C. In some implementations, the PTCR heating element has a resistivity of between 50 ohm-cm and 300 ohm-cm at 50° C. and a resistivity of between 20 ohm-cm and 200 ohm-cm at 150° C. and a resistivity of between 75000 ohm-cm and 200000 ohm-cm at 260° C. In some implementations, the PTCR heating element has a resistivity of between 50 ohm-cm and 400 ohm-cm at 50° C. and a resistivity of between 20 ohm-cm and 250 ohm-cm at 150° C. and a resistivity of between 75000 ohm-cm and 250000 ohm-cm at 260° C. In some implementations, the PTCR heating element has a resistivity of between 50 ohm-cm and 500 ohm-cm at 50° C. and a resistivity of between 20 ohm-cm and 300 ohm-cm at 150° C. and a resistivity of between 75000 ohm-cm and 300000 ohm-cm at 260° C. In some implementations, the PTCR heating element has a resistivity of between 75 ohm-cm and 110 ohm-cm at 50° C. and a resistivity of between 30 ohm-cm and 50 ohm-cm at 150° C. and a resistivity of between 100000 ohm-cm and 125000 ohm-cm at 260° C. In some implementations, the PTCR heating element has a resistivity of between 75 ohm-cm and 150 ohm-cm at 50° C. and a resistivity of between 30 ohm-cm and 100 ohm-cm at 150° C. and a resistivity of between 100000 ohm-cm and 150000 ohm-cm at 260° C. In some implementations, the PTCR heating element has a resistivity of between 75 ohm-cm and 200 ohm-cm at 50° C. and a resistivity of between 30 ohm-cm and 150 ohm-cm at 150° C. and a resistivity of between 100000 ohm-cm and 175000 ohm-cm at 260° C. In some implementations, the PTCR heating element has a resistivity of between 75 ohm-cm and 300 ohm-cm at 50° C. and a resistivity of between 30 ohm-cm and 200 ohm-cm at 150° C. and a resistivity of between 100000 ohm-cm and 200000 ohm-cm at 260° C. In some implementations, the PTCR heating element has a resistivity of between 75 ohm-cm and 400 ohm-cm at 50° C. and a resistivity of between 30 ohm-cm and 250 ohm-cm at 150° C. and a resistivity of between 100000 ohm-cm and 250000 ohm-cm at 260° C. In some implementations, the PTCR heating element has a resistivity of between 75 ohm-cm and 500 ohm-cm at 50° C. and a resistivity of between 30 ohm-cm and 300 ohm-cm at 150° C. and a resistivity of between 100000 ohm-cm and 300000 ohm-cm at 260° C. In some implementations, the PTCR heating element has a resistivity of between 10 ohm-cm and 110 ohm-cm at 25° C. and a resistivity of between 10 ohm-cm and 50 ohm-cm at 150° C. and a resistivity of between 100000 ohm-cm and 325000 ohm-cm at 280° C. In some implementations, the PTCR heating element has a resistivity of between 10 ohm-cm and 150 ohm-cm at 25° C. and a resistivity of between 10 ohm-cm and 100 ohm-cm at 150° C. and a resistivity of between 100000 ohm-cm and 350000 ohm-cm at 280° C. In some implementations, the PTCR heating element has a resistivity of between 10 ohm-cm and 200 ohm-cm at 25° C. and a resistivity of between 10 ohm-cm and 150 ohm-cm at 150° C. and a resistivity of between 100000 ohm-cm and 375000 ohm-cm at 280° C. In some implementations, the PTCR heating element has a resistivity of between 10 ohm-cm and 300 ohm-cm at 25° C. and a resistivity of between 10 ohm-cm and 200 ohm-cm at 150° C. and a resistivity of between 100000 ohm-cm and 400000 ohm-cm at 280° C. In some implementations, the PTCR heating element has a resistivity of between 10 ohm-cm and 400 ohm-cm at 25° C. and a resistivity of between 10 ohm-cm and 250 ohm-cm at 150° C. and a resistivity of between 100000 ohm-cm and 450000 ohm-cm at 280° C. In some implementations, the PTCR heating element has a resistivity of between 10 ohm-cm and 500 ohm-cm at 25° C. and a resistivity of between 10 ohm-cm and 300 ohm-cm at 150° C. and a resistivity of between 100000 ohm-cm and 500000 ohm-cm at 280° C. In some implementations, the PTCR heating element has a resistivity of between 50 ohm-cm and 110 ohm-cm at 25° C. and a resistivity of between 20 ohm-cm and 50 ohm-cm at 150° C. and a resistivity of between 150000 ohm-cm and 325000 ohm-cm at 280° C. In some implementations, the PTCR heating element has a resistivity of between 50 ohm-cm and 150 ohm-cm at 25° C. and a resistivity of between 20 ohm-cm and 100 ohm-cm at 150° C. and a resistivity of between 150000 ohm-cm and 350000 ohm-cm at 280° C. In some implementations, the PTCR heating element has a resistivity of between 50 ohm-cm and 200 ohm-cm at 25° C. and a resistivity of between 20 ohm-cm and 150 ohm-cm at 150° C. and a resistivity of between 150000 ohm-cm and 375000 ohm-cm at 280° C. In some implementations, the PTCR heating element has a resistivity of between 50 ohm-cm and 300 ohm-cm at 25° C. and a resistivity of between 20 ohm-cm and 200 ohm-cm at 150° C. and a resistivity of between 150000 ohm-cm and 400000 ohm-cm at 280° C. In some implementations, the PTCR heating element has a resistivity of between 50 ohm-cm and 400 ohm-cm at 25° C. and a resistivity of between 20 ohm-cm and 250 ohm-cm at 150° C. and a resistivity of between 150000 ohm-cm and 450000 ohm-cm at 280° C. In some implementations, the PTCR heating element has a resistivity of between 50 ohm-cm and 500 ohm-cm at 25° C. and a resistivity of between 20 ohm-cm and 300 ohm-cm at 150° C. and a resistivity of between 150000 ohm-cm and 500000 ohm-cm at 280° C. In some implementations, the PTCR heating element has a resistivity of between 90 ohm-cm and 110 ohm-cm at 25° C. and a resistivity of between 30 ohm-cm and 50 ohm-cm at 150° C. and a resistivity of between 200000 ohm-cm and 325000 ohm-cm at 280° C. In some implementations, the PTCR heating element has a resistivity of between 90 ohm-cm and 150 ohm-cm at 25° C. and a resistivity of between 30 ohm-cm and 100 ohm-cm at 150° C. and a resistivity of between 200000 ohm-cm and 350000 ohm-cm at 280° C. In some implementations, the PTCR heating element has a resistivity of between 90 ohm-cm and 200 ohm-cm at 25° C. and a resistivity of between 30 ohm-cm and 150 ohm-cm at 150° C. and a resistivity of between 200000 ohm-cm and 375000 ohm-cm at 280° C. In some implementations, the PTCR heating element has a resistivity of between 90 ohm-cm and 300 ohm-cm at 25° C. and a resistivity of between 30 ohm-cm and 200 ohm-cm at 150° C. and a resistivity of between 200000 ohm-cm and 400000 ohm-cm at 280° C. In some implementations, the PTCR heating element has a resistivity of between 90 ohm-cm and 400 ohm-cm at 25° C. and a resistivity of between 30 ohm-cm and 250 ohm-cm at 150° C. and a resistivity of between 200000 ohm-cm and 450000 ohm-cm at 280° C. In some implementations, the PTCR heating element has a resistivity of between 90 ohm-cm and 500 ohm-cm at 25° C. and a resistivity of between 30 ohm-cm and 300 ohm-cm at 150° C. and a resistivity of between 200000 ohm-cm and 500000 ohm-cm at 280° C. In some implementations, the PTCR heating element has a resistivity of between 10 ohm-cm and 110 ohm-cm at 50° C. and a resistivity of between 10 ohm-cm and 110 ohm-cm at 100° C. and a resistivity of between 50000 ohm-cm and 125000 ohm-cm at 260° C. In some implementations, the PTCR heating element has a resistivity of between 10 ohm-cm and 150 ohm-cm at 50° C. and a resistivity of between 10 ohm-cm and 150 ohm-cm at 100° C. and a resistivity of between 50000 ohm-cm and 150000 ohm-cm at 260° C. In some implementations, the PTCR heating element has a resistivity of between 10 ohm-cm and 200 ohm-cm at 50° C. and a resistivity of between 10 ohm-cm and 200 ohm-cm at 100° C. and a resistivity of between 50000 ohm-cm and 175000 ohm-cm at 260° C. In some implementations, the PTCR heating element has a resistivity of between 10 ohm-cm and 300 ohm-cm at 50° C. and a resistivity of between 10 ohm-cm and 300 ohm-cm at 100° C. and a resistivity of between 50000 ohm-cm and 200000 ohm-cm at 260° C. In some implementations, the PTCR heating element has a resistivity of between 10 ohm-cm and 400 ohm-cm at 50° C. and a resistivity of between 10 ohm-cm and 400 ohm-cm at 100° C. and a resistivity of between 50000 ohm-cm and 250000 ohm-cm at 260° C. In some implementations, the PTCR heating element has a resistivity of between 10 ohm-cm and 500 ohm-cm at 50° C. and a resistivity of between 10 ohm-cm and 500 ohm-cm at 100° C. and a resistivity of between 50000 ohm-cm and 300000 ohm-cm at 260° C. In some implementations, the PTCR heating element has a resistivity of between 50 ohm-cm and 110 ohm-cm at 50° C. and a resistivity of between 50 ohm-cm and 110 ohm-cm at 100° C. and a resistivity of between 75000 ohm-cm and 125000 ohm-cm at 260° C. In some implementations, the PTCR heating element has a resistivity of between 50 ohm-cm and 150 ohm-cm at 50° C. and a resistivity of between 50 ohm-cm and 150 ohm-cm at 100° C. and a resistivity of between 75000 ohm-cm and 150000 ohm-cm at 260° C. In some implementations, the PTCR heating element has a resistivity of between 50 ohm-cm and 200 ohm-cm at 50° C. and a resistivity of between 50 ohm-cm and 200 ohm-cm at 100° C. and a resistivity of between 75000 ohm-cm and 175000 ohm-cm at 260° C. In some implementations, the PTCR heating element has a resistivity of between 50 ohm-cm and 300 ohm-cm at 50° C. and a resistivity of between 50 ohm-cm and 300 ohm-cm at 100° C. and a resistivity of between 75000 ohm-cm and 200000 ohm-cm at 260° C. In some implementations, the PTCR heating element has a resistivity of between 50 ohm-cm and 400 ohm-cm at 50° C. and a resistivity of between 50 ohm-cm and 400 ohm-cm at 100° C. and a resistivity of between 75000 ohm-cm and 250000 ohm-cm at 260° C. In some implementations, the PTCR heating element has a resistivity of between 50 ohm-cm and 500 ohm-cm at 50° C. and a resistivity of between 50 ohm-cm and 500 ohm-cm at 100° C. and a resistivity of between 75000 ohm-cm and 300000 ohm-cm at 260° C. In some implementations, the PTCR heating element has a resistivity of between 75 ohm-cm and 110 ohm-cm at 50° C. and a resistivity of between 90 ohm-cm and 110 ohm-cm at 100° C. and a resistivity of between 100000 ohm-cm and 125000 ohm-cm at 260° C. In some implementations, the PTCR heating element has a resistivity of between 75 ohm-cm and 150 ohm-cm at 50° C. and a resistivity of between 90 ohm-cm and 150 ohm-cm at 100° C. and a resistivity of between 100000 ohm-cm and 150000 ohm-cm at 260° C. In some implementations, the PTCR heating element has a resistivity of between 75 ohm-cm and 200 ohm-cm at 50° C. and a resistivity of between 90 ohm-cm and 200 ohm-cm at 100° C. and a resistivity of between 100000 ohm-cm and 175000 ohm-cm at 260° C. In some implementations, the PTCR heating element has a resistivity of between 75 ohm-cm and 300 ohm-cm at 50° C. and a resistivity of between 90 ohm-cm and 300 ohm-cm at 100° C. and a resistivity of between 100000 ohm-cm and 200000 ohm-cm at 260° C. In some implementations, the PTCR heating element has a resistivity of between 75 ohm-cm and 400 ohm-cm at 50° C. and a resistivity of between 90 ohm-cm and 400 ohm-cm at 100° C. and a resistivity of between 100000 ohm-cm and 250000 ohm-cm at 260° C. In some implementations, the PTCR heating element has a resistivity of between 75 ohm-cm and 500 ohm-cm at 50° C. and a resistivity of between 90 ohm-cm and 500 ohm-cm at 100° C. and a resistivity of between 100000 ohm-cm and 300000 ohm-cm at 260° C.

Figure 16:
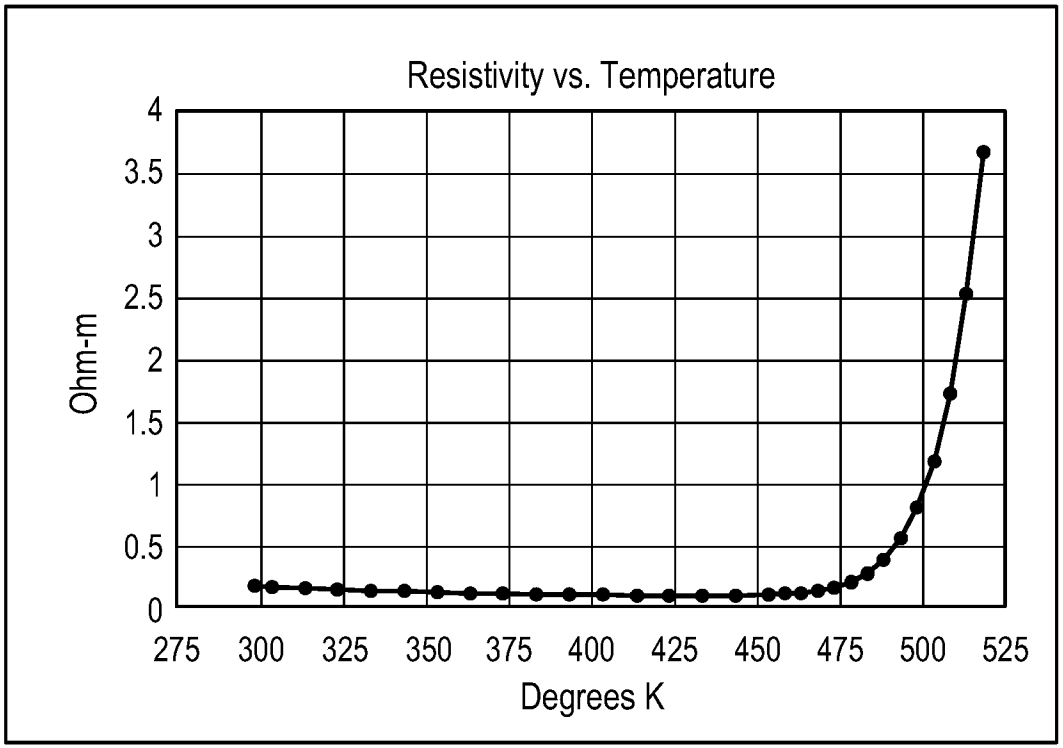
FIG. 16 graphically illustrates an example resistivity vs. temperature curve for a nonlinear positive temperature coefficient of resistivity (PTCR) material.

FIG. 16 illustrates another example PTCR resistivity versus temperature curve. In this example, the PTCR material has a density of 5700 kg/m3, a heat capacity of 520 J/kg K, and a thermal conductivity of 2.1 W/m K. The coefficient of resistivity begins to initially increase at a temperature after about 440 K and then sharply increases between 503 K and 518 K. At 298 K, the resistivity of the PTCR material forming the PTCR heating element is 0.168 ohm-m, and at 373 K the resistivity of the PTCR material forming the PTCR heating element is 0.105 ohm-m, and at 518 K the resistivity of the PTCR material forming the PTCR heating element is 3.669 ohm-m. In some example implementations, the PTCR material has a density between 5000 kg/m3 and 7000 kg/m3, a heat capacity between 450 J/kg K and 600 J/kg K, and a thermal conductivity between 1.5 W/m K and 3.0 W/m K.

Figure 17A:
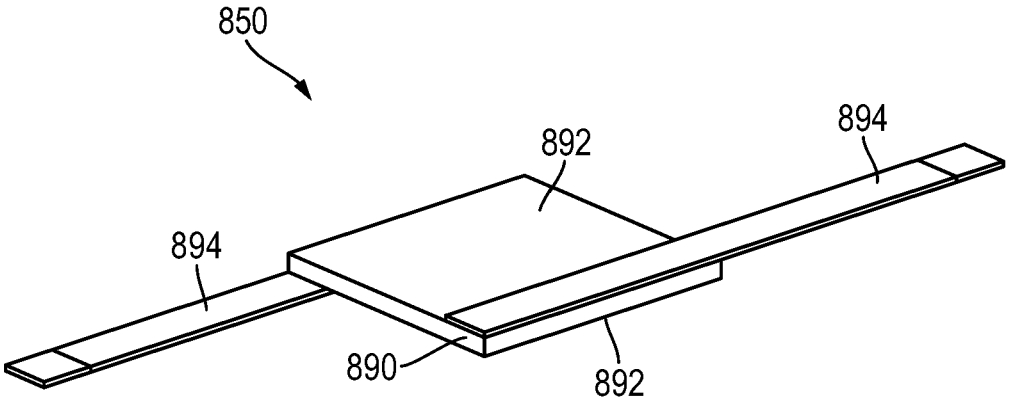
FIG. 17A illustrates an embodiment of a PTCR heating element that can enable improved vaporizer heating.
Figure 17B:
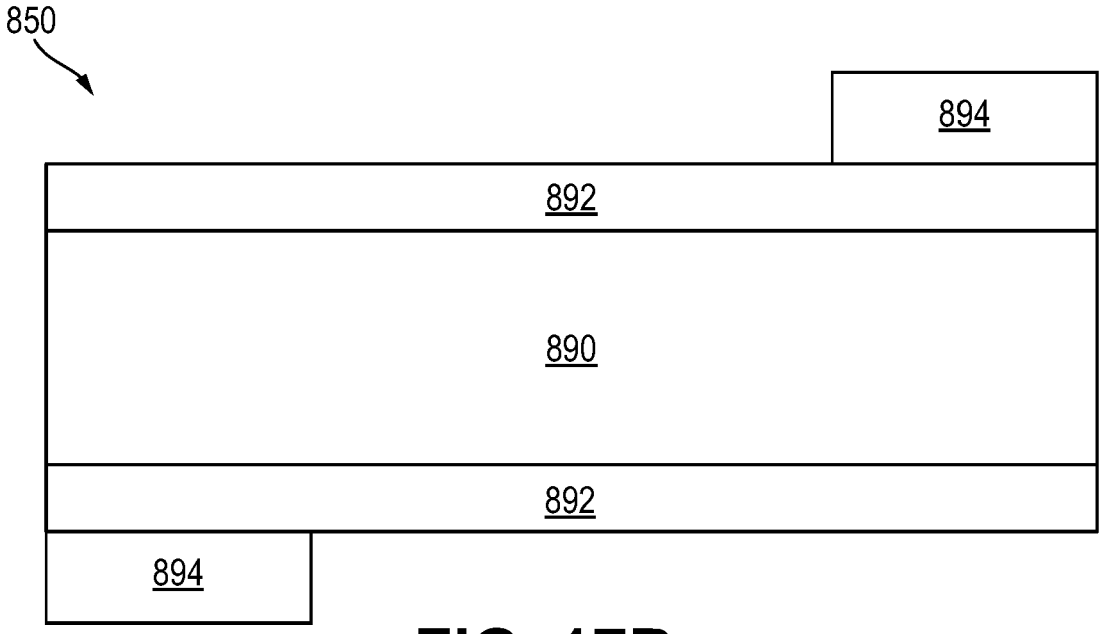
FIG. 17B illustrates a cross-sectional view of the PTCR heating element FIG. 17A.
Figure 18A:
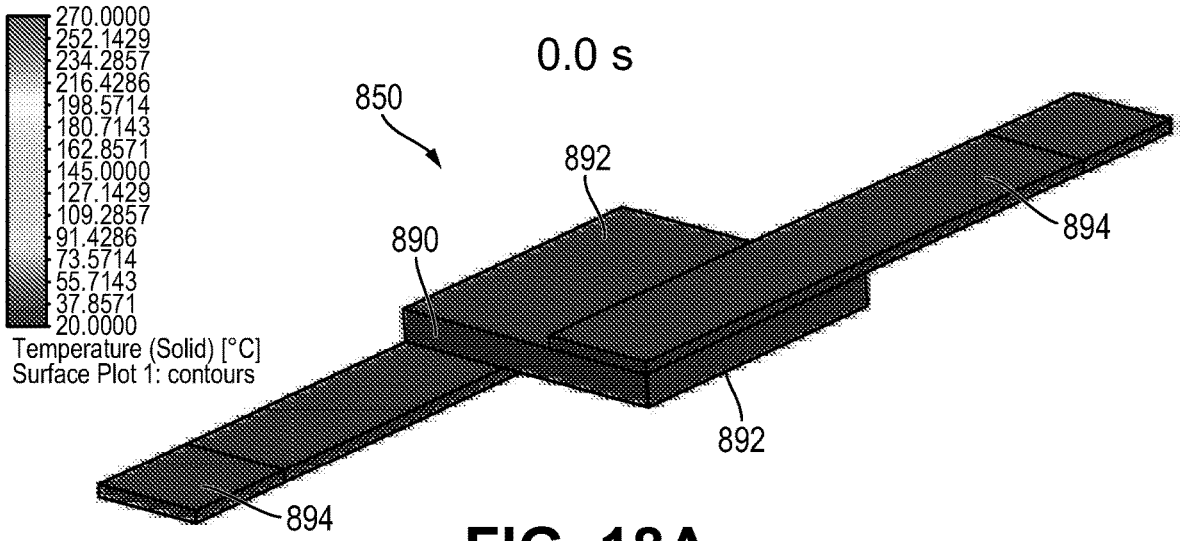
FIG. 18A-FIG. 18E illustrate modeled temperatures of an example PTCR heating element.
Figure 18B:
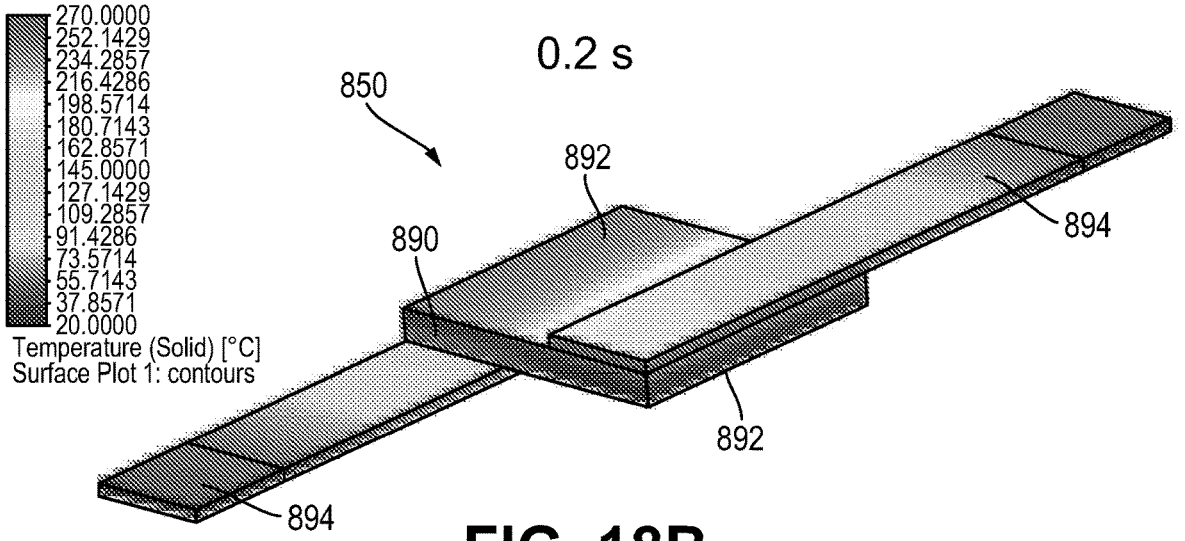
Figure 18C:
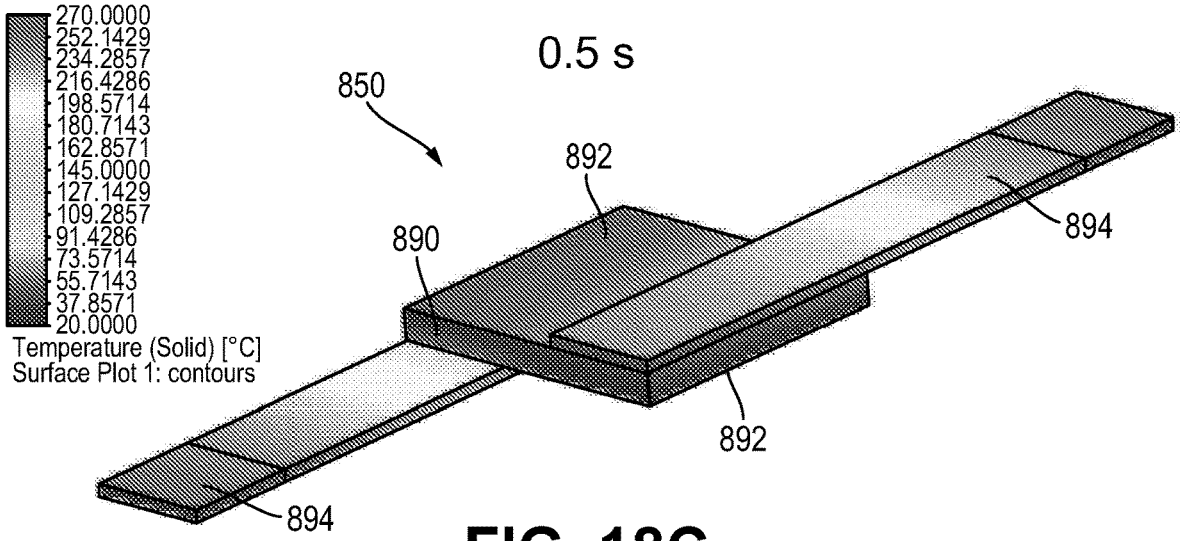
Figure 18D:
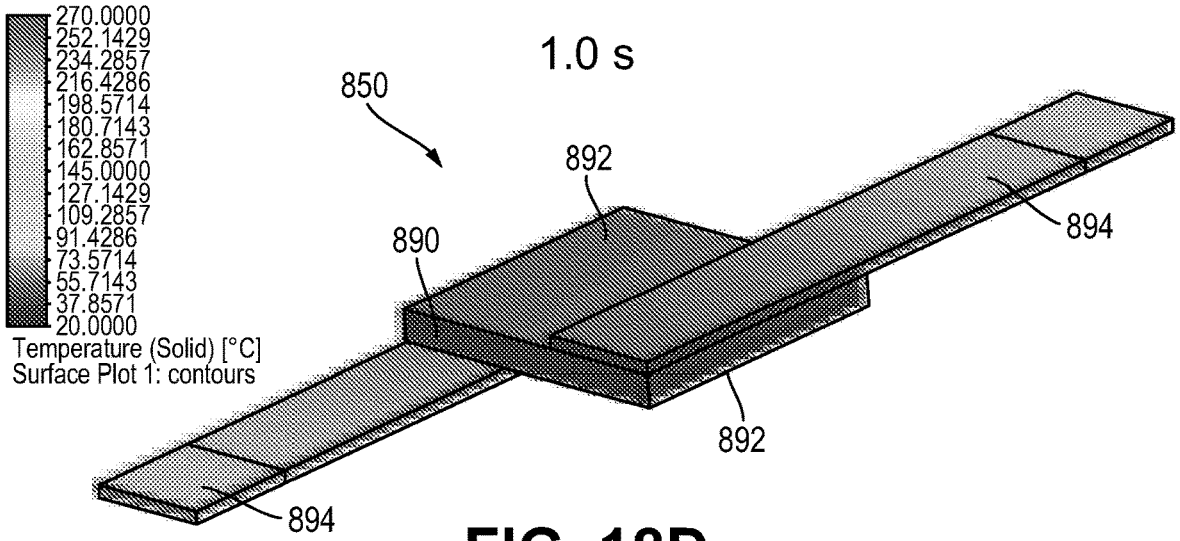
Figure 18E:
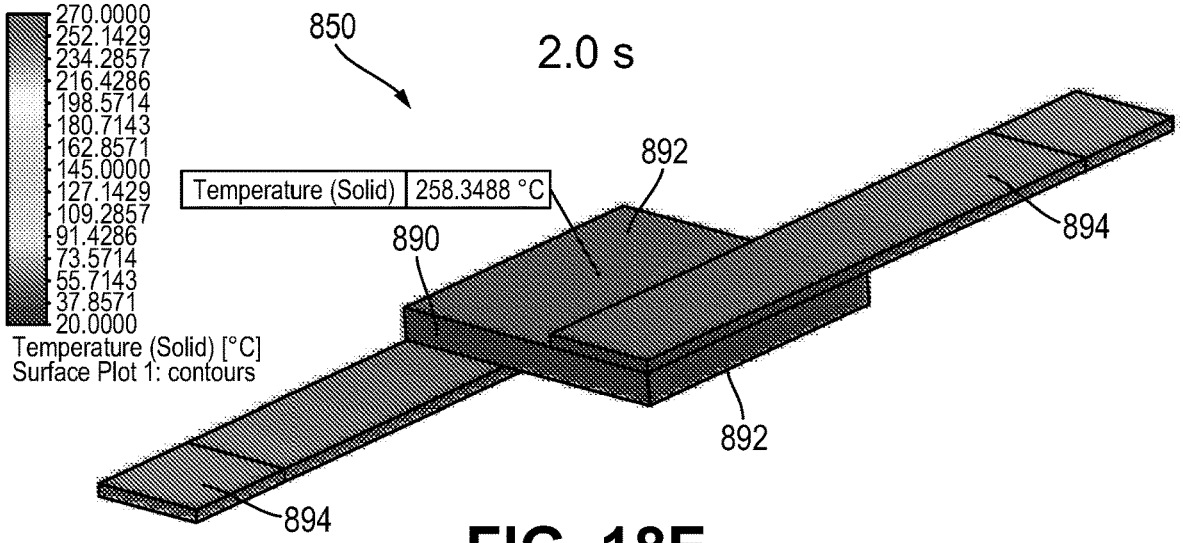

FIG. 17A illustrates an example PTCR heating element 850 that can enable improved vaporizer heating. A thin section of nonlinear PTCR material 890 is shown in FIG. 17A, where nonlinear PTCR material 890 is sandwiched between electrically conductive layers 892, which in turn are attached to conductive leads 894 such that conductive leads 894 may have differential voltage applied. FIG. 17B illustrates a cross-sectional view of the PTCR heating element 850 of FIG. 17A.

In some example implementations, which can be effective in a vaporizer device using, for example, a fluid combination including propylene glycol and glycerol, a PTCR heating element 850 includes the geometry illustrated in FIG. 17A with nonlinear PTCR material thickness of 0.5 mm (height) and 5.0 mm (length and width) in the other dimensions. The nonlinear PTCR material electrical characteristics includes these values: $T_1$ value between 150° C. and 300° C., such as between 220° C. and 280° C.; resistivity at temperatures below $T_1$ between 0.01 Ohm-m and 100 Ohm-m, such as between 0.1 Ohm-m and 1 Ohm-m; resistivity change between $T_1$ and $T_2$ having an increase of a factor exceeding 10 such as exceeding 100; and temperature difference between $T_1$ and $T_2$ less than 200° C. such as less than 50° C.

Figure 31:
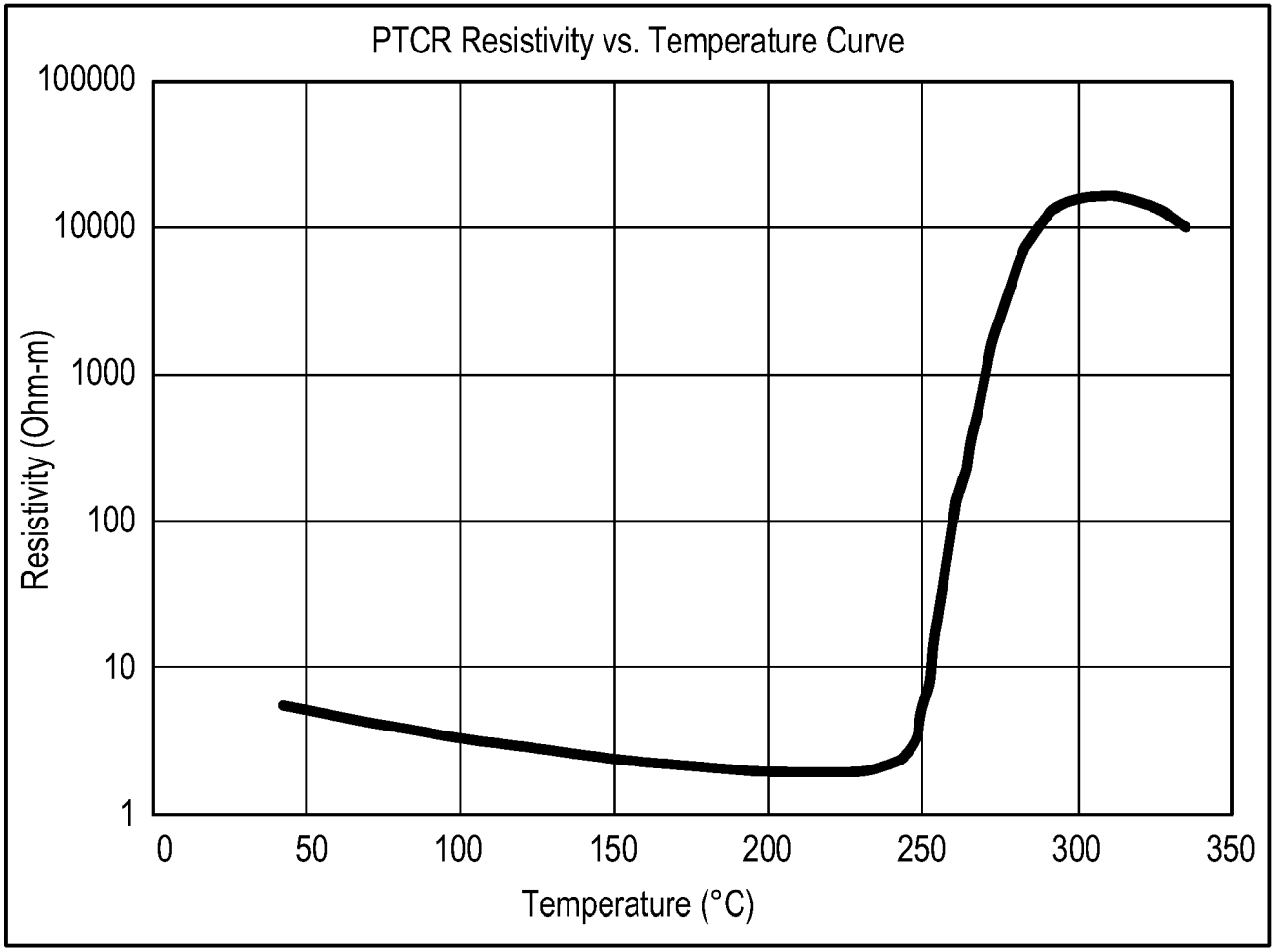
FIG. 31 illustrates an example graphical illustration showing a logarithm of resistivity of a cylindrical vaporization device with PTCR heater as a function of temperature.

FIG. 18A-FIG. 18E illustrate modeled temperatures of an embodiment of the PTCR heating element 850. In the illustrated example, the nonlinear PTCR material 890 includes a plate geometry with dimensions of 5 mm×5 mm×0.5 mm; the conductive layers 892 may be formed of silver (Ag) with dimensions of 5 mm×5 mm×0.025 mm; and the conductive leads 894 may be formed of copper (CU) with dimensions of 12 mm×2 mm×0.2 mm. The nonlinear PTCR material 890 may include a PTCR resistivity versus temperature curve as illustrated in FIG. 31, with a nonlinear transition zone of about 240° C. to about 300° C. A voltage of 3 to 6 volts was applied across the conductive leads 894 of the example PTCR heating element 850. Under these circumstances, the example PTCR heating element 850 in open air with free convective airflow will increase in temperature as shown in the modeled sequence of FIG. 18A-FIG. 18E, which illustrate respectively 0.0, 0.2, 0.5, 1.0, and 2.0 seconds after application of the voltage differential. As illustrated, the temperature beyond 1.0 second is relatively uniform and the peak temperatures at the surface of conductive layers 892 is less than 270° C.

FIG. 19A-FIG. 19F illustrate modeled temperatures of another example of a PTCR heating element 850. A gradient temperature scale is shown on the left side of each figure with red representing the hottest temperature of about 255° C. and continues through the colors of the visible light spectrum in order (e.g., red, orange, yellow, green, blue, and violet) to the coolest temperature of about 23° C. In each of the illustrated examples, the nonlinear PTCR material 890 includes a plate geometry with dimensions of about 5 mm×5 mm×0.5 mm; the conductive layers 892 were formed of silver (Ag) with dimensions of about 5 mm×5 mm×0.025 mm; and the conductive leads 894 were formed of copper (CU) with dimensions of about 12 mm×2 mm×0.2 mm. The plate geometry can include two parallel sides including conductive layers 892 with conductive leads 894 attached thereto. The conductive leads 894 are centrally attached to conductive layers 892 on each side of the PTCR heating element 850 with a connection 896. In some implementations, the connection 896 is a clamp, a clip, a conductive paste, a high-temperature, lead-free solder, and/or combinations thereof.

Figure 19A:
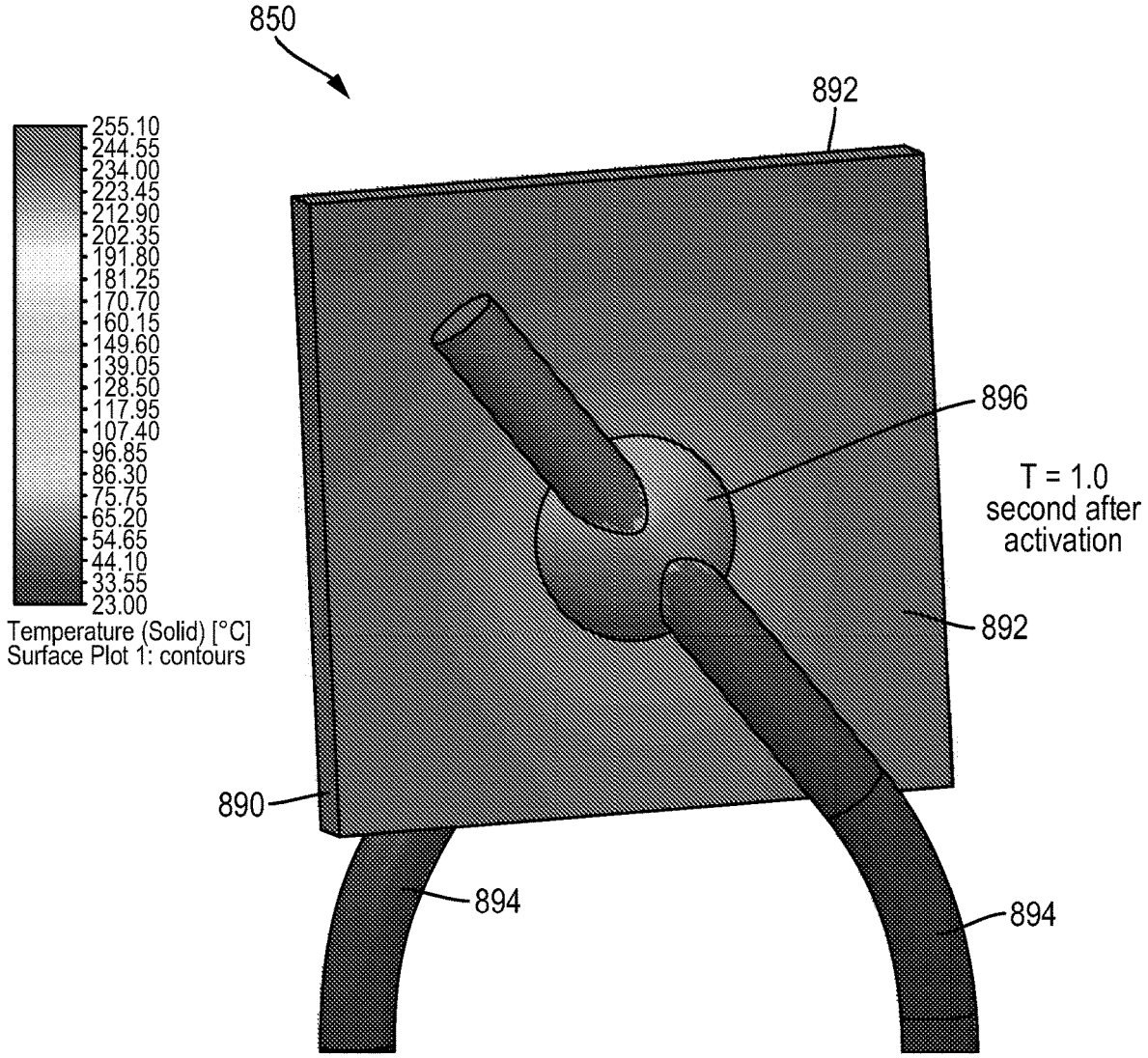
FIG. 19A-FIG. 19F illustrate modeled temperatures of an example PTCR heating element.

FIG. 19A illustrates the temperature 1.0 second after activation by applying a current to the PTCR heating element 850. The conductive leads 894 (e.g., violet colored) are still about 25° C. The majority of the nonlinear PTCR material 890 and conductive layers 892 has increased in temperature to about 120° C., with the area including connection 896 in the center being slightly cooler at a temperature around 80° C.

Figure 19B:
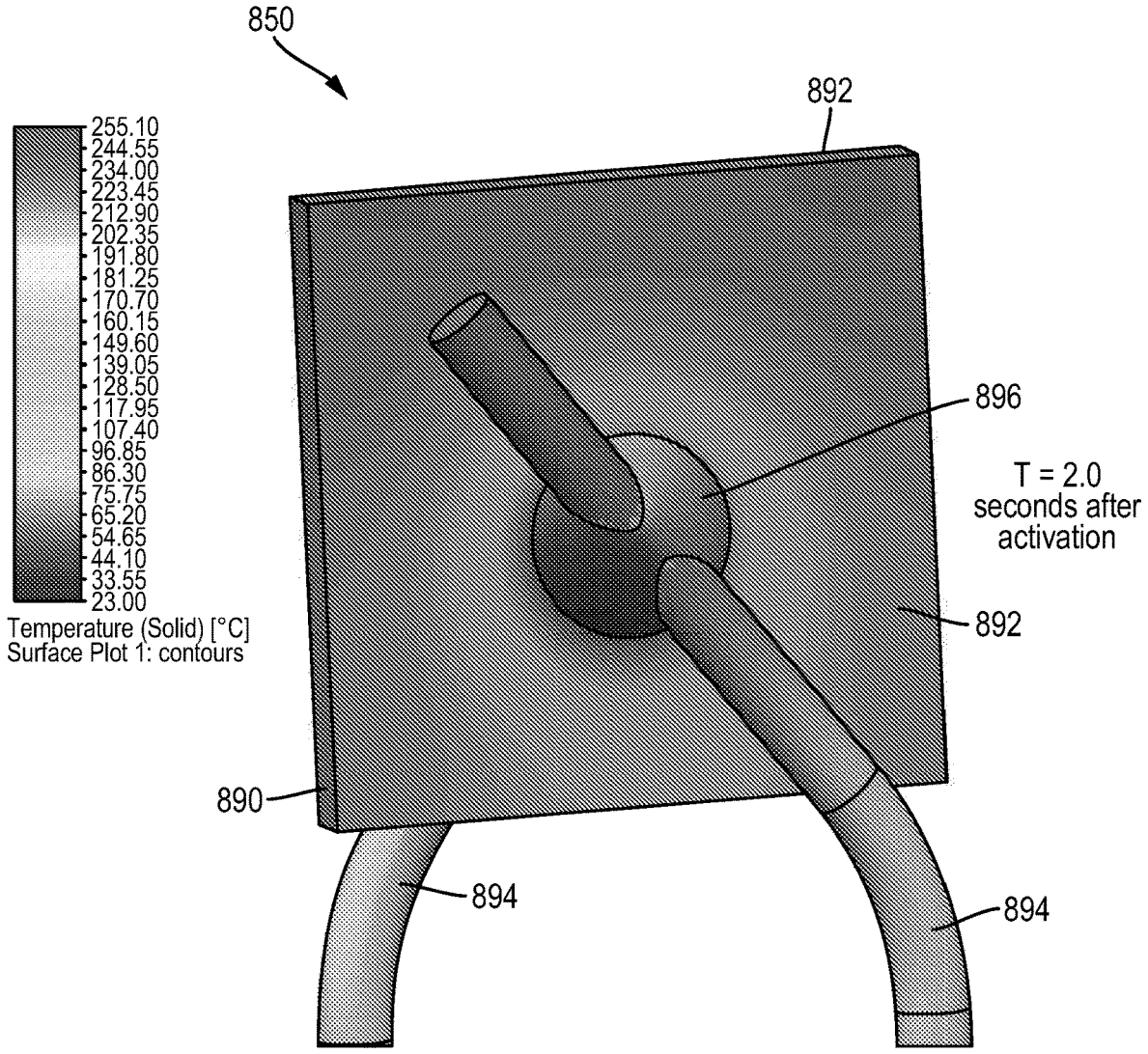

FIG. 19B illustrates the temperature 2.0 seconds after activation by applying a current to the PTCR heating element 850. The conductive leads 894 (e.g., blue/green colored) have increased in temperature to about 90° C. The majority of the nonlinear PTCR material 890 and conductive layers 892 has increased in temperature to about 210° C., with the area including connection 896 in the center being cooler at a temperature around 160° C.

Figure 19C:
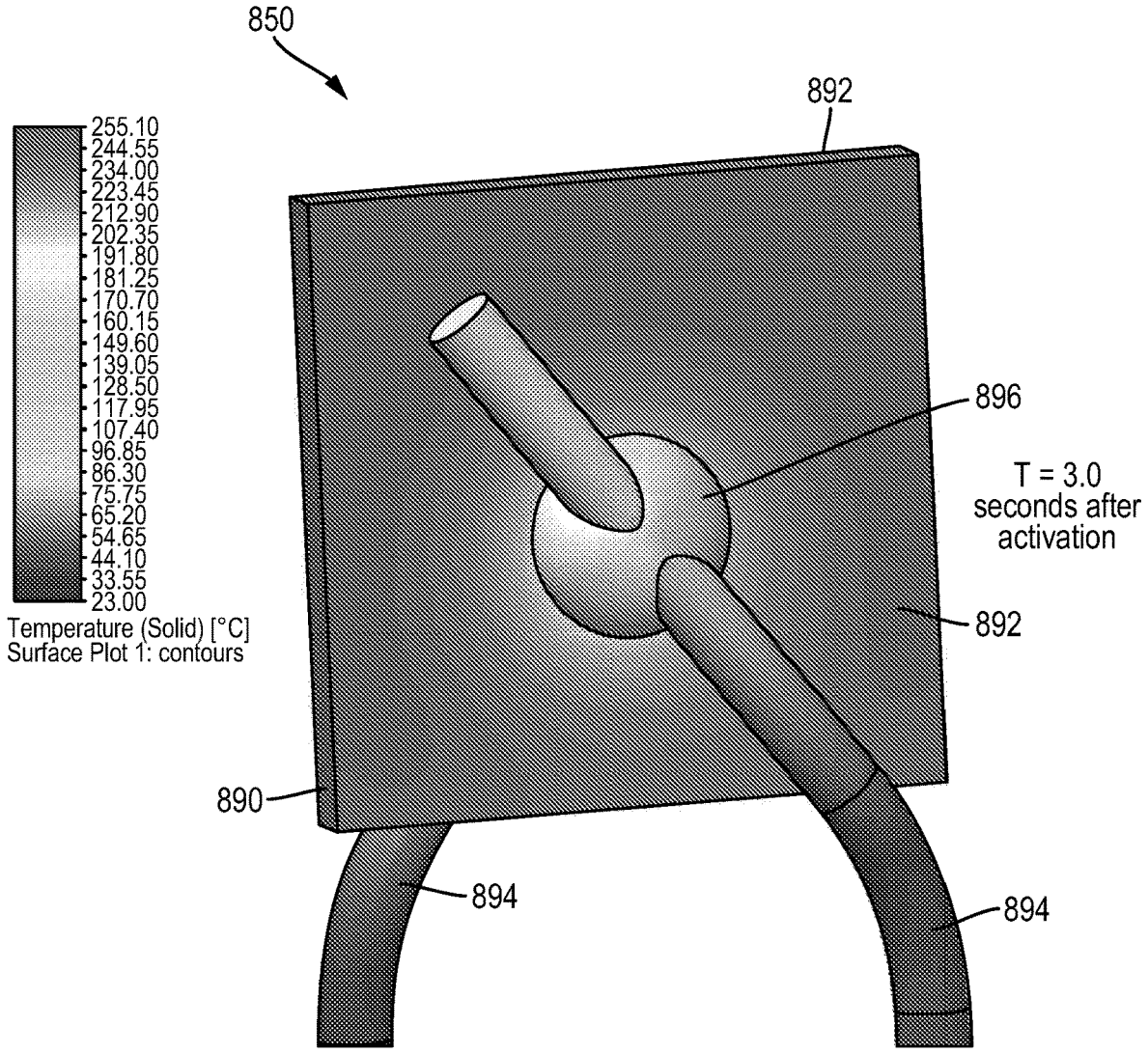

FIG. 19C illustrates the temperature 3.0 seconds after activation by applying a current to the PTCR heating element 850. The conductive leads 894 (e.g., green colored) have increased in temperature to about 140° C. The majority of the nonlinear PTCR material 890 and conductive layers 892 has increased in temperature to about 250° C., with the area including connection 896 in the center being cooler at a temperature around 200° C.

Figure 19D:
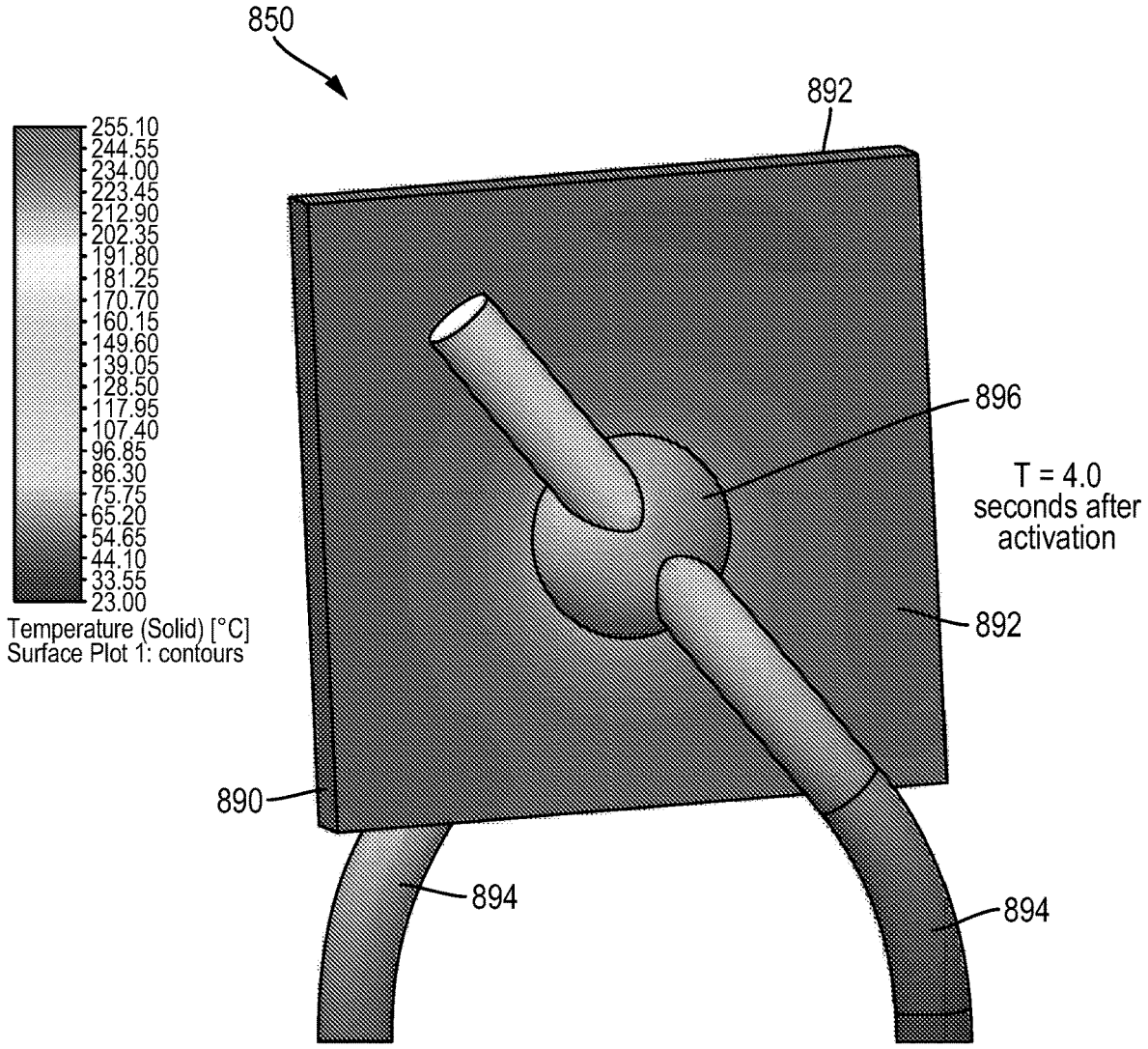

FIG. 19D illustrates the temperature 4.0 seconds after activation by applying a current to the PTCR heating element 850. The conductive leads 894 (e.g., green colored) have increased in temperature to about 160° C. The majority of the nonlinear PTCR material 890 and conductive layers 892 remains at temperature to about 250° C., with the area including connection 896 in the center being cooler at a temperature around 215° C.

Figure 19E:
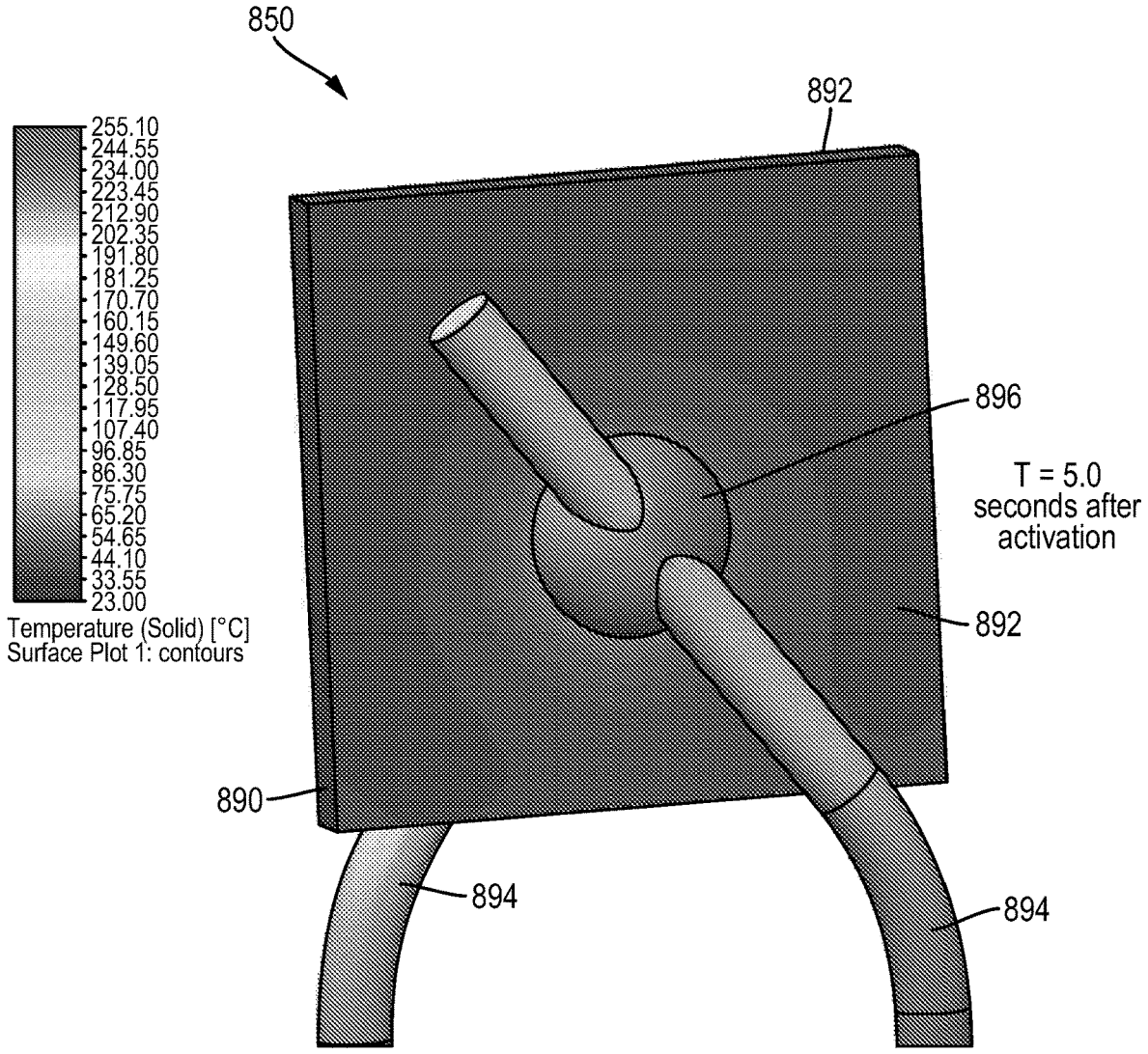

FIG. 19E illustrates the temperature 5.0 seconds after activation by applying a current to the PTCR heating element 850. The conductive leads 894 (e.g., green/yellow colored) have increased in temperature to about 180° C. The majority of the nonlinear PTCR material 890 and conductive layers 892 remains at temperature to about 250° C., with the area including connection 896 in the center being slightly cooler at a temperature around 225° C.

Figure 19F:
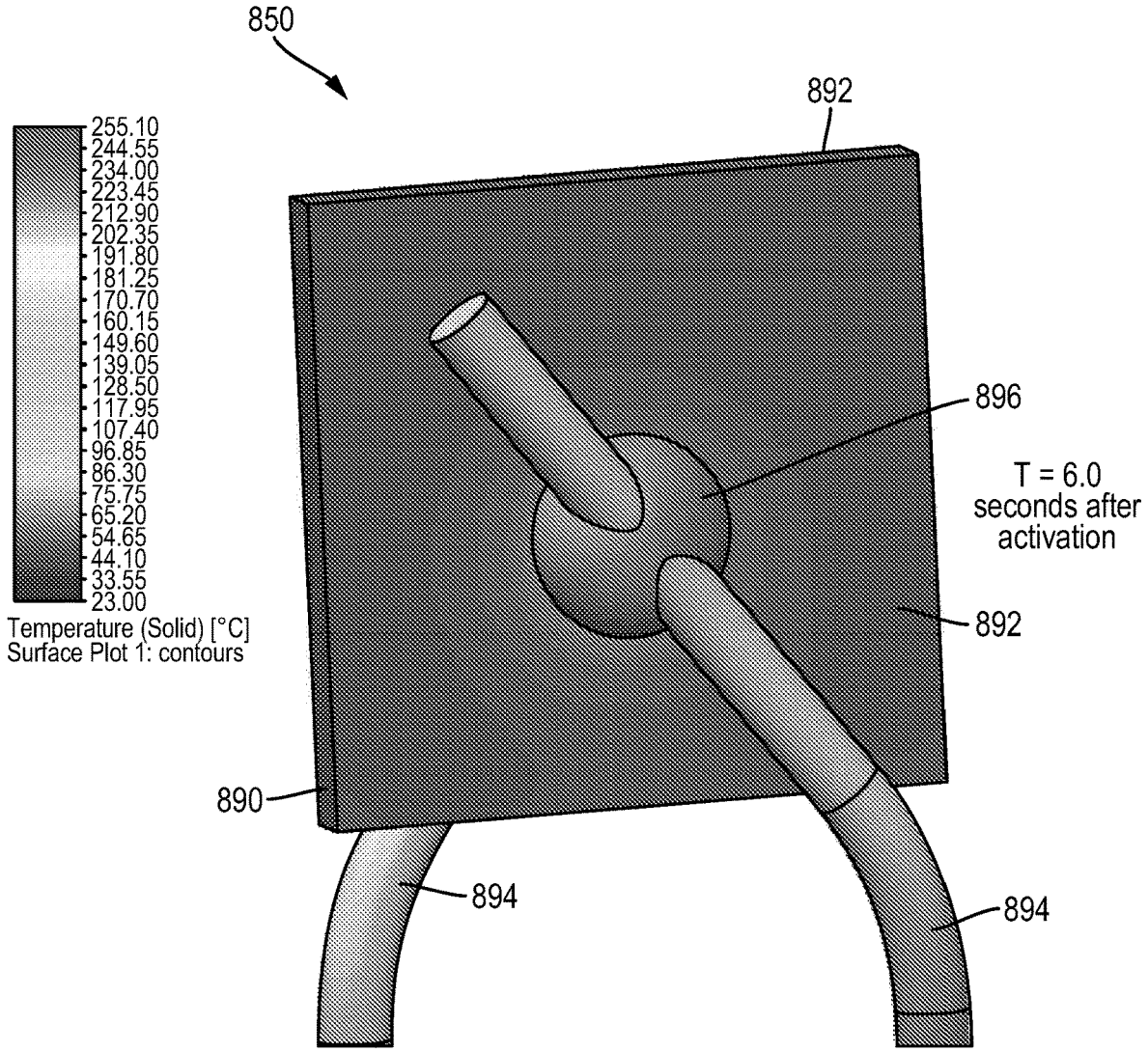
Figure 20:
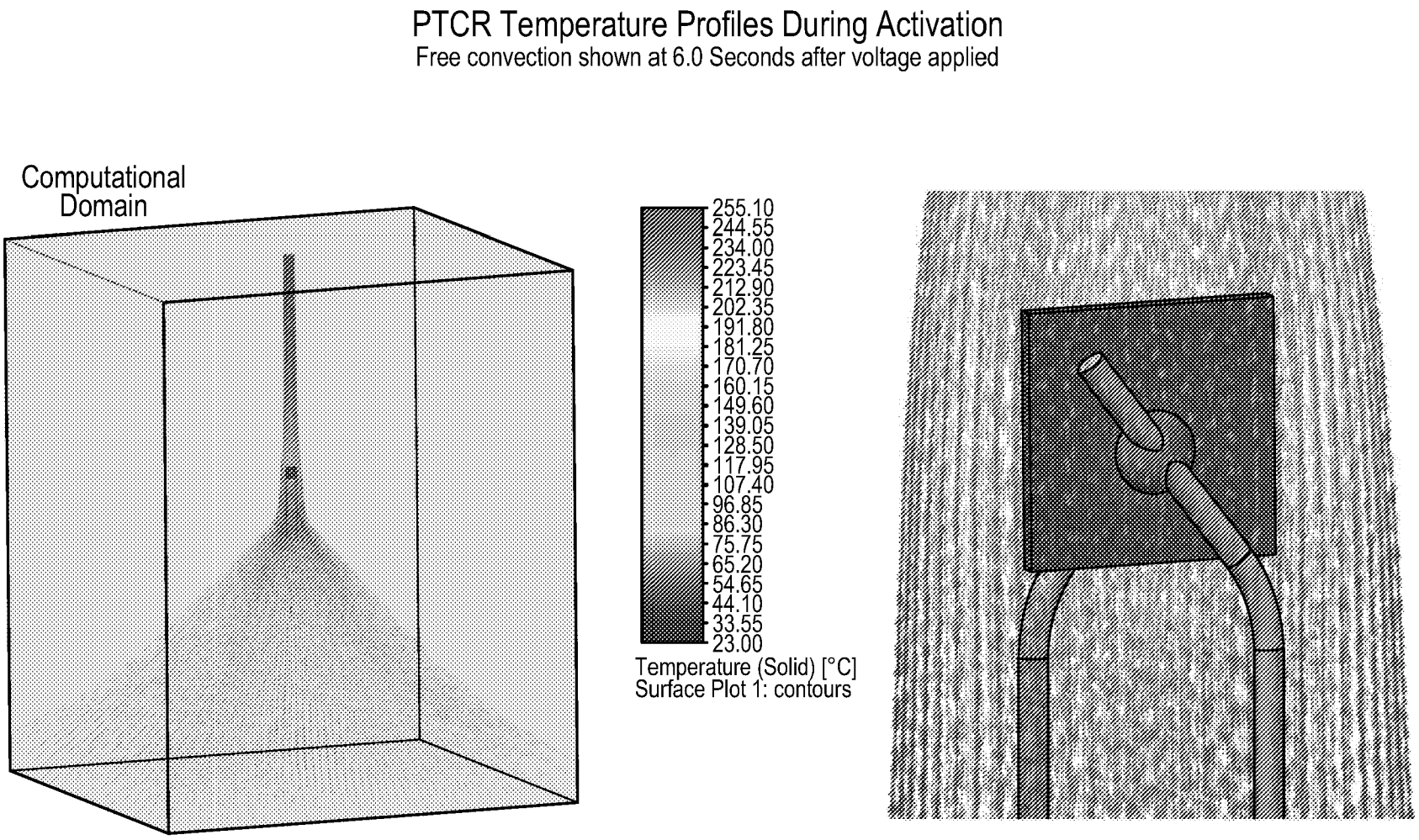
FIG. 20 illustrates modeled temperatures of an example heating element 6.0 seconds after application of a voltage in a free convective state.

FIG. 19F illustrates the temperature 6.0 seconds after activation by applying a current to the PTCR heating element 850. The conductive leads 894 (e.g., yellow colored) have increased in temperature to about 200° C. The majority of the nonlinear PTCR material 890 and conductive layers 892 remains at temperature to about 250° C., with the area including connection 896 in the center being just slightly cooler at a temperature around 235° C. FIG. 20 illustrates modeled temperatures of an example heater 6.0 seconds after application of a voltage in a free convective state.

Figure 21A:
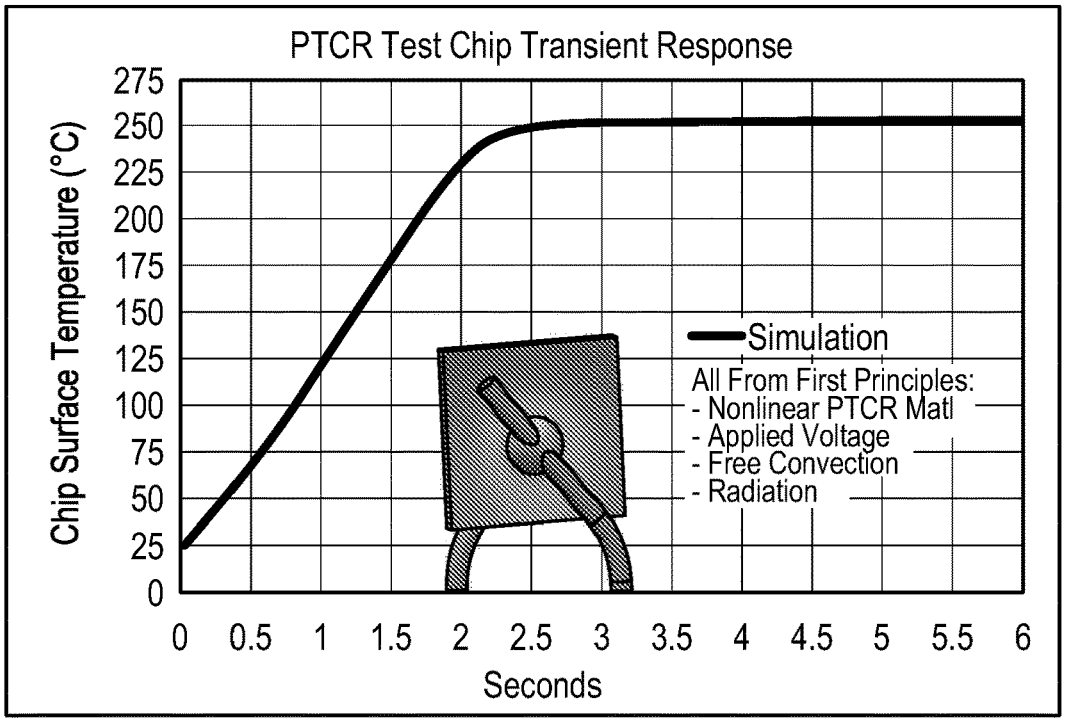
FIG. 21A graphically illustrates a modeled surface temperature as a function of time for an example PTCR heating element.

FIG. 21A illustrates a modeled surface temperature as a function of time for an example PTCR heating element. In the model, the surface temperature of the PTCR heating element starts at 25° C. (i.e. room temperature) at time zero. After an electrical current is applied, the surface temperature increases linearly for about 2 seconds to a temperature of about 225° C. After about 2 seconds, the rate of the temperature increase tapers off to a steady-state operating temperature of about 250° C. that is achieve about 3 seconds after activation. In the model, it was assumed that the nonlinear PTCR material is in a non-contact, free convective state, and the emitted radiation was measured from a distance. In some implementations, the PTCR heating element is heated to an operating temperature between 240° C. and 280° C. In some implementations, the PTCR heating element is heated to an operating temperature between 245° C. and 255° C. In some implementations, the PTCR heating element is heated to an operating temperature about 250° C.

Figure 21B:
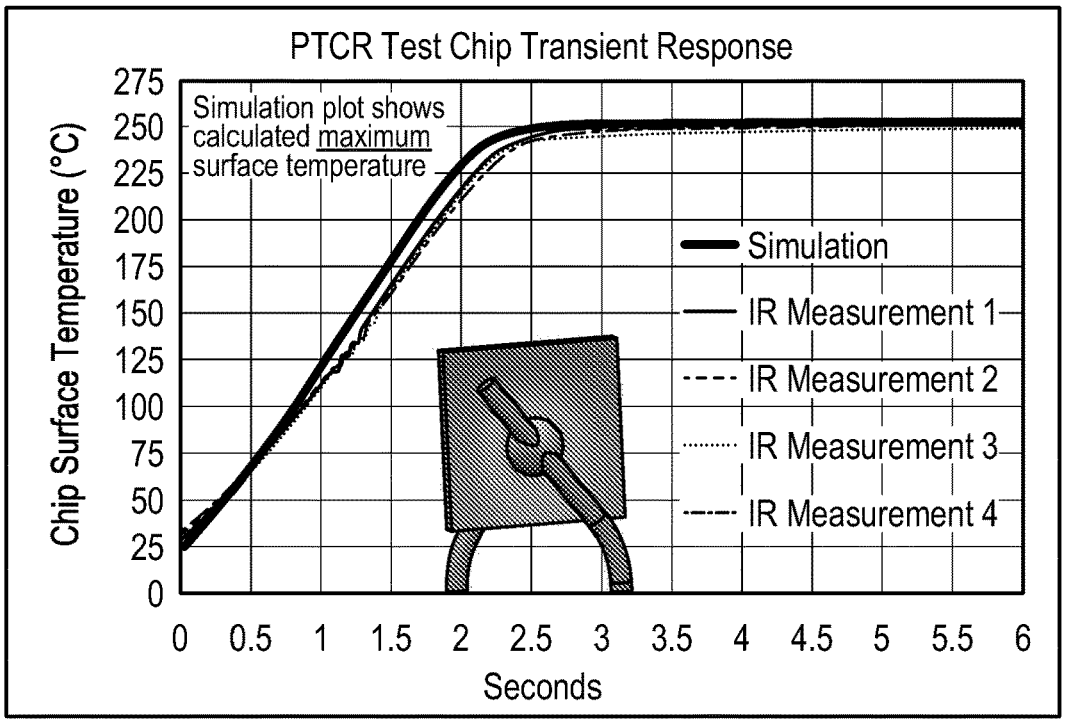
FIG. 21B graphically illustrates a modeled and measured maximum surface temperatures as a function of time of an example PTCR heating element.

FIG. 21B illustrates a modeled and measured maximum surface temperatures as a function of time for an example PTCR heating element. Four measurements were repeated using an infrared camera to measure the maximum surface temperatures of the PTCR heating element as a function of time, which were then plotted against the model of the maximum surface temperature. In the model, it was assumed that the nonlinear PTCR material is in a non-contact, free convective state and the emitted radiation was measured from a distance. In each case, the maximum surface temperature of the PTCR heating element starts at about 25° C. (i.e. room temperature) at time zero. After an electrical current is applied, the maximum surface temperature increases linearly for about 2 seconds to a temperature of about 225° C. After about 2 seconds, the rate of the temperature increase tapers off to a steady-state operating temperature of about 250° C. that is achieve about 3 seconds after activation. In some implementations, the PTCR heating element is heated to an operating temperature between 240° C. and 280° C. In some implementations, the PTCR heating element is heated to an operating temperature between 245° C. and 255° C. In some implementations, the PTCR heating element is heated to an operating temperature about 250° C.

Figure 21C:
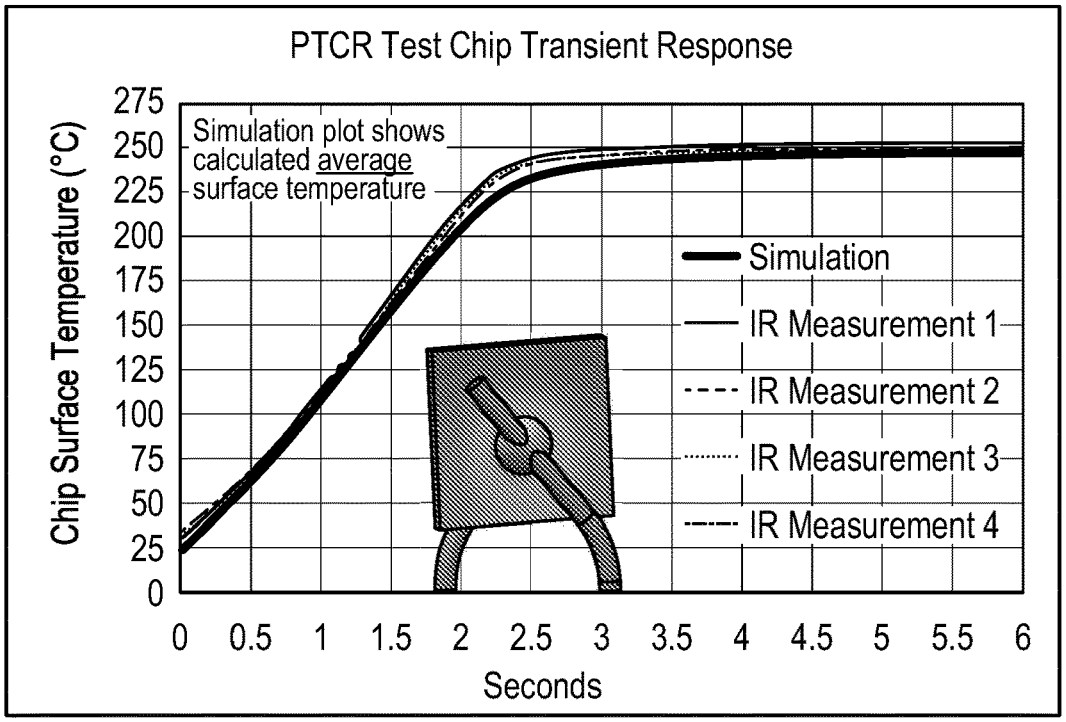
FIG. 21C graphically illustrates a modeled and measured average surface temperatures as a function of time of an example PTCR heating element.

FIG. 21C illustrates a modeled and measured average surface temperatures as a function of time for an example PTCR heating element. Four measurements were repeated using an infrared camera to measure the average surface temperatures of the PTCR heating element as a function of time, which were then plotted against the model of the average surface temperature. In the model, it was assumed that the nonlinear PTCR material is in a non-contact, free convective state and the emitted radiation was measured from a distance. In each case, the average surface temperature of the PTCR heating element starts at about 25° C. (i.e. room temperature) at time zero. After an electrical current is applied, the maximum surface temperature increases linearly for about 2 seconds to a temperature of about 225° C. After about 2 seconds, the rate of the temperature increase tapers off to a steady-state operating temperature of about 250° C. that is achieve about 3 seconds after activation. In some implementations, the PTCR heating element is heated to an operating temperature between 240° C. and 280° C. In some implementations, the PTCR heating element is heated to an operating temperature between 245° C. and 255° C. In some implementations, the PTCR heating element is heated to an operating temperature about 250° C.

Figure 22:
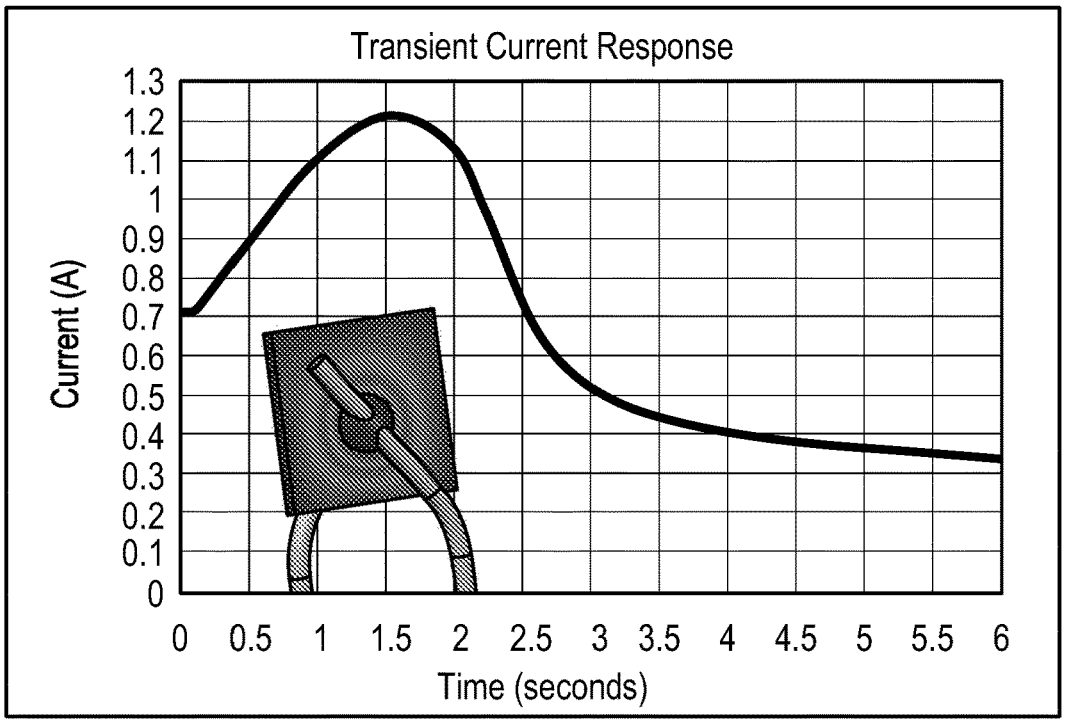
FIG. 22 graphically illustrates a transient current response as a function of time for an example PTCR heating element.

FIG. 22 illustrates a transient current response as a function of time of an example PTCR heating element, consistent with implementations of the current subject matter. In the graph, the current is measured in amps, which increases at a near linear rate, and reaches a peak draw after about 1.5 seconds from activation. Thereafter, the resistance quickly increases to reduce the current draw as the PTCR heating element achieves a self-regulating operating temperature.

Uniform temperature can be a desirable performance attribute of PTCR heaters, providing a distinct advantage over series coil heaters, including series heaters having power input controlled by temperature sensors, electronic circuits with microprocessors, and sophisticated algorithms dedicated to the purpose of temperature control. These existing series heaters can have overall power modulated in response to temperature measurement at a point or by average temperature estimated by overall electrical resistivity in combination with TCR (temperature coefficient of resistivity) of the typical series heating element. However, in some series heaters, temperatures within the series heater can vary by 40° C. or more because local differences in the thermal mass of the surrounding medium, and local differences in losses to the sounding medium, lead to variations in the local resistivity along the series heater.

In some implantations, a PTCR heating element 850 constructed with material having a nonlinear PTCR resistivity vs. temperature curve the same or similar to that shown in FIG. 14, with parallel geometry such as that shown in FIGS. 17A-17B, and with an adequate (e.g., 3V to 6V) differential voltage applied to conductive leads 894, each of a given control volume within such a PTCR heater will have a temperature within a narrow range, typically less than 10° C. This can be achieved even with differential thermal loading. The less than 10° C. range can be tailored for vaporization by controlling the materials and geometric arrangement of the PTCR heating element.

Alternative PTCR heater designs and geometries are possible.

Figure 23:
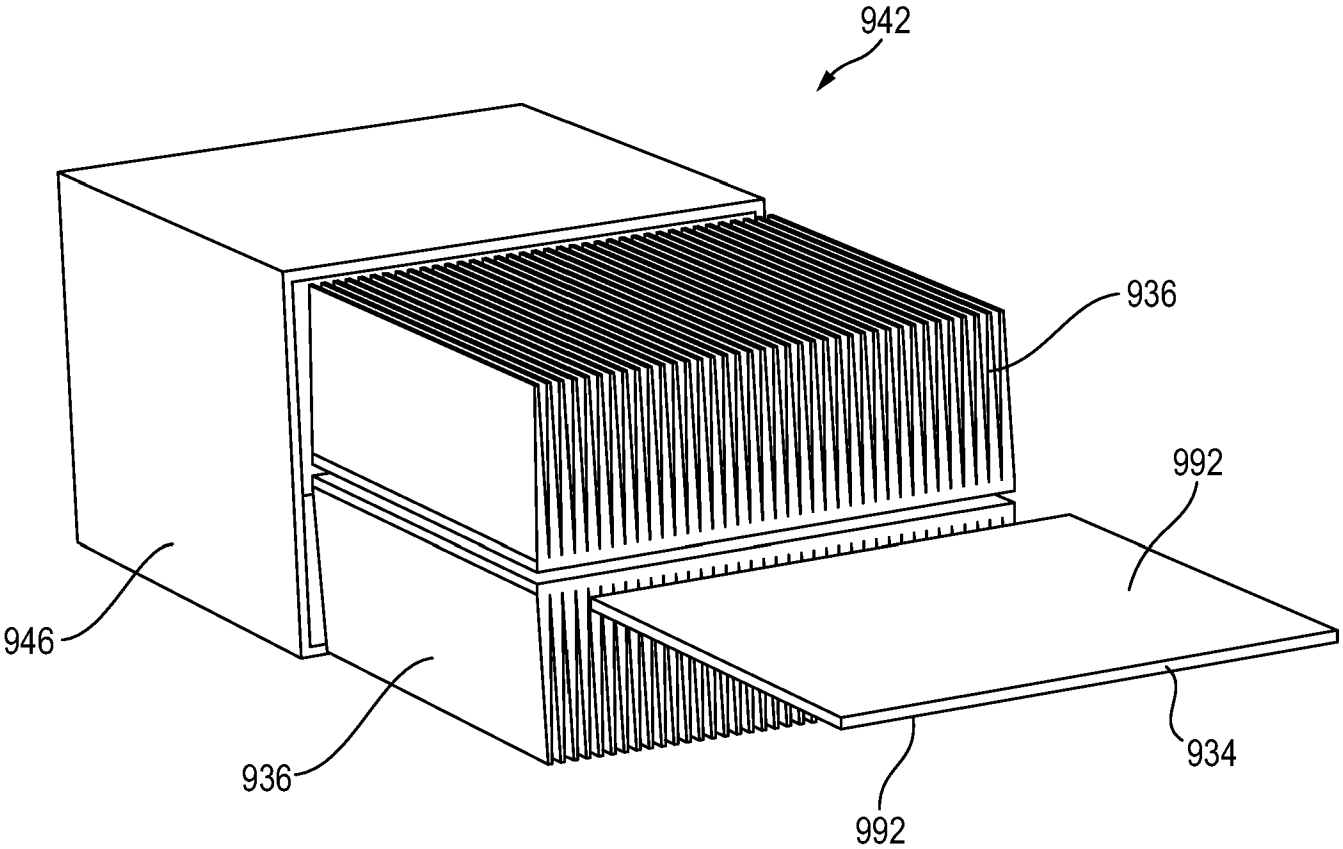
FIG. 23 is a perspective view of an example PTCR heater with heat exchanger assembly that can enable convective heating and improved uniform heating of vaporizable materials.

In some implementations, the PTCR heater can include a heat exchanger for the purpose of preheating air entering and passing through vaporizable materials. FIG. 23 is a perspective view of an example PTCR heater with heat exchanger assembly 942. The PTCR heater with heat exchanger assembly 942 may include a PTCR heating element 950 including a PTCR material 934, and a heat exchanger including heat exchanger elements 936 that can enable convective heating and improved uniform heating of vaporizable materials.

The PTCR heater with heat exchanger assembly 942 (also referred to as a rectangular PTCR air heater) includes the PTCR material 934 sandwiched between electrically conductive layers 992. In contact with the PTCR material 934 are the heat exchanger elements 936, which can be made of aluminum or other conductive material extrusion. Surrounding the heat exchanger elements 936 is a heater cover 946.

Figure 24:
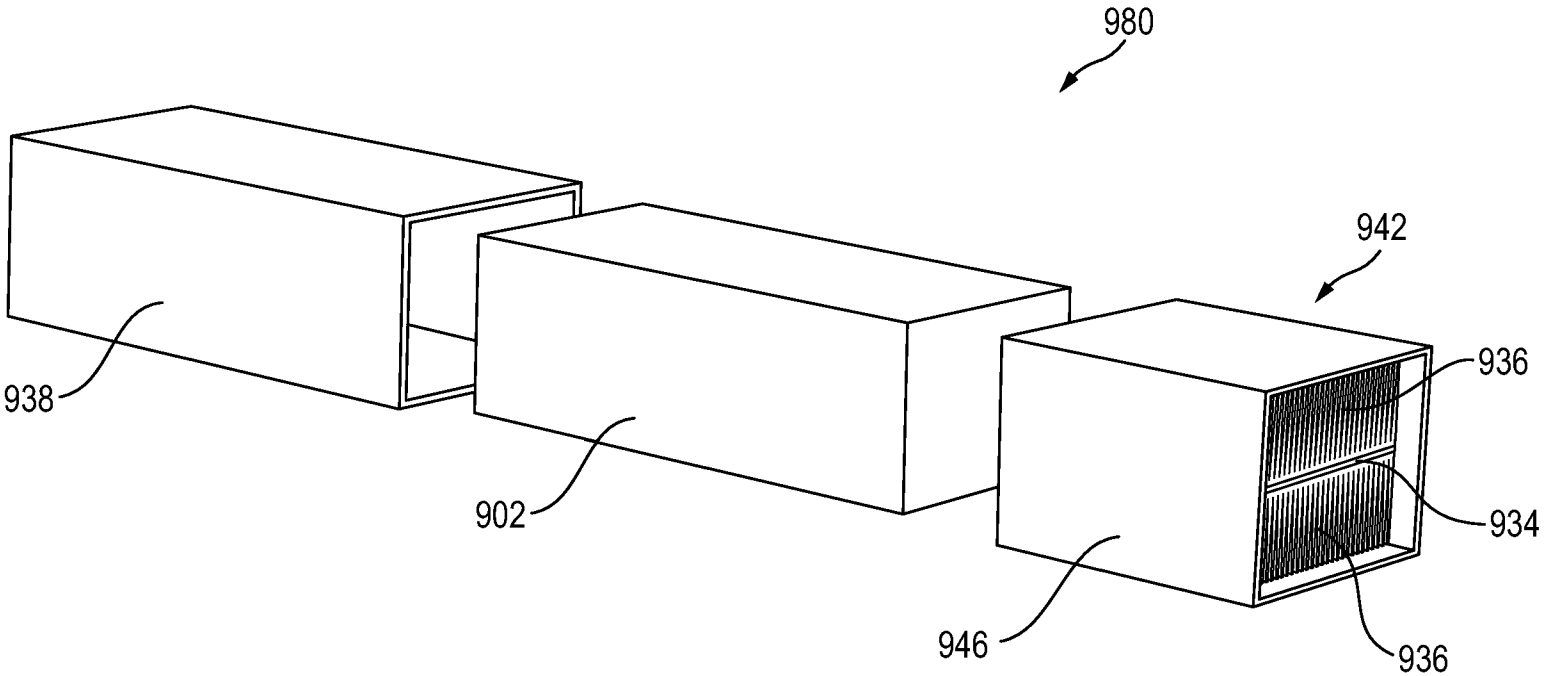
FIG. 24 is an exploded view of a rectangular embodiment of a PTCR insert for a vaporizer device.
Figure 25:
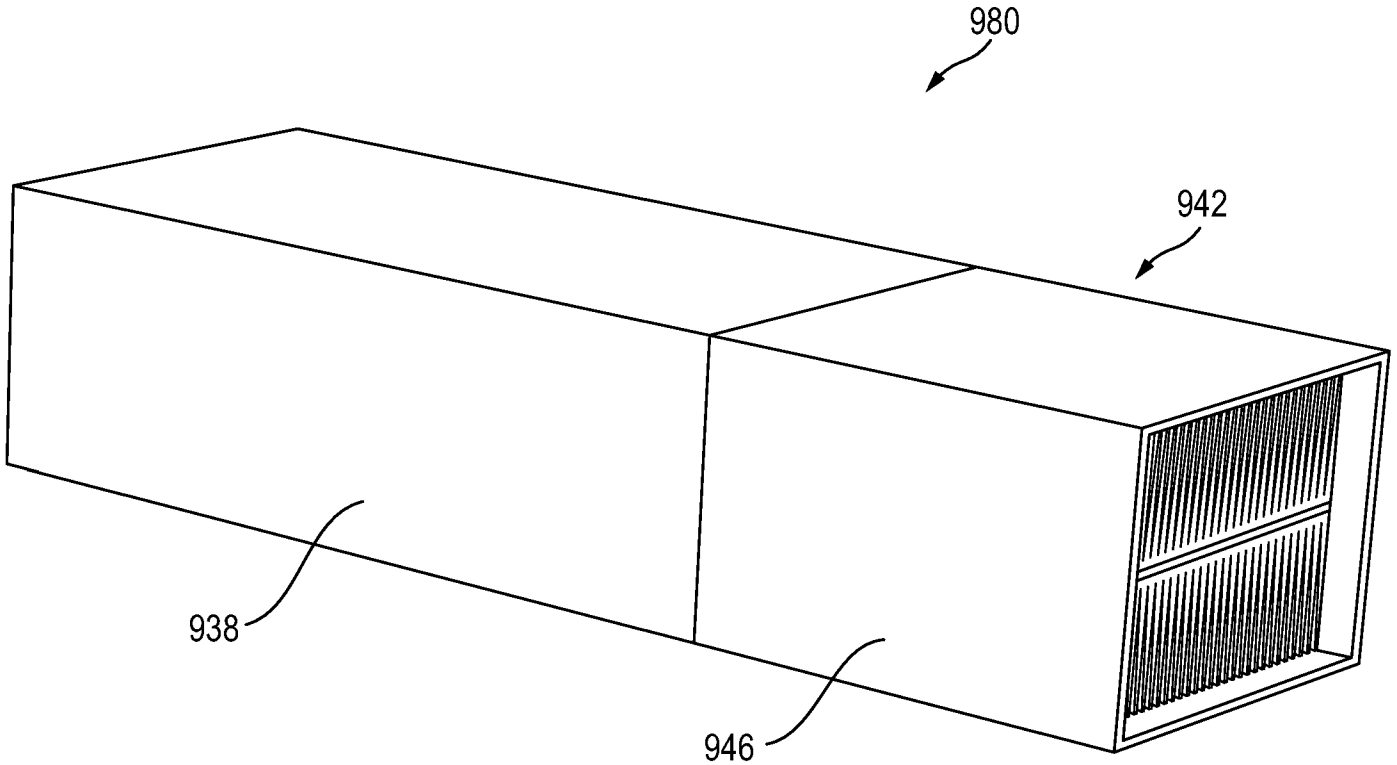
FIG. 25 is a perspective view of an assembled embodiment of a rectangular embodiment of a PTCR insert for a vaporizer device.

FIG. 24 is an exploded view of a rectangular embodiment of a PTCR insert 980. The PTCR insert 980 includes the PTCR heater with heat exchanger assembly 942, a disposable rectangular vaporizable material product 902 with a rectangular product cover 938. In some implementations, the vaporizable material product 902 and the product cover 938 can include a disposable containing a solid vaporizable material. In some implementations, the vaporizable material product 902 and the product cover 938 can include a disposable liquid cartridge (e.g., pod) containing a liquid vaporizable material and wick. FIG. 25 illustrates a perspective view of an assembled embodiment of the PTCR insert 980.

Figure 26:
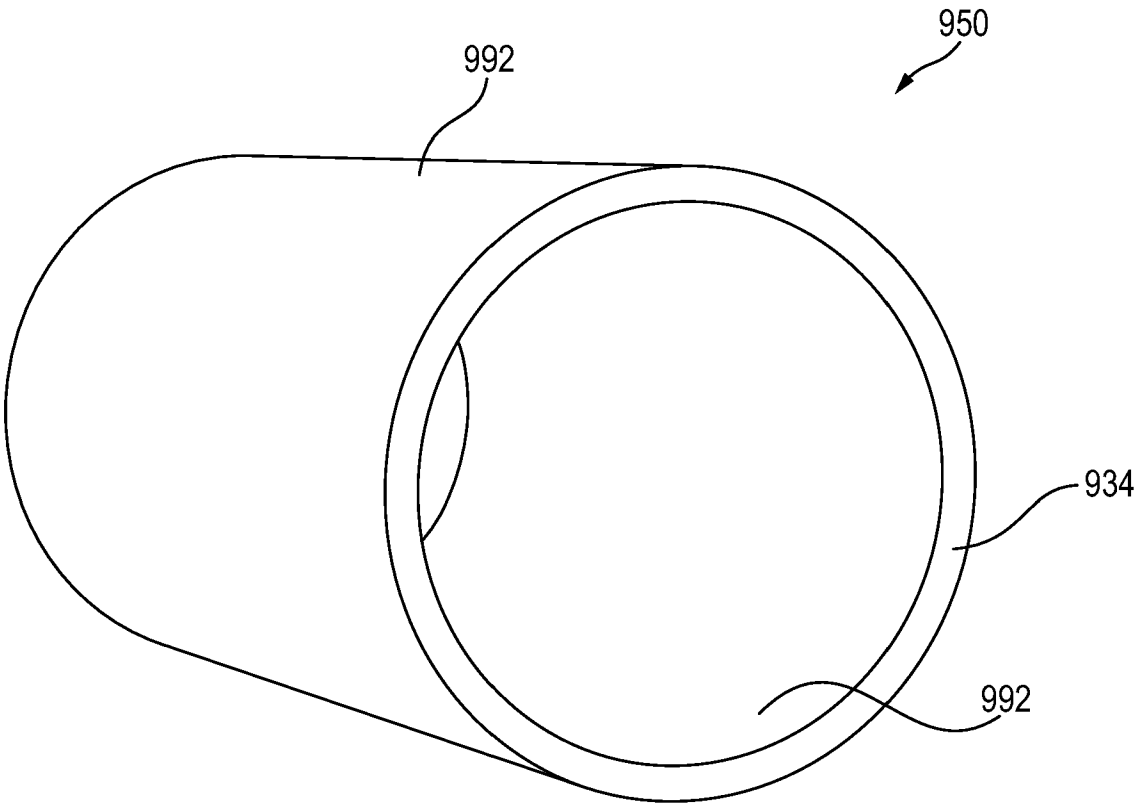
FIG. 26 is a perspective view of an example PTCR heating element with cylindrical geometry.

The current subject matter is not limited to rectangular geometries. For example, alternative designs of a PTCR heater with heat exchanger assembly 942 and/or PTCR insert 980 may depart from planar geometry in many possible configurations produced by extrusion or injection molding. For example, FIG. 26 is a perspective view of an example PTCR heating element 950 with cylindrical geometry. The example PTCR heating element 950 includes a cylindrical embodiment of the PTCR heating element 950 with cylindrical surface conductive layers 992.

Figure 27:
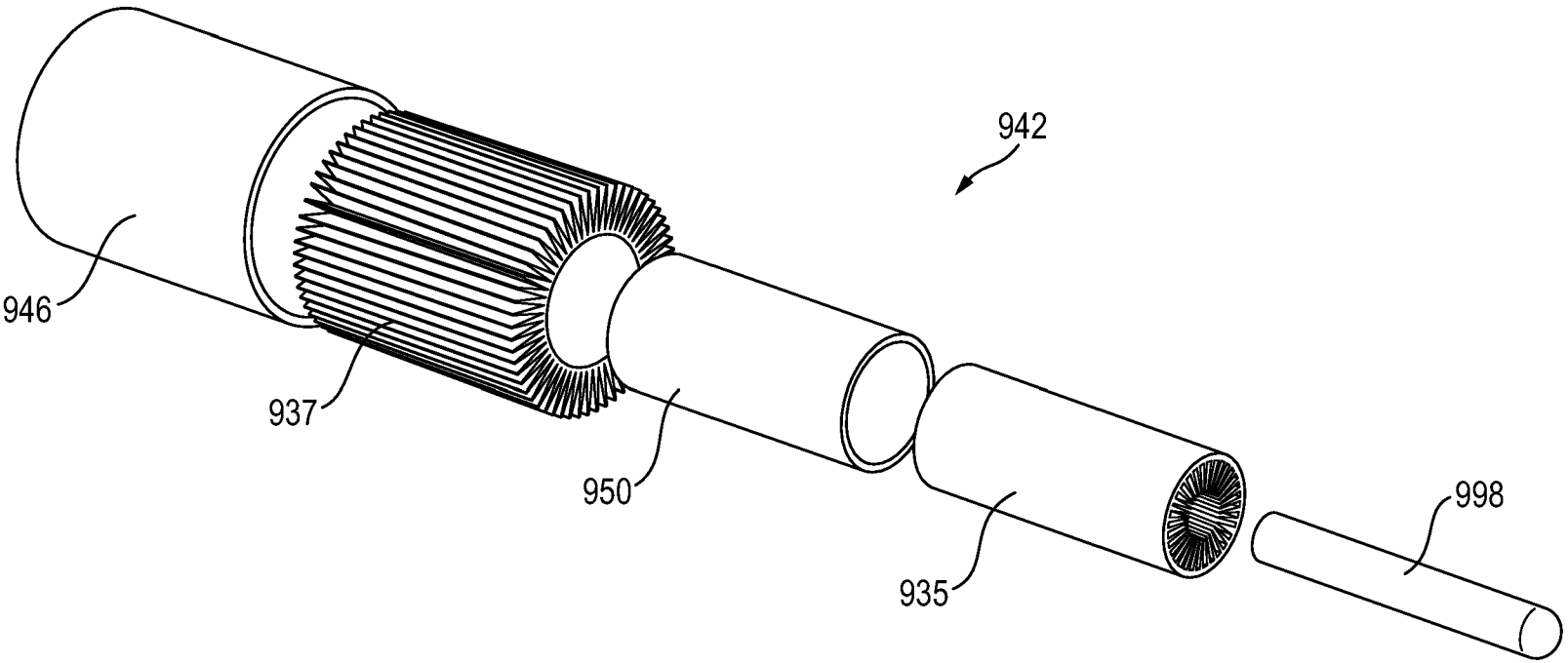
FIG. 27 is an exploded view illustrating an example cylindrical PTCR heater with heat exchanger assembly.
Figure 28:
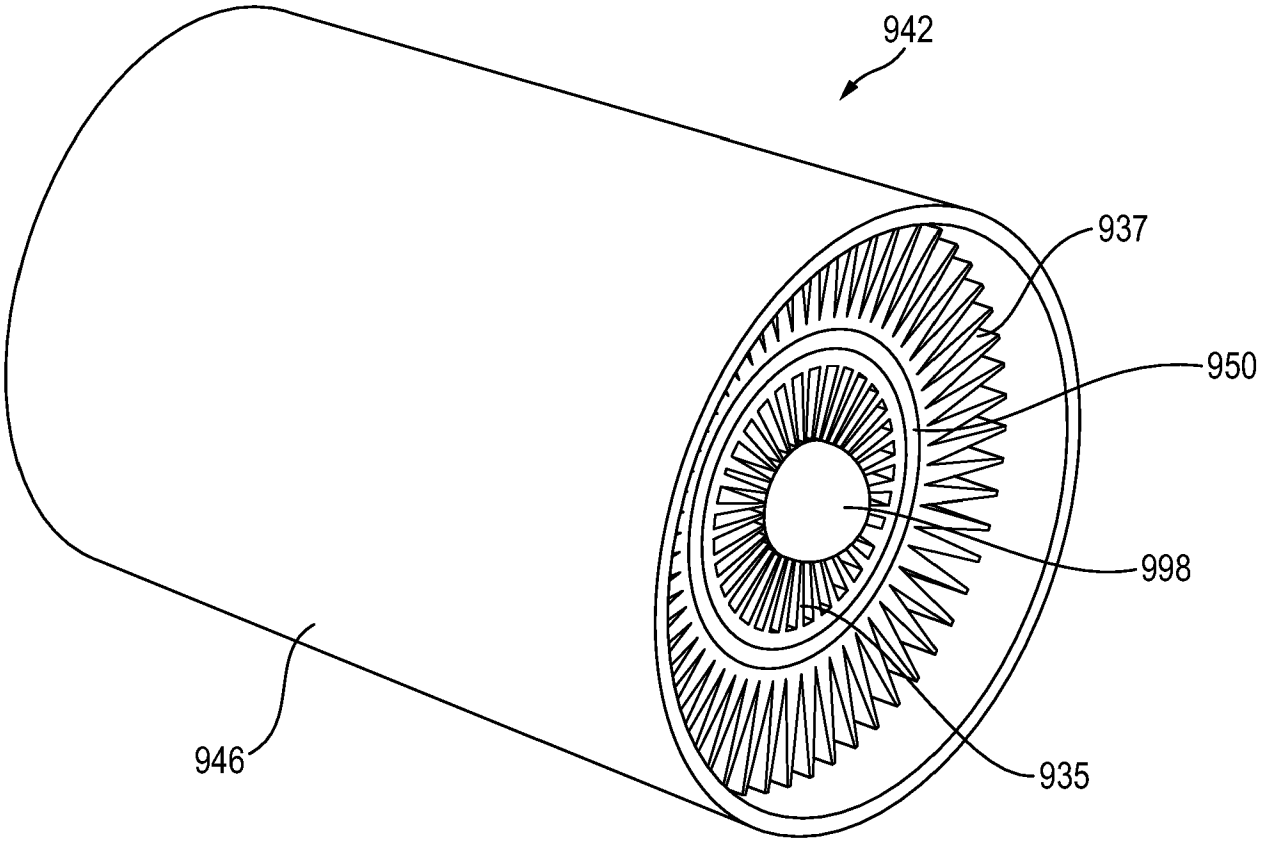
FIG. 28 is a perspective view of the example assembled cylindrical PTCR heater with heat exchanger assembly.
Figure 29:
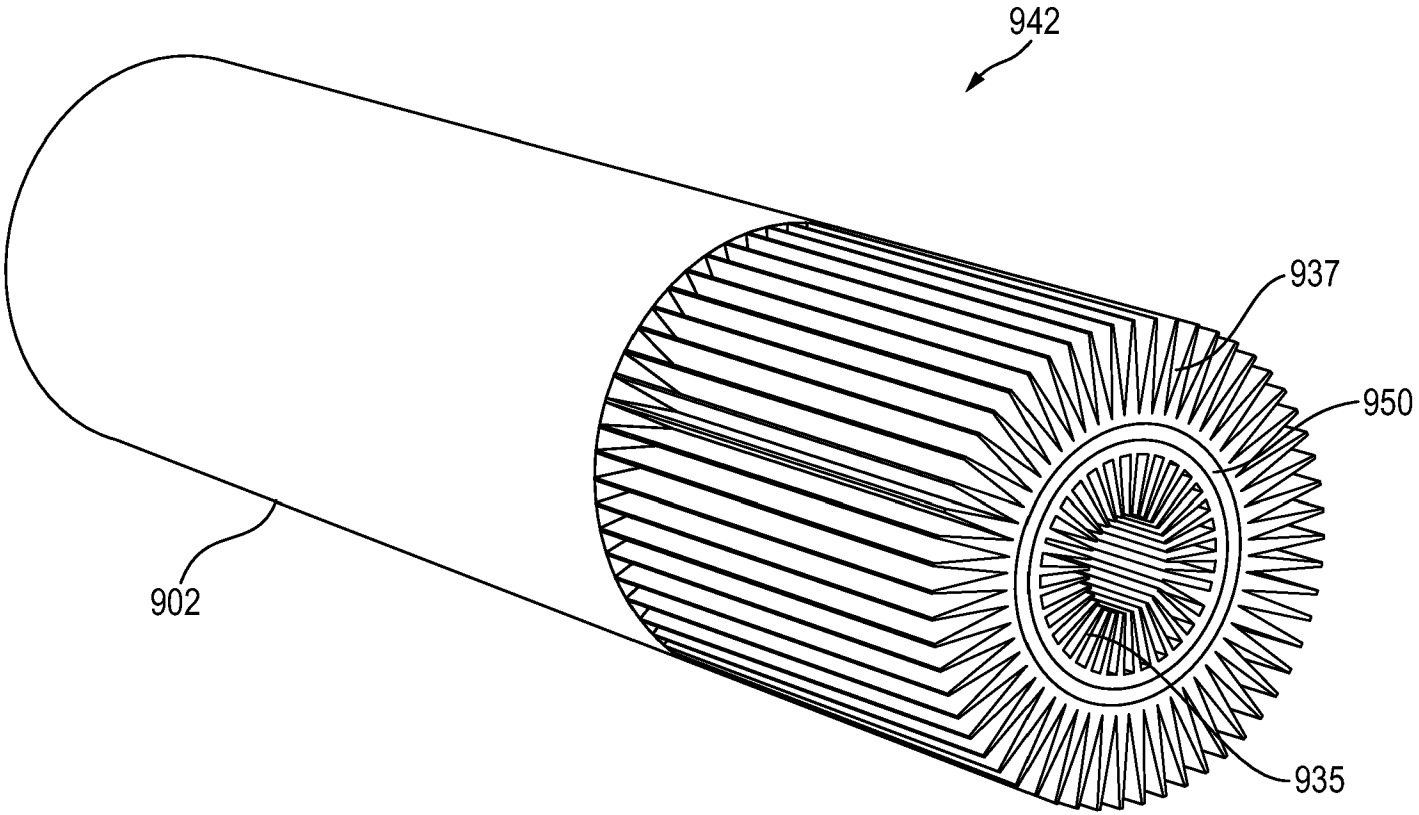
FIG. 29 is a perspective view of a cylindrical embodiment of the PTCR insert for a vaporizer device.

FIG. 27 is an exploded view illustrating an example cylindrical PTCR heater with heat exchanger assembly 942, which includes the PTCR heating element 950, external cylindrical heat exchanger 937, internal cylindrical heat exchanger 935, cylindrical flow diverter 998, and a heater cover 946. FIG. 28 is a perspective view of the example assembled cylindrical PTCR heater with heat exchanger assembly 942. FIG. 29 is a perspective view of a cylindrical embodiment of the PTCR insert 980 with the external covers and cylindrical flow diverter removed, thereby showing orientation of the cylindrical PTCR heater with heat exchanger assembly 942, external cylindrical heat exchanger 937, and internal cylindrical heat exchanger 935 aligned with a cylindrical embodiment of the vaporizable material product 902.

Figure 30:
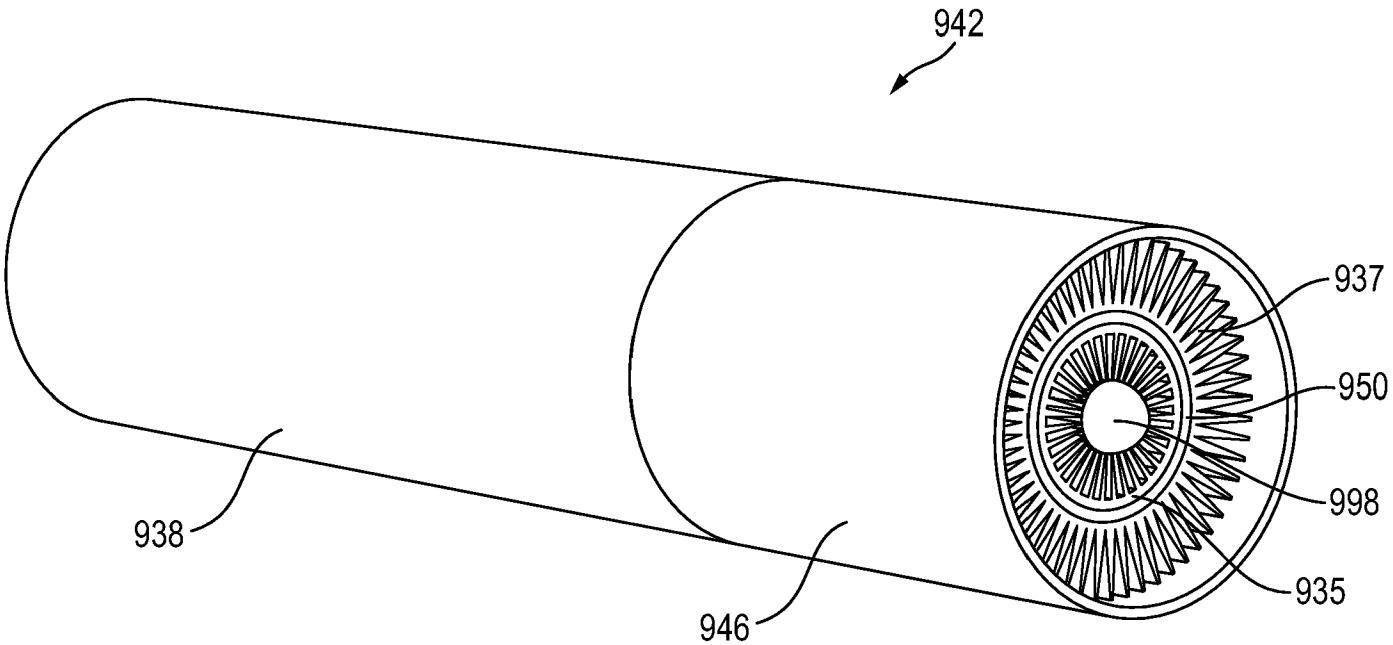
FIG. 30 is a perspective view of the example cylindrical PTCR heater with heat exchanger assembly.

FIG. 30 is a perspective view of the example cylindrical PTCR heater with heat exchanger assembly 942 including the PTCR heating element 950, external cylindrical heat exchanger 937, internal cylindrical heat exchanger 935, cylindrical flow diverter 998, heater cover 946, and a cylindrical product cover 938 (which, in FIG. 23, obscures the vaporizable material product 902).

FIG. 31 illustrates an example graphical illustration of the logarithm of resistivity of an example cylindrical vaporization device with PTCR heater as a function of temperature. The performance illustrated in FIG. 31 is according to example calculations characterizing a performance of an example implementation of a cylindrical PTCR heater with heat exchanger assembly 942. The example cylindrical PTCR heater with heat exchanger assembly 942 is a HNB device, with HNB product, treated in the calculation as a porous medium, with specific area by mass $S_m \cong 10000$ $cm^2/g$, density $\rho \cong 300$ $kg/m^3$. Convective heat transfer constant $h \cong 2.0$ $W/m^2K$. Surface area by volume can be calculated as $S_{vol} = S_m \times \rho = 10000$ $cm^2/g \times 1000$ $g/kg \times m^2/10000$ $cm^2$, and $S_{vol} \cong 1000$ $m^2/kg$ from which volumetric heat exchange coefficient $\nu = h\rho(S_{vol}) \cong 6.0$ E5 $W/m^3K$.

For the calculations, ambient conditions were 20.05° C. at standard pressure of 1 atmosphere. Input airflow rate was constant at 1.4 l/m, applied voltage was constant 3.7 volts across opposing electrically conductive layers 992. No electric current restrictions were applied beyond PTCR behavior shown in FIG. 26.

The calculated cylindrical vaporization device with PTCR heater included electrically conductive layers 992 that were silver, external cylindrical heat exchanger 937 and internal cylindrical heat exchanger 935 that were aluminum extrusions, cylindrical flow diverter 998 and heater cover 946 were polytetrafluoroethylene (PTFE), and product cover 938 was paper.

Figure 32:
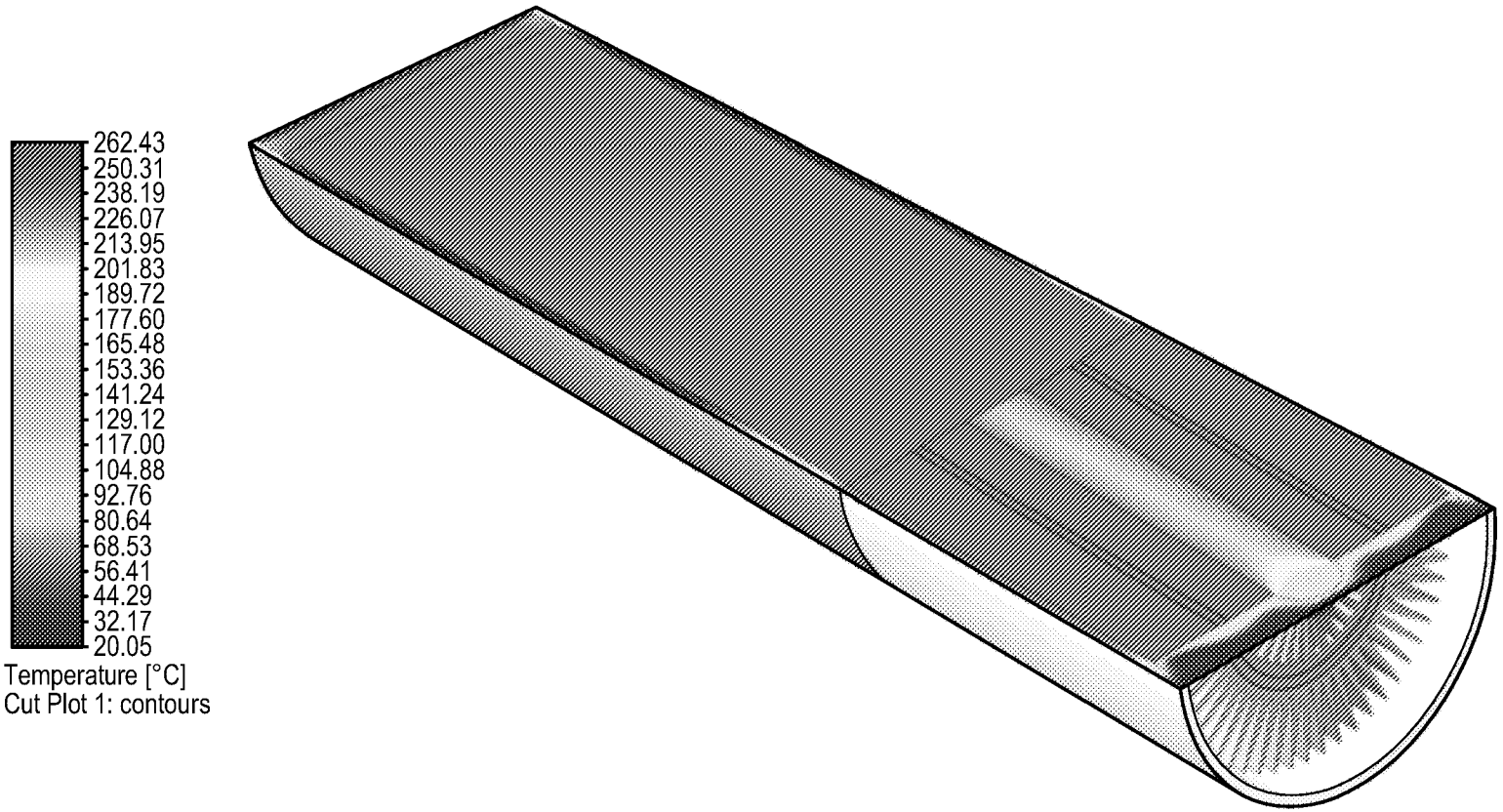
FIG. 32 is a cross-sectional graphical illustration showing temperature simulations of the example implementation of the cylindrical vaporization device with PTCR heater.
Figure 33A:
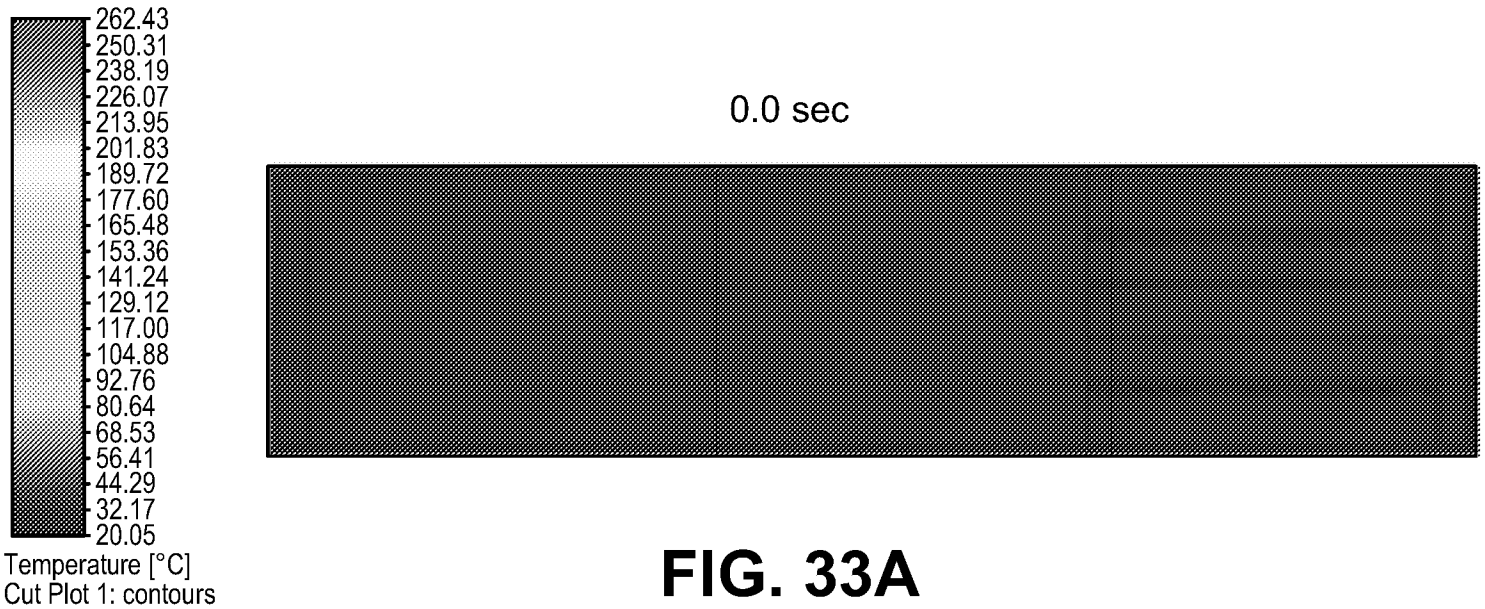
FIGS. 33A-33G illustrate example cross-sectional graphical illustrations showing transient response of temperature for an example implementation of the cylindrical vaporization device with PTCR heater.
Figure 33B:
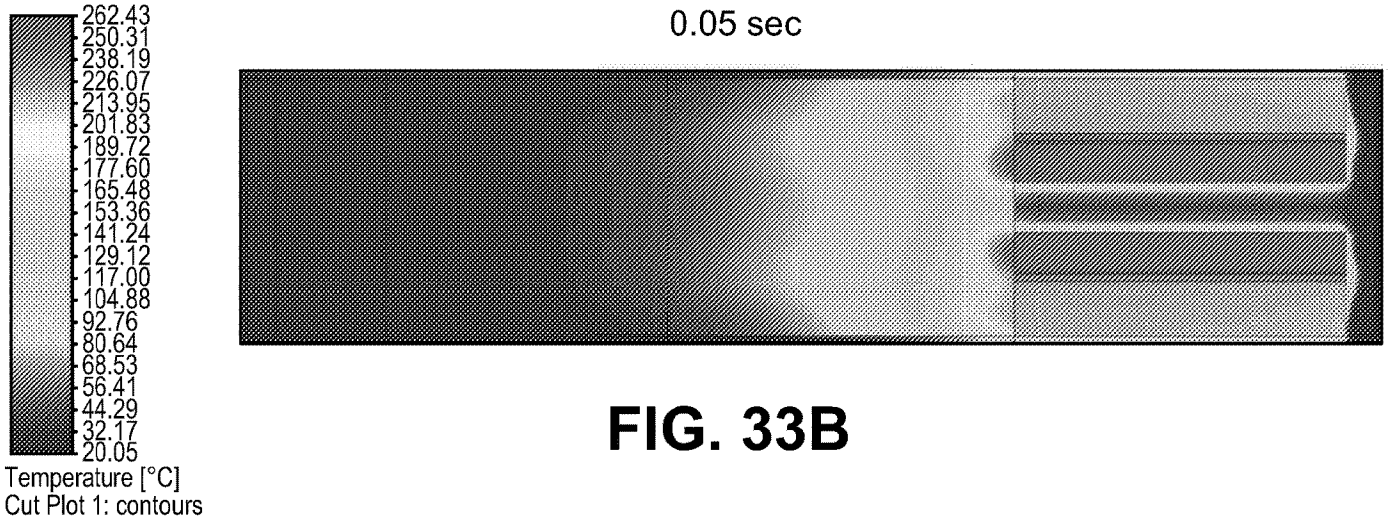
Figure 33C:
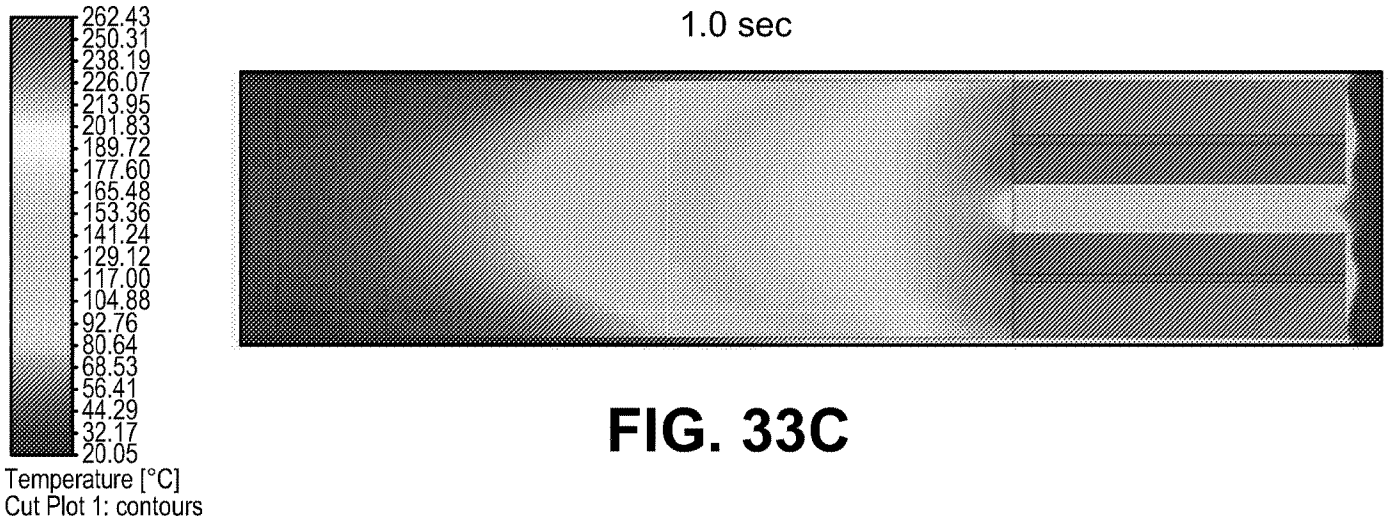
Figure 33D:
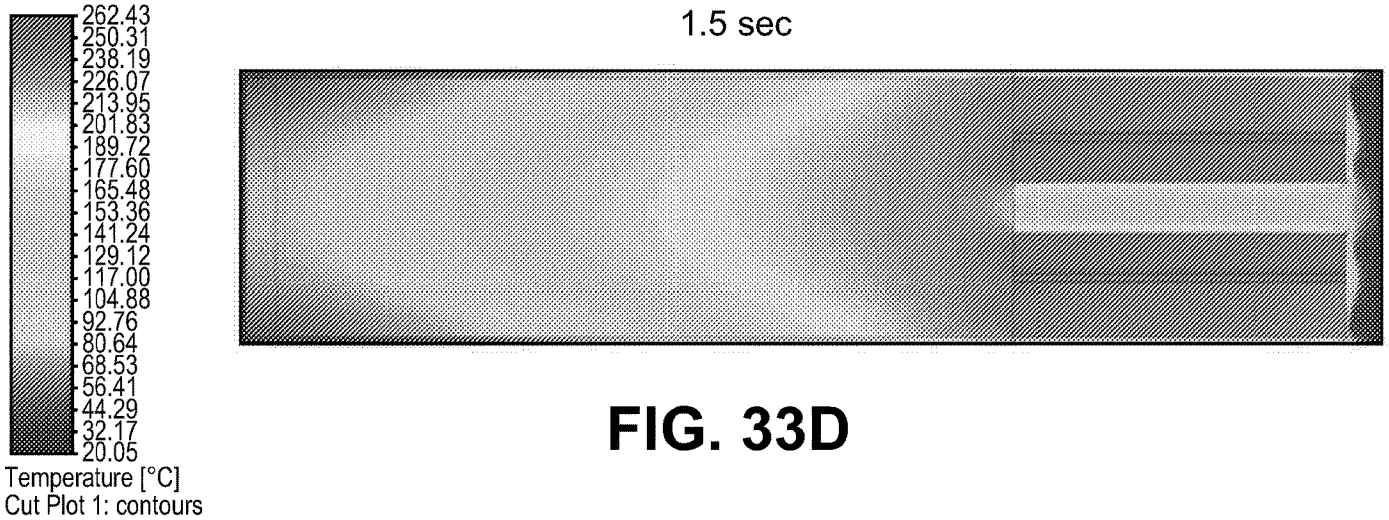
Figure 33E:
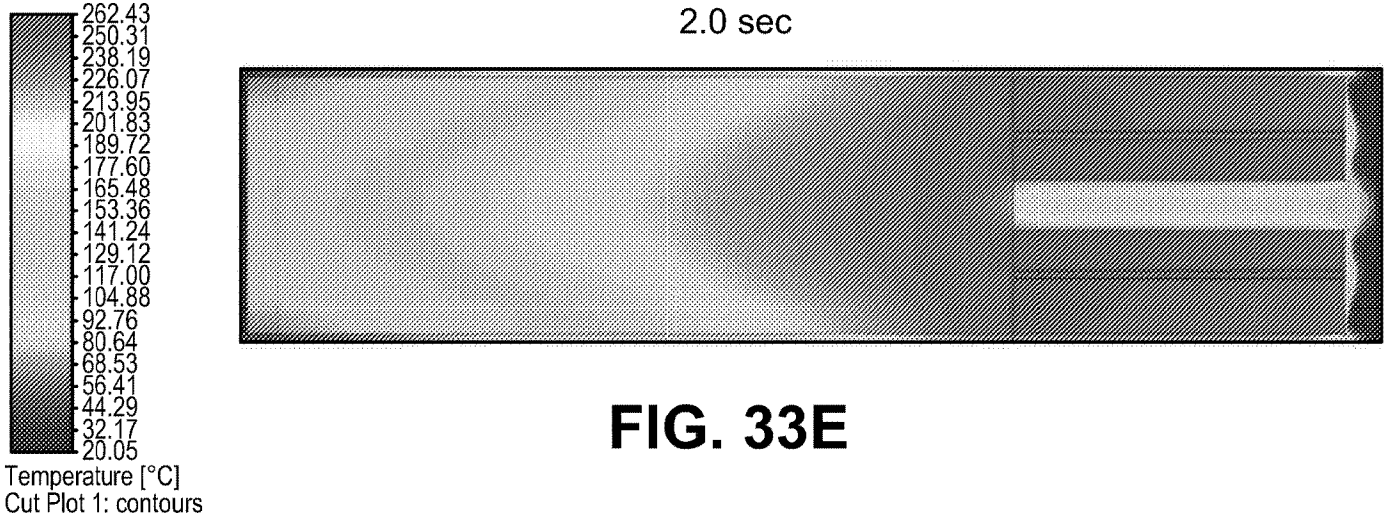
Figure 33F:
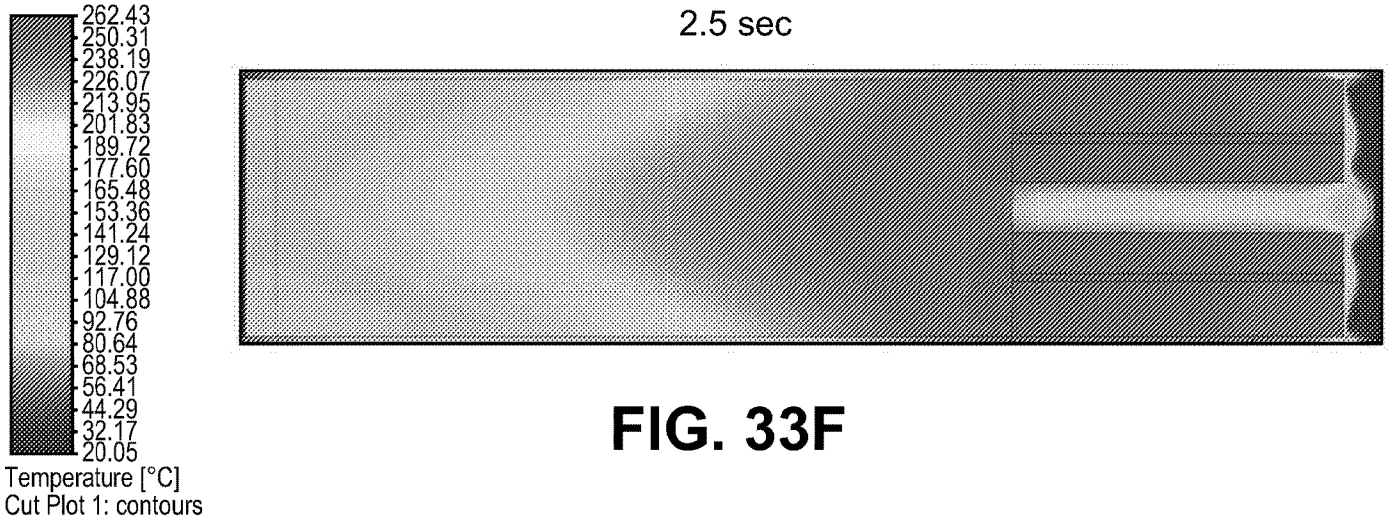
Figure 33G:
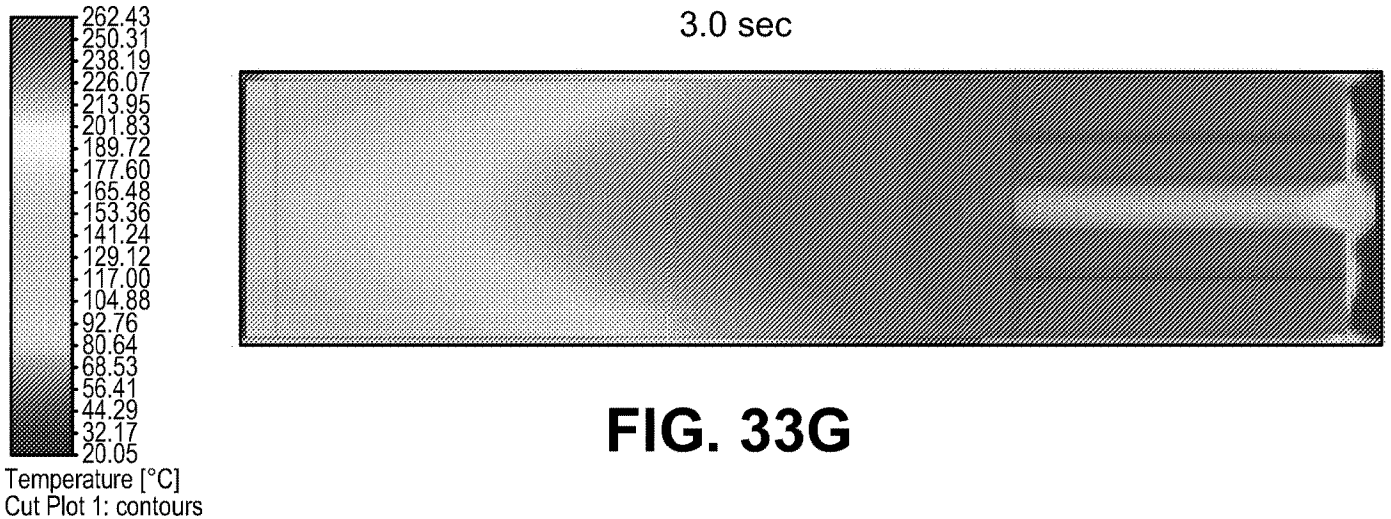

FIG. 32 is a cross-sectional graphical illustration showing temperature simulations of the example implementation of the cylindrical vaporization device with PTCR heater described above with respect to FIG. 33. FIGS. 33A-33G illustrate example cross-sectional graphical illustrations showing transient response of temperature as color for the example implementation of the cylindrical vaporization device with PTCR heater. FIGS. 33A-33G demonstrate that temperatures everywhere never exceed 280° C., well below combustion temperatures. It can also be seen in FIGS. 33A-33G that heating of solid vaporizable material proceeds in a wave from upstream to downstream such that cross-sectional hot spots and resulting differential porosity voids are eliminated.

Terminology

When a feature or element is herein referred to as being "on" another feature or element, it can be directly on the other feature or element or intervening features and/or elements can also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements can be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature can have portions that overlap or underlie the adjacent feature.

Terminology used herein is for the purpose of describing particular embodiments and implementations only and is not intended to be limiting. For example, as used herein, the singular forms "a," "an," and "the" are intended to include the plural forms as well, unless the context clearly indicates otherwise.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;"

"one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device can be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers can be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value can have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes can be made to various embodiments without departing from the teachings herein. For example, the order in which various described method steps are performed may often be changed in alternative embodiments, and in other alternative embodiments, one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system can include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Use of the term "based on," herein and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described herein can be directed to various combinations and subcombinations of the disclosed features and/or combinations and subcombinations of several further features disclosed herein. In addition, the logic flows depicted in the accompanying figures and/or described herein do not necessarily require the particular order shown, or sequential order, to achieve desirable results. Other implementations may be within the scope of the following claims.

What is claimed is:

1. A vaporizer device comprising:

a housing including an air inlet;

a heating element within the housing and arranged to receive airflow from the air inlet, the heating element including a nonlinear positive temperature coefficient of resistance material; and a heat exchanger thermally coupled to the heating element and configured to transfer heat between the heating element and the airflow to heat air in the airflow, the vaporizer device capable of providing the heated air to a vaporizable material for vaporization of the vaporizable material.

2. The vaporizer device of claim 1, wherein the heat exchanger includes a first heat exchanger thermally coupled to a first side of the heating element, the heat exchanger including a second heat exchanger thermally coupled to a second side of the heating element.

3. The vaporizer device of claim 1, wherein the heat exchanger includes a plurality of fin features.

4. The vaporizer device of claim 1, further comprising:

a flow diverter located in a path of the airflow and configured to divert a portion of the airflow through the heat exchanger.

5. The vaporizer device of claim 1, wherein the housing includes a cover containing the heat exchanger.

6. The vaporizer device of claim 1, further comprising:

a cartridge located downstream of the heating element and oriented to receive the heated air, wherein downstream is with respect to the airflow.

7. The vaporizer device of claim 1, further comprising:

a cartridge configured to contain the vaporizable material, wherein the housing includes a connector configured to couple the housing to the cartridge.

8. The vaporizer device of claim 7, wherein the cartridge includes a solid vaporizable material.

9. The vaporizer device of claim 7, wherein the cartridge includes a reservoir, liquid vaporizable material within the reservoir, and a wick in fluidic communication with the liquid vaporizable material, wherein the cartridge is configured to receive the heated air and direct the heated air over the wick.

10. The vaporizer device of claim 9, wherein the cartridge includes a mouthpiece, and the wick is located in a path of the airflow between the heating element and the mouthpiece.

11. The vaporizer device of claim 7, wherein the cartridge includes a second air inlet configured to draw a second airflow into the cartridge for mixing with the heated air and within a reservoir located in a path of the airflow downstream from the heat exchanger and the vaporizable material.

12. The vaporizer device of claim 7, wherein the cartridge includes:

a reservoir;

liquid vaporizable material within the reservoir;

a wick in fluidic communication with the liquid vaporizable material, the wick arranged to receive the heated air from the heat exchanger to produce vaporized vaporizable material in the form of an inhalable aerosol;

a solid vaporizable material arranged to receive the vaporized vaporizable material from the wick; and a mouthpiece configured to receive the vaporized vaporizable material after the vaporized vaporizable material passes through the solid vaporizable material.

13. The vaporizer device of claim 1, further comprising:

a first cartridge including a reservoir, liquid vaporizable material within the reservoir, and a wick in fluidic communication with the liquid vaporizable material, the wick arranged to receive the heated air from the heat exchanger to produce vaporized vaporizable material in the form of an inhalable aerosol; and a second cartridge including a solid vaporizable material and a mouthpiece, the solid vaporizable material arranged to receive the vaporized vaporizable material from the wick, and the mouthpiece configured to receive the vaporized vaporizable material after the vaporized vaporizable material passes through the solid vaporizable material;

wherein the first cartridge is removably coupled to the housing, and wherein the second cartridge is removably coupled to the housing and/or the first cartridge.

14. The vaporizer device of claim 13, wherein the first cartridge and the second cartridge are disposable cartridges.

15. The vaporizer device of claim 13, wherein the second cartridge includes a second air inlet for mixing ambient temperature air with the vaporized vaporizable material after the vaporized vaporizable material passes through the solid vaporizable material.

16. The vaporizer device of claim 13, further comprising a fibrous body arranged to receive and cool the vaporized vaporizable material after the vaporized vaporizable material passes through the solid vaporizable material.

17. The vaporizer device of claim 1, wherein the nonlinear positive temperature coefficient of resistance material includes an electrical resistivity transition zone characterized by an increase in electrical resistivity over a temperature range such that, when the heating element is heated to a first temperature within the electrical resistivity transition zone, current flow from a power source is reduced to a level that limits further temperature increases of the heating element from current flow.

18. The vaporizer device of claim 1, wherein the increase in electrical resistivity over a temperature range of an electrical resistivity transition zone includes an increase factor of at least 10, the increase factor characterizing a relative change in electrical resistivity between electrical resistivity at a first temperature associated with a start of the electrical resistivity transition zone and electrical resistivity at a second temperature associated with an end of the electrical resistivity transition zone.

19. The vaporizer device of claim 1, wherein an electrical resistivity transition zone begins at a first temperature and electrical resistivity of the heating element at temperatures below the first temperature is between 0.2 ohm-cm and 200 ohm-cm.

20. The vaporizer device of claim 1, further comprising:

a power source configured to provide a voltage between 3 Volts and 50 Volts to the heating element;

a pressure sensor; and a controller coupled to the pressure sensor and configured to detect inhalation and in response electrically connect the power source to the heating element.

* * * * *